US011639583B1

(12) United States Patent
Janson

(10) Patent No.: US 11,639,583 B1
(45) **Date of Patent: *May 2, 2023**

(54) RAIL TIE PLATE WITH SPIKE RETENTION CAPABILITY

(71) Applicant: Paul M. Janson, Porter Ranch, CA (US)

(72) Inventor: Paul M. Janson, Porter Ranch, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/947,660

(22) Filed: Sep. 19, 2022

Related U.S. Application Data

(63) Continuation of application No. 17/719,935, filed on Apr. 13, 2022, now Pat. No. 11,492,762, which is a (Continued)

(51) Int. Cl.
*E01B 9/12* (2006.01)
*E01B 9/06* (2006.01)

(52) U.S. Cl.
CPC . *E01B 9/12* (2013.01); *E01B 9/06* (2013.01)

(58) Field of Classification Search
CPC ..... E01B 9/06; E01B 9/12
See application file for complete search history.

(56) References Cited

U.S. PATENT DOCUMENTS 457,584 A 8/1891 Goldie
1,511,548 A 10/1924 Rutherford
(Continued)

FOREIGN PATENT DOCUMENTS

DE 202007018602 U1 12/2008
EP 1948865 A1 7/2008

OTHER PUBLICATIONS

Hanzi Industrial International Co., Ltd, Products, retrieved from http://www.hanzirail.com/products.asp, retrieved on Sep. 7, 2022, 11 pages.

*Primary Examiner* — Robert J McGarry, Jr.
(74) *Attorney, Agent, or Firm* — Brian S. Steinberger; Hilary F. Steinberger; Law Offices of Brian S. Steinberger, P.A.

(57) ABSTRACT

Apparatus, devices, assemblies, systems and methods of using w spring clips over spikes for holding railroad tie spikes down to wood and concrete railroad ties and hold the spike heads to the rails. A first embodiment can use rail tie plates with box holders for holding end portions of a w shaped spring steel clip to press against cap heads of railroad tie spikes. A second embodiment can use a rail tie plates with vertical supports for horizontal bars over heads of railroad tie spikes. A third embodiment can use rail tie plates with vertical studs and upper threaded ends with flat plates attached by nuts over heads of rail road tie spikes, and with cotter pins locking the nuts in place. Additional embodiments include metal structures fastened, welded and/or forged to tie plates for allowing w shaped spring clips with mid portions that hold down heads on spikes to prevent the spikes from coming out. Additional embodiments can use concave side C-clips, convex side C-clips, double hook C-clips in flat plate and fire form, G-Clips and W-Clips with notches on leg ends. The embodiments can be used with auxiliary plates having welded bars over notch openings to hold down both heads of stakes and footer edges of rails.

27 Claims, 49 Drawing Sheets

Related U.S. Application Data continuation of application No. 17/503,297, filed on Oct. 16, 2021, now Pat. No. 11,359,335.

(60) Provisional application No. 63/204,697, filed on Oct. 19, 2020.

(56) References Cited

U.S. PATENT DOCUMENTS

| | | | |
|---|---|---|---|
| 1,646,630 | A | 10/1927 | Pronini |
| 2,035,885 | A | 3/1936 | Hojnowski |
| 2,299,308 | A | 10/1942 | Creighton |
| 2,629,557 | A | 2/1953 | Of Rosenberg |
| 3,067,947 | A | 12/1962 | Deenik |
| 3,429,506 | A | 2/1969 | Triplett |
| 3,939,617 | A | 2/1976 | Eisses |
| 4,050,284 | A | 9/1977 | Miller |
| 4,141,500 | A | 2/1979 | Gragnani |
| 4,150,792 | A | 4/1979 | Qureshi |
| 4,313,563 | A | 2/1982 | Young |
| 4,325,511 | A | 4/1982 | Young |
| 4,350,291 | A | 9/1982 | Dobson |
| 4,379,521 | A | 4/1983 | Young et al. |
| 4,399,941 | A | 8/1983 | Lubbers |
| 4,461,422 | A | 7/1984 | Harkus |
| 4,513,912 | A | 4/1985 | Schumaker |
| 4,756,477 | A | 7/1988 | Schumaker |
| 4,953,787 | A | 9/1990 | Fee |
| 5,520,330 | A | 5/1996 | Brown et al. |
| 5,549,245 | A | 8/1996 | Kish |
| 5,782,406 | A | 7/1998 | Igwemezie |
| 6,808,120 | B2 | 10/2004 | Oram et al. |
| D776,004 | S | 1/2017 | Pisano |
| 11,124,922 | B1 | 9/2021 | Janson |
| 11,359,335 | B2 | 6/2022 | Janson |
| 11,492,762 | B2 * | 11/2022 | Janson ..... E01B 9/06 |
| 2005/0036852 | A1 | 2/2005 | Berna |
| 2010/0224691 | A1 | 9/2010 | McQuistian |
| 2010/0301126 | A1 | 12/2010 | Meyer |
| 2013/0004705 | A1 | 1/2013 | Jaffe |
| 2014/0103132 | A1 | 4/2014 | Lienhard et al. |
| 2015/0033663 | A1 | 2/2015 | Kunz et al. |
| 2016/0298299 | A1 | 10/2016 | Hamilton et al. |
| 2018/0058012 | A1 | 3/2018 | Coats |
| 2021/0277608 | A1 | 9/2021 | Nguyen |

* cited by examiner

RAIL TIE PLATE WITH SPIKE RETENTION CAPABILITY

CROSS REFERENCE TO RELATED APPLICATIONS

This application is a Continuation-In-Part of U.S. patent application Ser. No. 17/719,935 filed Apr. 13, 2022, now U.S. Pat. No. 11,492,762, which is a Continuation of U.S. patent application Ser. No. 17/503,297 filed Oct. 16, 2021, now U.S. Pat. No. 11,359,335, which claims the benefit of priority to U.S. Provisional Application Ser. No. 63/204,697 filed Oct. 19, 2020, which is incorporated herein by specific reference thereto. The entire disclosure of each of the applications listed in this paragraph are incorporated herein by specific reference thereto.

FIELD OF INVENTION

This invention relates to railroad tie spikes, and in particular to apparatus, devices, assemblies, systems and methods of using clips over spikes for holding railroad tie spikes down to wood and concrete railroad ties and hold the spike heads to the rails.

BACKGROUND AND PRIOR ART

Trains run on rails supported on cross ties formed of wood. The rails are commonly made of a steel, and have mounting flanges. The mounting flanges are adapted to rest on metallic bearing plates, generally referred to as tie plates or fishplates. The fishplates rest on the wooden ties, and spikes are used for securing rails to wooden ties. Spikes are often inserted in an opening or cavity in the fishplate and the spike shank is driven into the tie. The head of the spike is generally adapted to engage with the flange of the rail, thereby securing the rail to the tie. Alternatively, the tie plates or fish plates are equipped with a metal clip or boss that engages to the flange of the rail, and the head of the spike is adapted to engage with the fishplate to secure the rail to the tie. See for example, U.S. Pat. No. 457,584 to Goldie; U.S. Pat. No. 4,141,500 to Gragnani; U.S. Pat. No. 4,350,291 to Dobson; U.S. Pat. No. 4,461,422 to Harkus; U.S. Pat. Nos. 4,513,912 and 4,756,477 to Schumaker and U.S. Pat. No. 6,808,120 to Oram et al.

FIG. 1 is an upper perspective exploded view of a prior art assembly 1 of spikes 2, 4, 6, 8 about to be attached through holes 13, 15 in a rail tie plate 10 to hold down a rail 20 to a rail tie 30. The side flanges of the rail 20 are positioned between the first ridge 12 and the second ridge 16 on top of the rail tie plate 10.

FIG. 2 is an upper perspective assembled view of the assembly 1 of FIG. 1 with spikes 2, 4 attached through a rail tie plate 10 holding a rail 20 to a rail tie 30. spikes 6, 8, not shown on the other side of the rail 20 also are driven into holes (not shown) in the rail tie plate 10 to hold the rail 20 to the rail tie 30.

Further attempts to secure or anchor a spike have included threaded spikes, and the like. See for example, U.S. Pat. No. 6,808,120 to Oram et al., Over time the ordinary spikes often work loose from the tie due to the working action that occurs as the rail deflects under the load and vibration of passing trains and due to expansion and contraction of the wood fibers of the tie due to temperature, humidity and other environmental changes. The loosening of the spikes will necessitate replacement of the spikes or other parts of the track assembly.

Furthermore, after such spikes have been in service an appreciable length of time, they will have a tendency to work in the hole established in the tie by the spike shank. Working of the spike acts to enlarge the hole surrounding the shank and to damage the surrounding wood fibers, causing the spike to loosen over time. The enlarged hole may also permit water and other chemicals to enter the hole surrounding the spike shank, thereby further weakening the spike or the surrounding wood fibers. Removal of the spikes usually causes additional damage to the ties. As such, spike removal often requires replacement of the entire tie in order to ensure that the replacement spike will anchor the rail to the tie with sufficient holding power.

The prior art does not describe, simple and effective techniques for protecting the spike heads from popping up from the ties over time to correct for the above discussed problems.

G-rail clips are well known. See for example E813 RAIL CLIP, E187 RAIL CLIP, and E2055 RAIL CLIP, manufactured by Hanzi Industrial International Co., Ltd. Of SHANGHAI, CHINA. See for example, U.S. Pat. No. 4,050,284 to Miller, which is incorporated by reference in its' entirety.

Many different types of rail clips are known and used with rail roads. See for example: U.S. Pat. No. 3,067,947 to Deenik; U.S. Pat. No. 3,939,617 to Eisses; U.S. Pat. No. 4,150,792 to Qureshi U.S. Pat. No. 4,050,284 to Miller; U.S. Pat. No. 4,325,511 to Young; U.S. Pat. No. 4,313,563 to Young; U.S. Pat. No. 4,379,521 to Young et al; U.S. Pat. No. 4,399,941 to Lubbers; U.S. Pat. No. 5,549,245 to Kish; which are all incorporated by reference. However, none of the known rail clips are used to hold down spikes to wood rail road ties.

Thus, the need exists for solutions to the above problems with the prior art.

SUMMARY OF THE INVENTION

A primary objective of the present invention is to provide apparatus, devices, assemblies, systems and methods of using clips over spikes for holding railroad tie spikes down to wooden ties and concrete ties and hold the spike heads to the rail so that the spikes will not come out.

A secondary objective of the present invention is to provide apparatus, devices, assemblies, systems and methods of using clips over spikes for retaining railroad tie spikes to railroad ties by w spring clips which press against the top of the head of the rail spikes and can be locked in place.

A third objective of the present invention is to provide apparatus, devices, assemblies, systems and methods of using clips over spikes for retaining railroad tie spikes to railroad ties by w spring clips which press against the top of the head of the rail spikes and can be locked in place.

A fourth objective of the present invention is to provide apparatus, devices, assemblies, systems and methods of using tie plates with vertical brackets having through-holes for passing horizontal rods held in place with cotter pins for retaining heads of spikes from coming out of railroad ties.

A fifth objective of the present invention is to provide apparatus, devices, assemblies, systems and methods of using tie plates with vertical studs having threaded ends for allowing flat plates to be attached, and through-holes in the studs for cotter pins, in order to retain spikes from coming out of railroad ties.

A first embodiment of a railroad spike retention system for retaining spikes to rail ties, can include a tie plate with spaced apart parallel first and second raised ridges for positioning a rail to a rail tie, a first plurality of holders fixed to the tie plate adjacent to an outer side of the first raised ridge on the tie plate, a first plurality of w shaped spring clips, each with free ends and a loop mid portion, the free ends and the loop mid portion facing in a same direction, wherein the free ends of each first w shaped spring clip are inserted into the first plurality of holders and the mid portion of each first spring clip is positioned over head portions of a first set of side spikes for retaining the first set of side spikes in place, a second plurality of holders fixed to the tie plate adjacent to an outer side of the second raised ridge on the tie plate, and a second plurality of W shaped spring clips, each with free ends and a loop mid portion, the free ends and the loop mid portion facing in a same direction, wherein the free ends of each second W shaped spring clip are inserted into the second plurality of holders and the mid portion of each second spring clip is positioned over head portions of a second set of side spikes for retaining the second set of side spikes in place.

The first plurality of holders can include first box shapes attached to a first base plate attached to the outer side of the first raised ridge of the tie plate, and the second plurality of holders include second box shapes attached to the outer side of the second raised ridge of the tie plate.

The plurality of first holders can be welded to the first base plate which are welded to the outer side of the first raised ridge of the tie plate, and the plurality of second holders can be welded to the second base plate which are welded the outer side of the second raised ridge of the tie plate.

The first plurality of holders can include four holders in a row, the first side spike can be a pair of first side spikes, the second plurality of holders can include four holders in a row, and the second side spike can be a pair of second side spikes.

The first w shaped spring clip can include a first pair of w shaped spring clips with the mid portions of each of first w shaped spring clips for holding down heads of the pair of spikes, and wherein the second w shaped spring clip can include a second pair of w shaped spring clips for holding down heads of the second pair of spikes.

The first w shaped spring clip and the second w shaped spring clip can be steel clips.

The railroad spike retention system can include first pins for locking the free ends of each first w shaped spring clip to the first plurality of holders, and second pins for locking the free ends of each second w shaped spring clip to the second plurality of holders The first pins and the second pins can include cotter pins.

A method of retaining spikes in railroad ties, can include the steps of mounting a first plurality of holders fixed to the tie plate adjacent to an outer side of a first raised ridge. mounting a second plurality of holders fixed to the tie plate adjacent to an outer side of a second raised ridge. positioning the tie plate with the mounted first and second plurality of holders on a rail tie below a rail so that the rail is between the first raised ridge and the second raised ridge on the tie plate, attaching flange ridges of the rail to a rail tie with first and second sets of spikes, providing a set of first w shaped spring clips, each with free ends and a loop mid portion, the free ends and the loop mid portion facing in a same direction, inserting the free ends of each of the first set of w shaped spring clips into the first plurality of holders, positioning the mid portion of each of the first spring clips over head portions of the first set of spikes for retaining the first set of spikes in place in place to the rail tie, providing a set of second w shaped spring clips, each with free ends and a loop mid portion, the free ends and the loop mid portion facing in a same direction, inserting the free ends of each of the second set of w shaped spring clips into the second plurality of holders, and positioning the mid portion of each of the second spring clips is over head portions of the second set pf spikes for retaining the second set of spikes in place to the rail tie.

The method can include the steps of locking the free ends of the first w shaped spring clips to the first plurality of holders with first cotter pins, and locking the free ends of the second w shaped spring clips to the second plurality of holders with second cotter pins A second embodiment of a railroad spike retention system for retaining spikes to rail ties, can include a tie plate with spaced apart parallel first and second raised ridges for positioning a rail to a rail tie, first spaced apart vertical brackets fixed to the tie plate adjacent to the first raised ridge, each of the first brackets having an upper through-hole passing from one side to an opposite side, each upper through-hole above heads of first rail spikes, a first elongated rod being inserted through each upper through-hole in the vertical brackets over the top of the spikes to retain the first spikes from coming out, second spaced apart vertical brackets fixed to the tie plate adjacent to the second raised ridge, each of the second brackets having an upper through-hole passing from one side to an opposite side, each upper through-hole above heads of second rail spike, and a second elongated rod being inserted through each upper through-hole in the vertical brackets over the top of the spikes to retain the second spikes from coming out The railroad spike retention system can include first cotter pins for passing through through-holes in ends of the first elongated rod for locking the first elongated rod to the first vertical brackets, and second cotter pins for passing through through-holes in ends of the second elongated rod for locking the second elongated rod to the second vertical brackets.

A third embodiment of a railroad spike retention system for retaining spikes to rail ties, can include a tie plate with spaced apart parallel first and second raised ridges for positioning a rail to a rail tie, first spaced apart studs with threaded ends fixed to the tie plate adjacent to the first raised ridge, each of the first studs having an upper through-hole passing from one side to an opposite side, each upper through-hole above heads of first spikes, a first flat plate attached to the threaded ends of the first studs over the top of the first spikes to retain the first spikes from coming out, second spaced apart studs with threaded ends fixed to the tie plate adjacent to the second raised ridge, each of the second studs having an upper through-hole passing from one side to an opposite side, each upper through-hole above heads of second spikes, and a second flat plate attached to the threaded ends of the second studs over the top of the second spikes to retain the second spikes from coming out;

The railroad spike retention system can include nuts with washers and/or without first cotter pins for passing through the through-holes in the first studs for locking the first flat plate to the first studs, and nuts with washers and/or second cotter pins for passing through the through-holes in the second studs for locking the second flat plate to the second studs.

Further objects and advantages of this invention will be apparent from the following detailed description of the presently preferred embodiments which are illustrated schematically in the accompanying drawings.

BRIEF DESCRIPTION OF THE FIGURES

The drawing figures depict one or more implementations in accord with the present concepts, by way of example only, not by way of limitations. In the figures, like reference numerals refer to the same or similar elements.

Seventh Embodiment

Figure 37A:
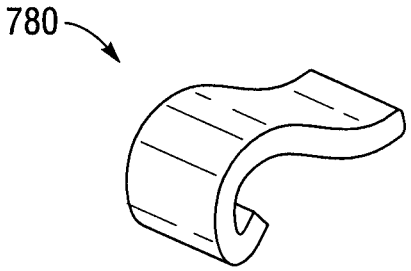

FIG. 37A is an upper perspective side view of a seventh embodiment of a concave back C clip.

Figure 37B:
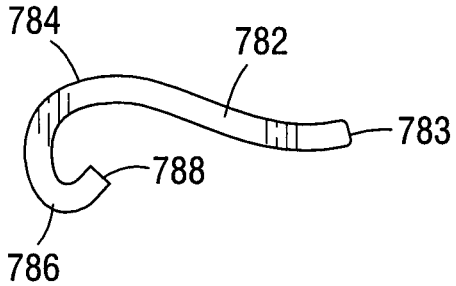

FIG. 37B is a side view of the concave back C clip of FIG. 37A.

Figure 37C:
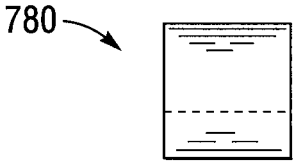

FIG. 37C is a front end left end view of the concave back C-clip of FIG. 37B.

Figure 37D:
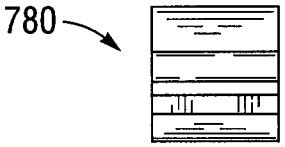

FIG. 37D is a rear end right end view of the concave back C-clip of FIG. 37B.

Figure 37E:
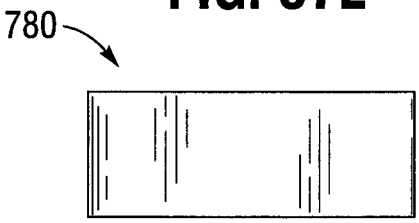

FIG. 37E is a top side view of the concave back C-clip of FIG. 37A.

Figure 37F:
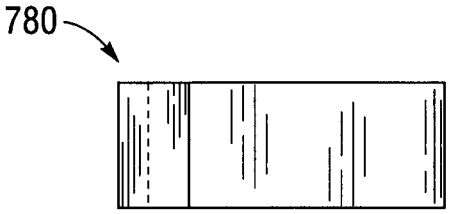

FIG. 37F is a bottom side view of the concave back C-clip of FIG. 37A.

Figure 37G:
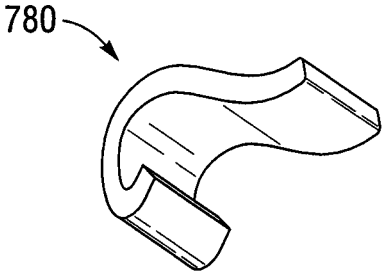

FIG. 37G is a lower perspective side view of the C-clip of FIG. 37A.

Figure 38A:
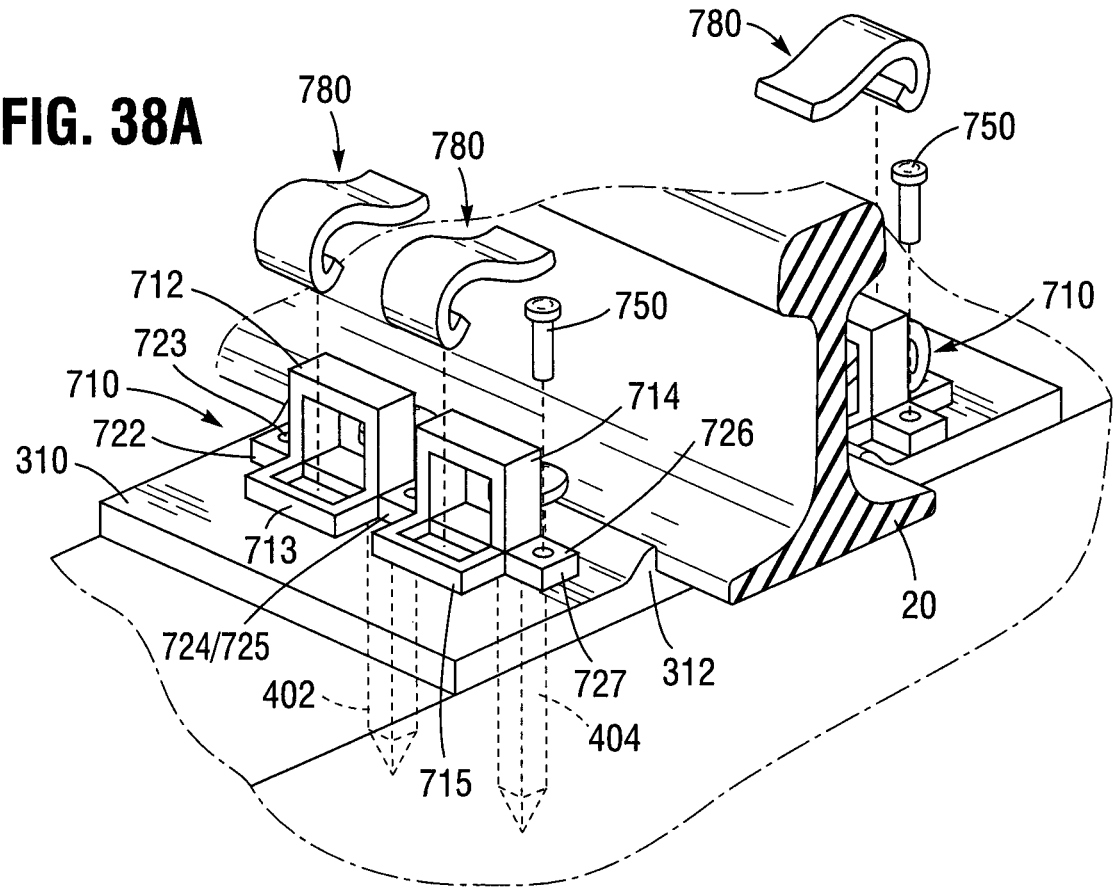

FIG. 38A is an exploded perspective view of using a left and right pairs of the C-clips of FIGS. 37A-37G with a left and right double box housing structures for holding spikes down through a rail tie plate about a railroad tie.

Figure 38B:
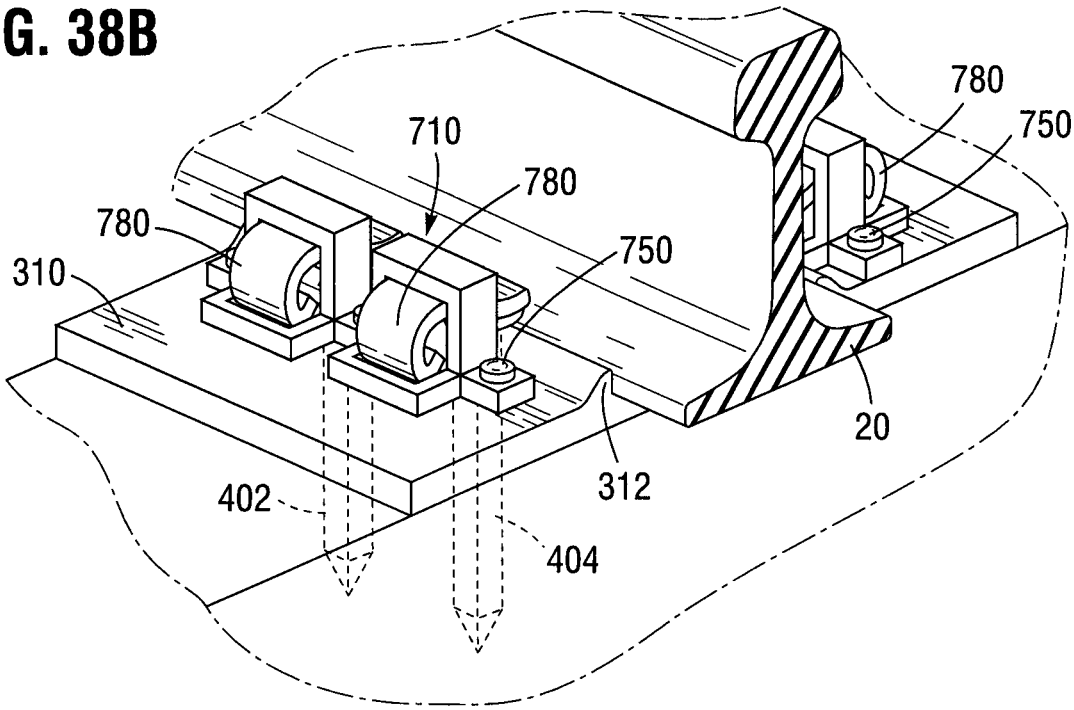

FIG. 38B is an assembled perspective view of FIG. 38A.

Figure 38C:
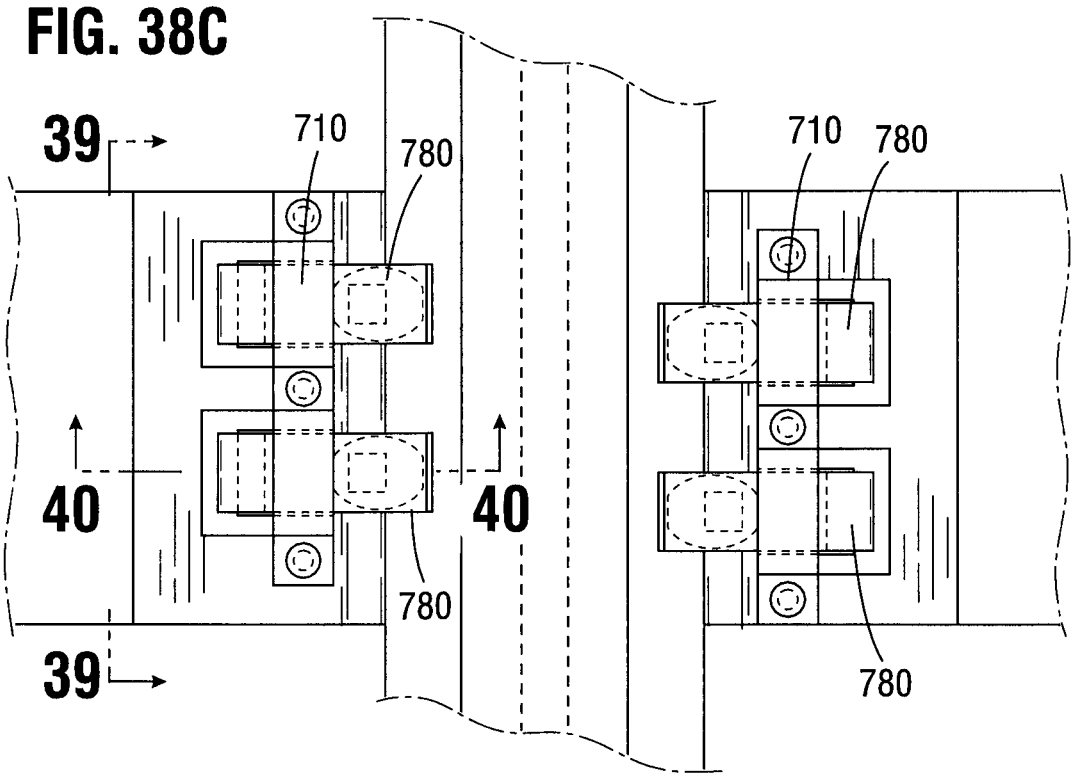

FIG. 38C is a top view of the assembled view of FIG. 38B.

Figure 39:
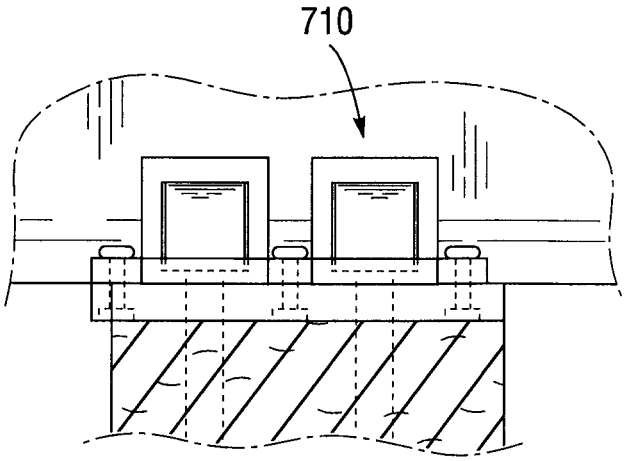

FIG. 39 is a front end view of FIG. 38C along arrows 39.

Figure 40:
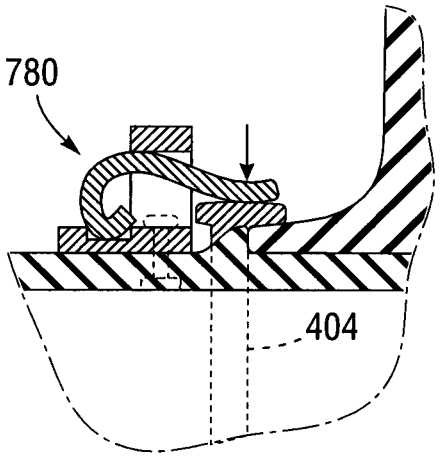

FIG. 40 is a cross-sectional view of FIG. 38C along arrows 40.

Figure 41A:
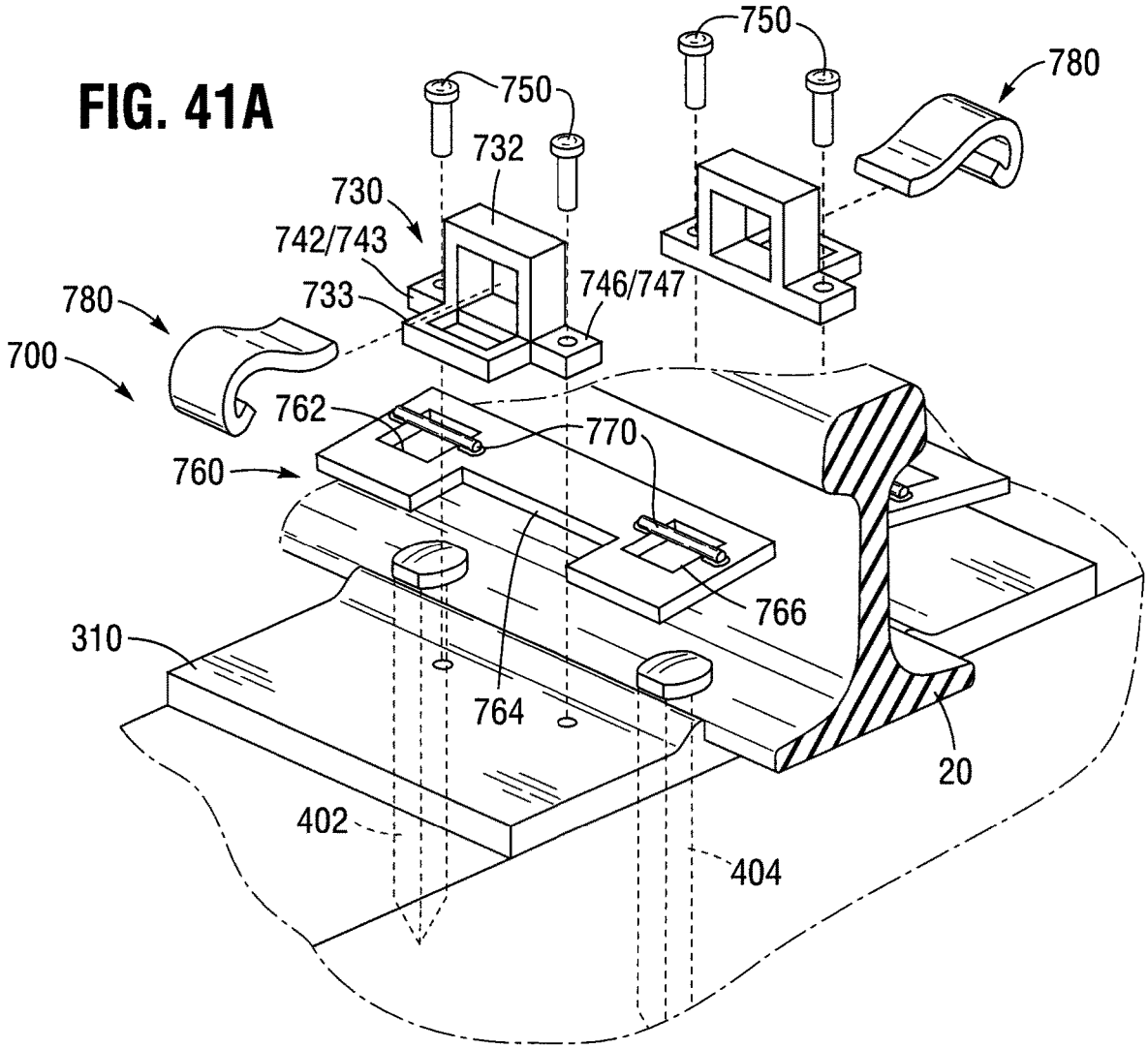

FIG. 41A is an exploded perspective view of using a left and right C-clips of FIGS. 37A-37G with a left and right box housing structures and raised auxiliary plates for holding spikes through a rail tie plate about a railroad tie.

Figure 41B:
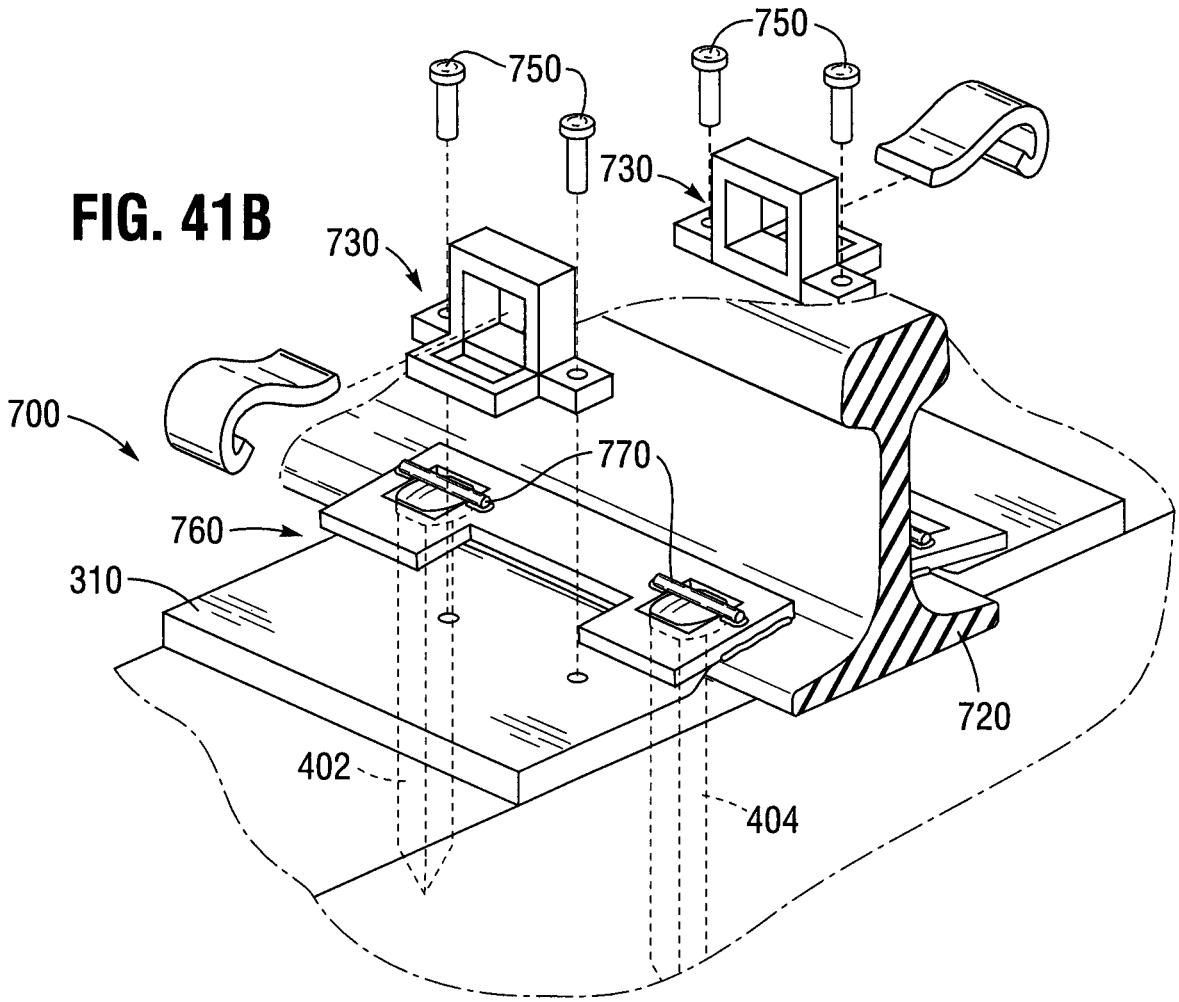

FIG. 41B is another exploded view of FIG. 41A with lowered auxiliary plates.

Figure 41C:
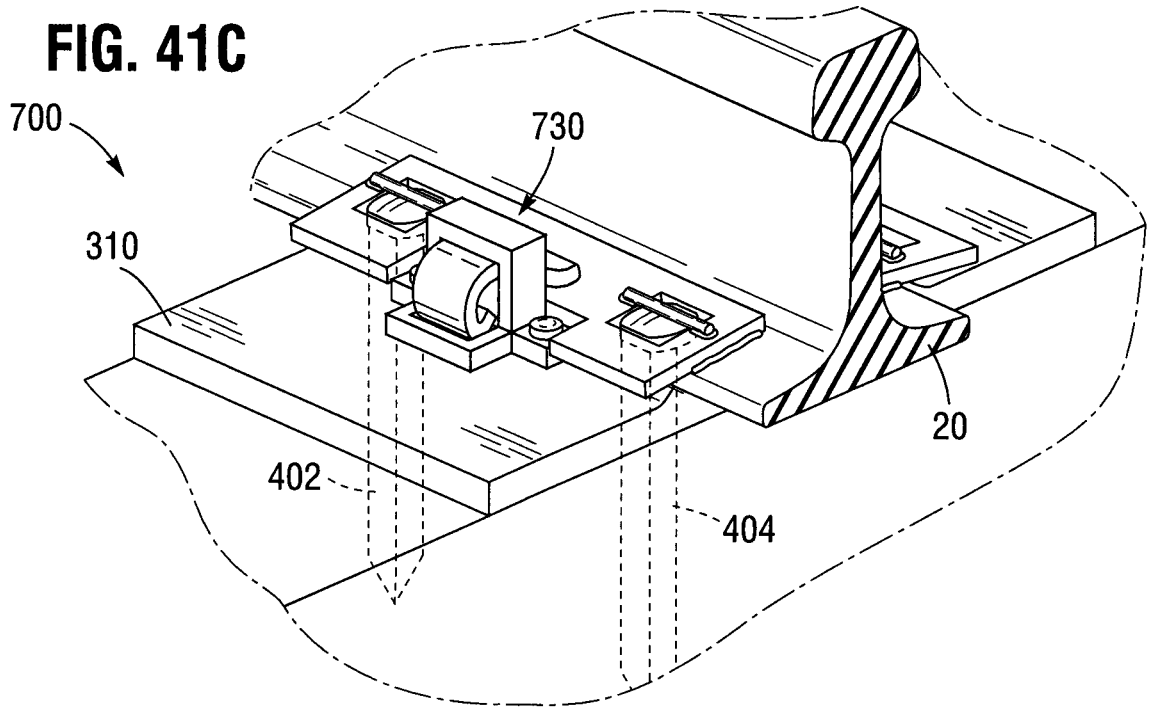

FIG. 41C is an assembled perspective view of FIGS. 41A and 41B.

Figure 42:
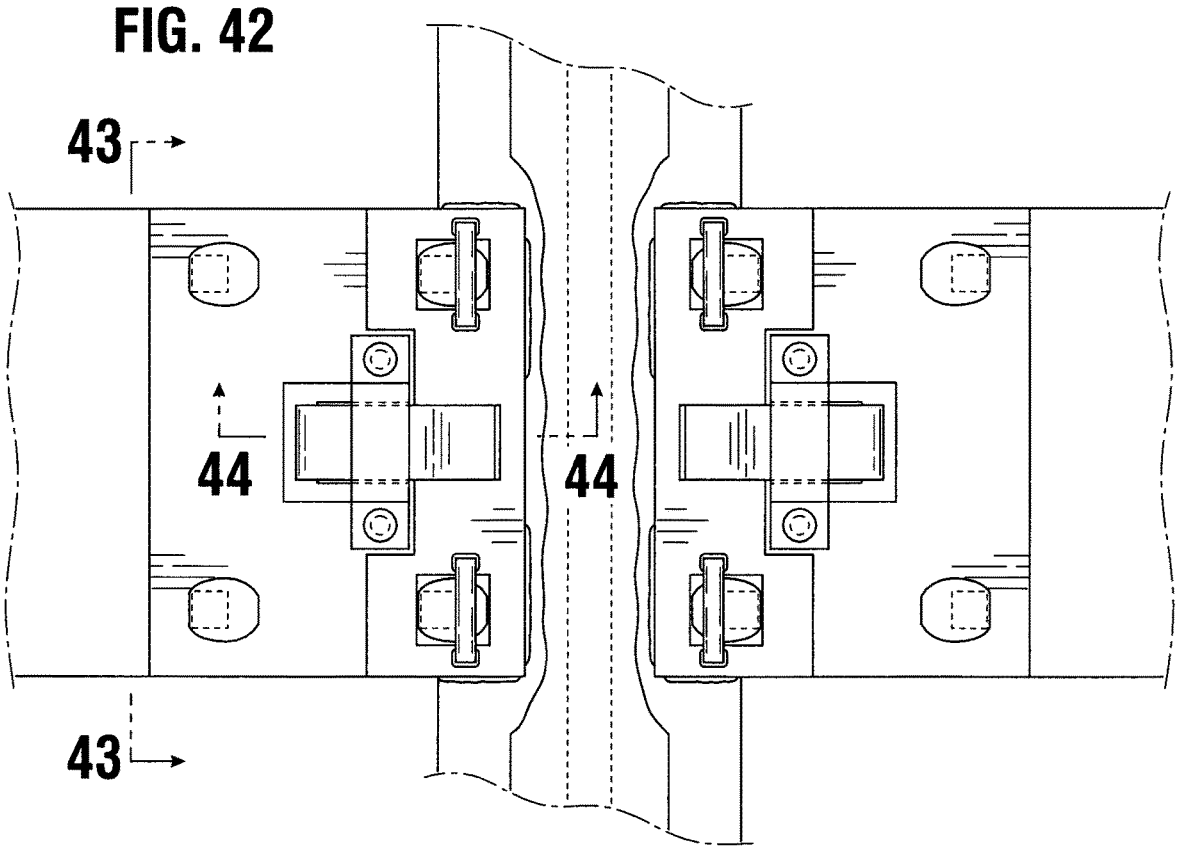

FIG. 42 is a top view of the assembled view of FIG. 41V.

Figure 43:
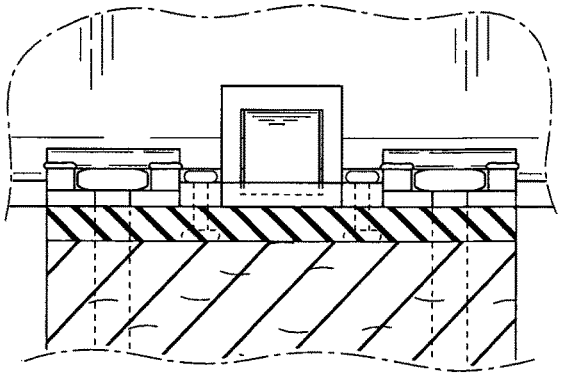

FIG. 43 is a front end view of FIG. 42 along arrows 43.

Figure 44:
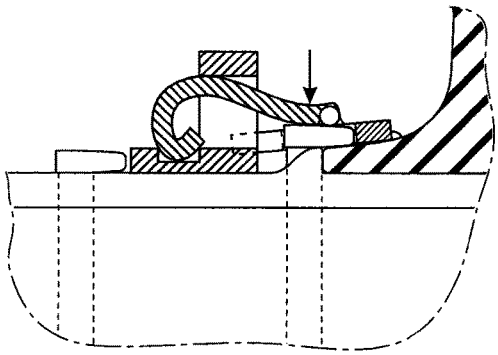

FIG. 44 is a cross-sectional view of FIG. 42 along arrows 44.

800 Eighth Embodiment-Convex back C clip

Figure 45A:
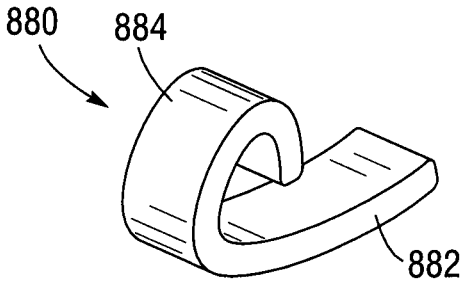

FIG. 45A is an upper perspective side view of a eighth embodiment of a convex back C clip.

Figure 45B:
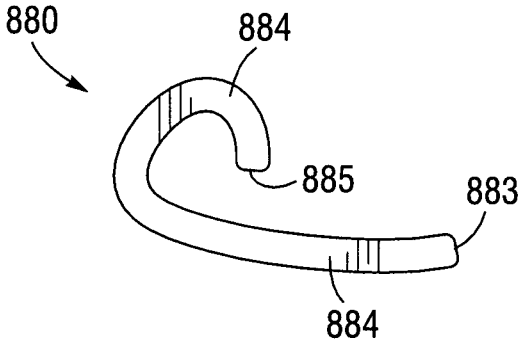

FIG. 45B is a side view of the convex back C clip of FIG. 45A.

Figure 45C:
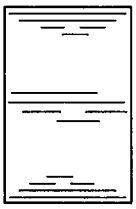

FIG. 45C is a front end left end view of the convex back C-clip of FIG. 45B.

Figure 45D:
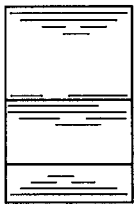

FIG. 45D is a rear end right end view of the convex back C-clip of FIG. 45B.

Figure 45E:
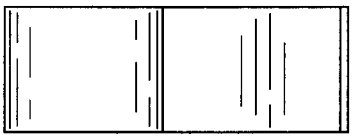

FIG. 45E is a top side view of the convex back C-clip of FIG. 45A.

Figure 45F:
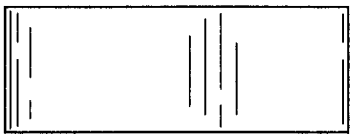

FIG. 45F is a bottom side view of the convex back C-clip of FIG. 45A.

Figure 45G:
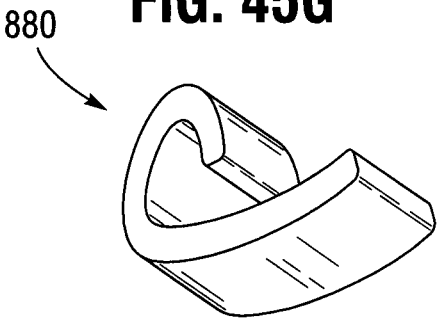

FIG. 45G is a lower perspective side view of the C-clip of FIG. 45A.

Figure 46A:
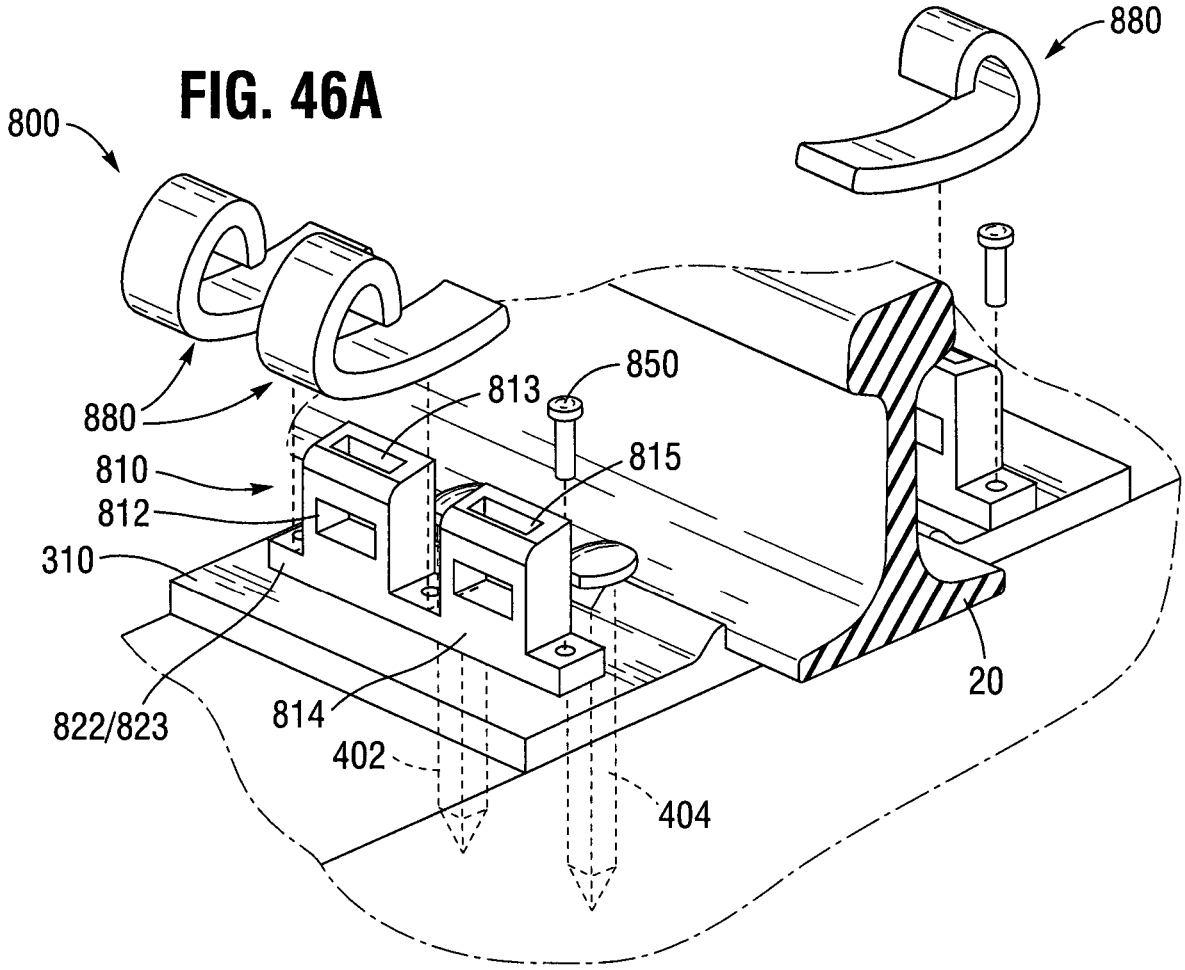

FIG. 46A is an exploded perspective view of using a left and right pairs of the C-clips of FIGS. 45A-45G with a left and right double box housing structures for holding spikes down through a rail tie plate about a railroad tie.

Figure 46B:
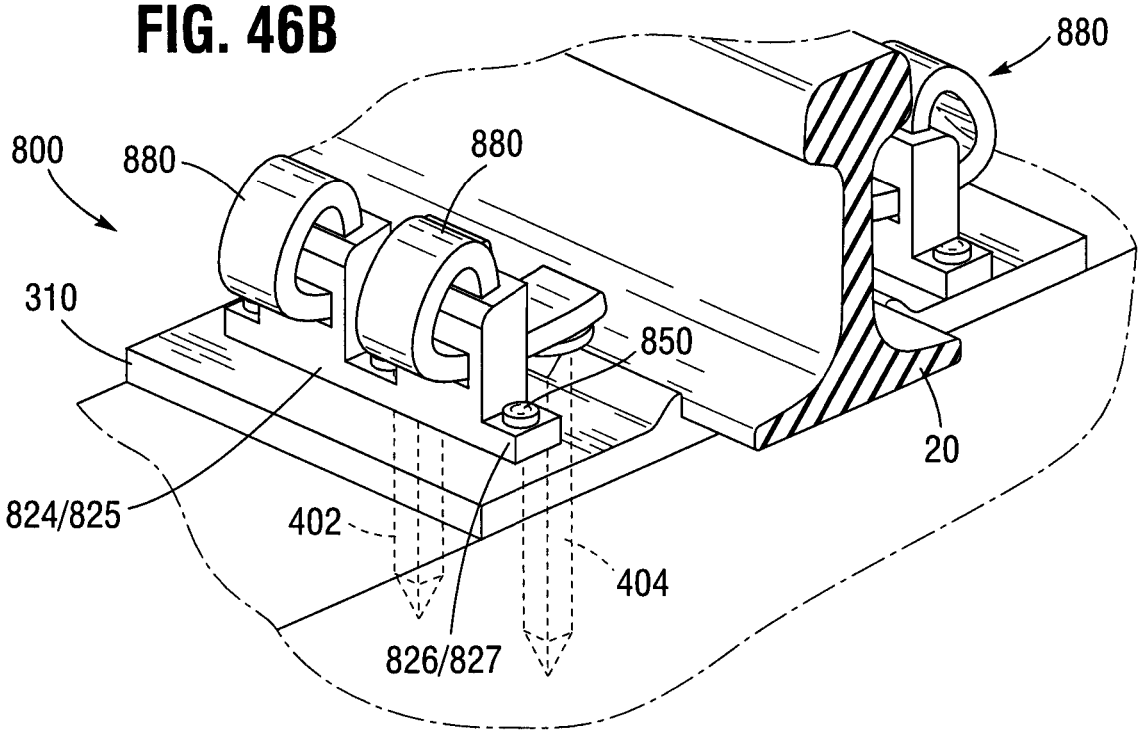

FIG. 46B is an assembled perspective view of FIG. 45A.

Figure 47:
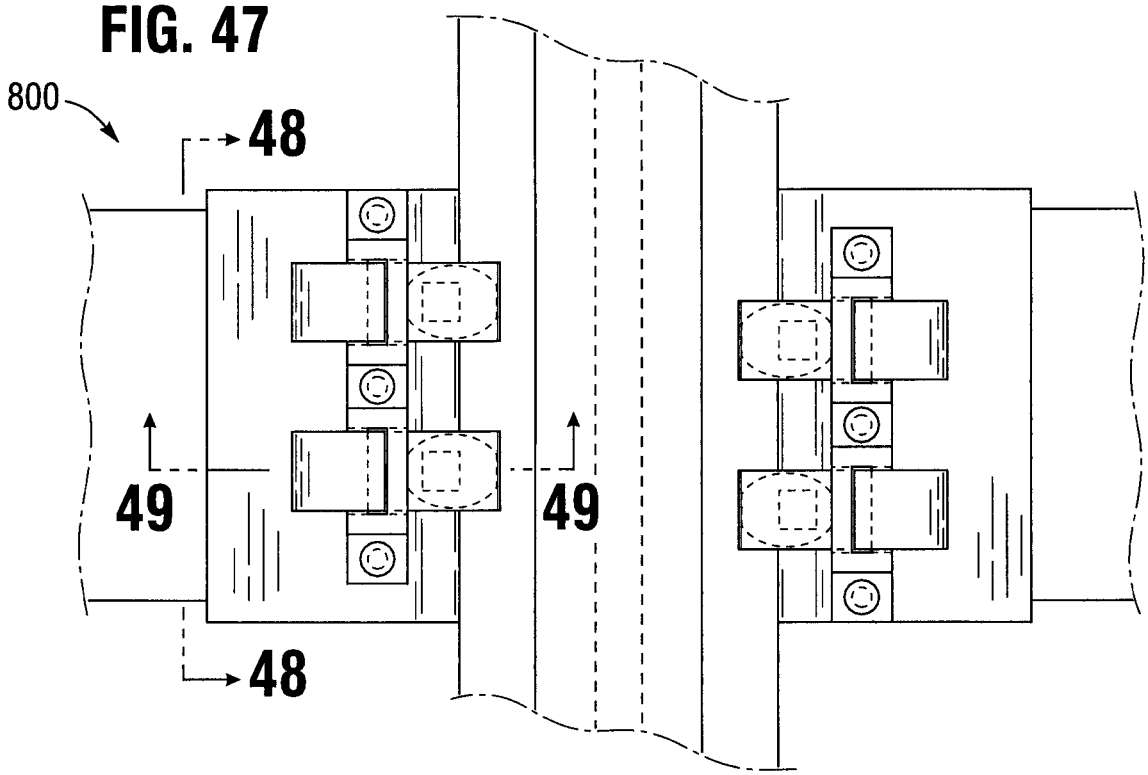

FIG. 47 is a top view of the assembled view of FIG. 46B.

Figure 48:
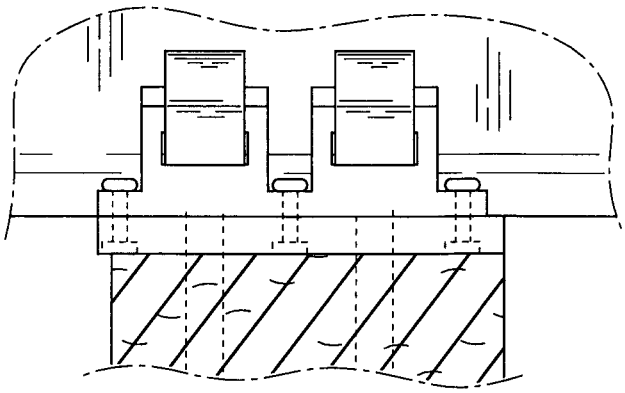

FIG. 48 is a front end view of FIG. 47 along arrows 48.

Figure 49:
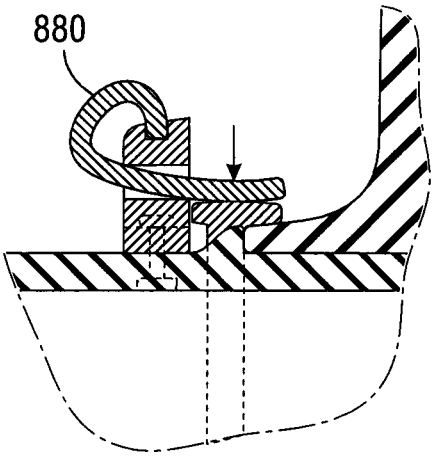

FIG. 49 is a cross-sectional view of FIG. 47 along arrows 49.

Figure 50A:
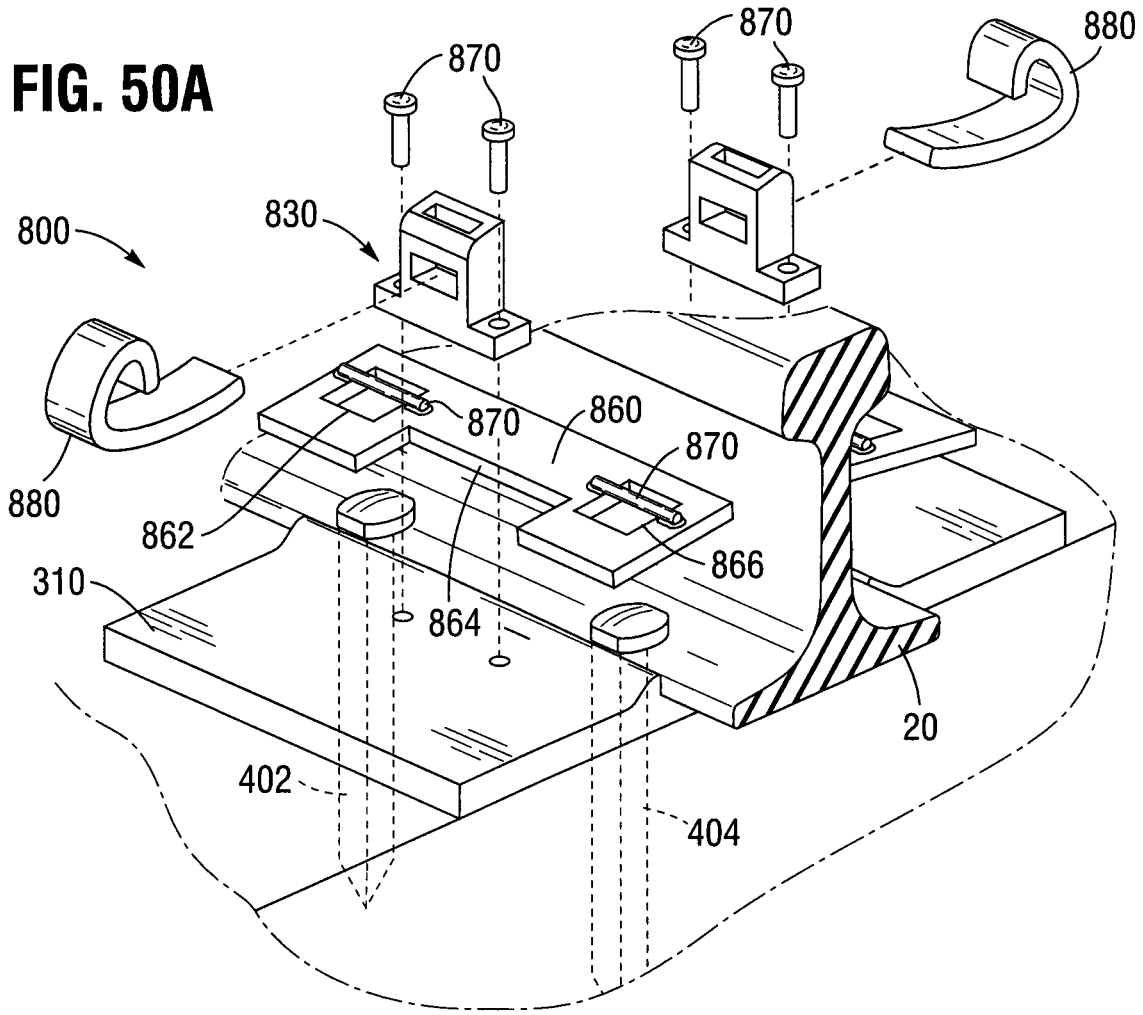

FIG. 50A is an exploded perspective view of using a left and right C-clips of FIGS. 45A-45G with a left and right box housing structures and raised auxiliary plates for holding spikes through a rail tie plate about a railroad tie.

Figure 50B:
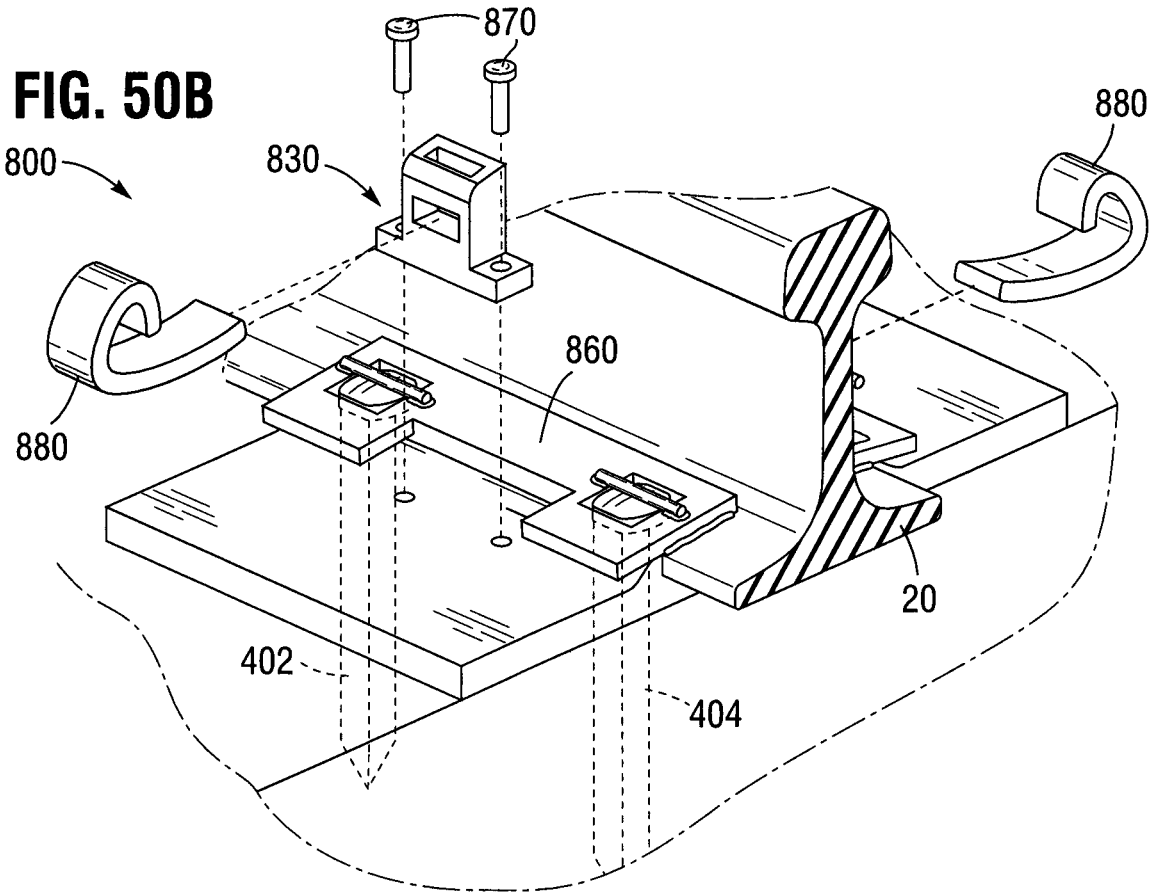

FIG. 50B is another exploded view of FIG. 50A with lowered auxiliary plates.

Figure 50C:
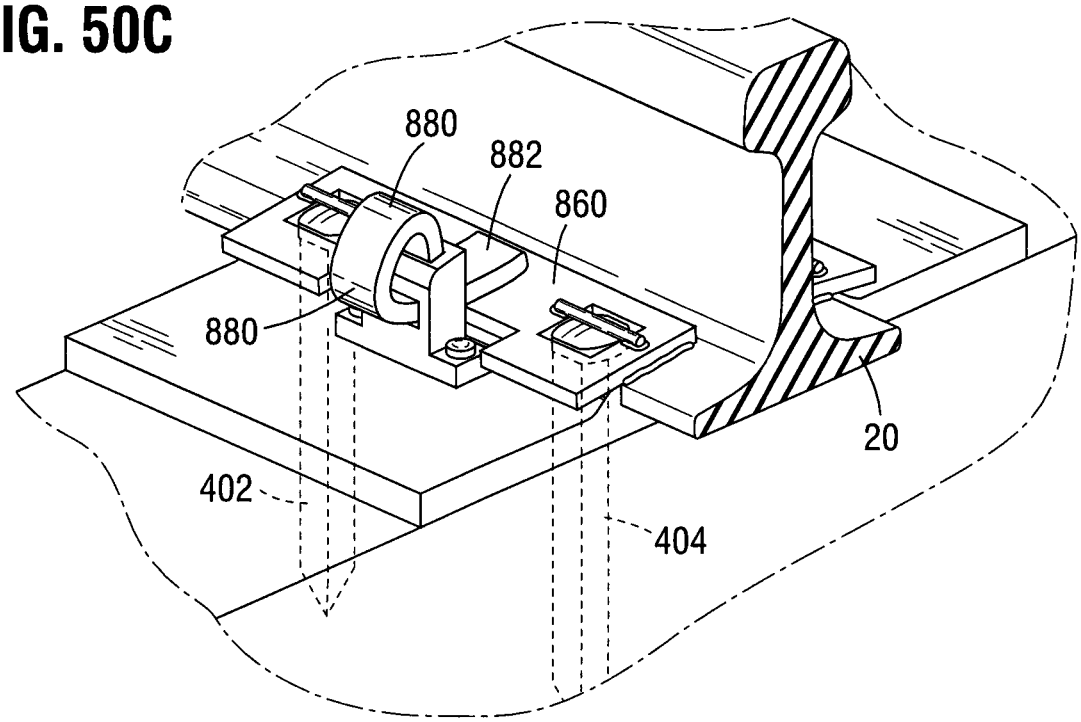

FIG. 50C is an assembled perspective view of FIGS. 50A-50B.

Figure 51:
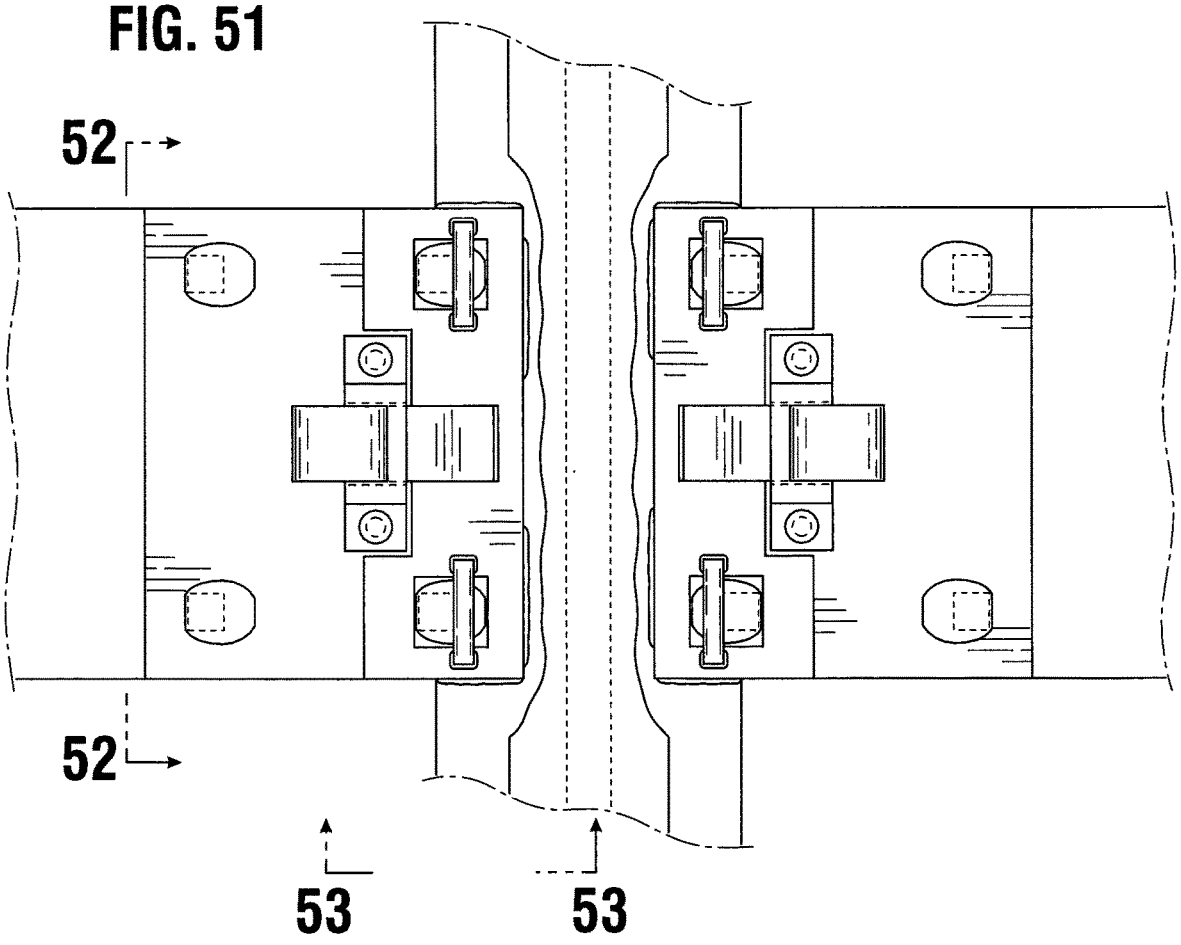

FIG. 51 is a top view of the assembled view of FIG. 50C.

Figure 52:
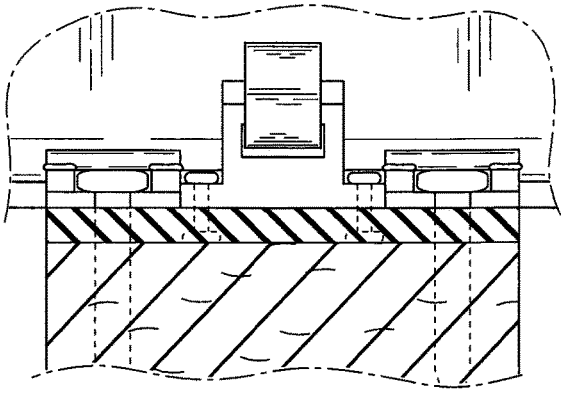

FIG. 52 is a front end view of FIG. 51 along arrows 52.

Figure 53:
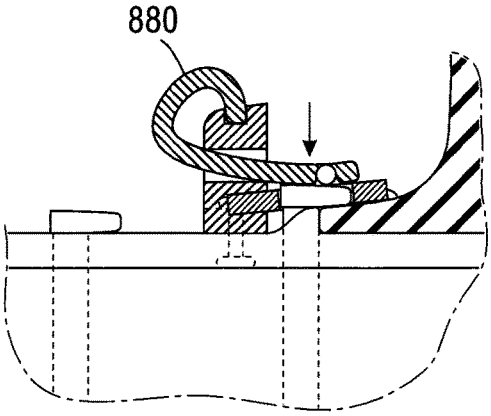

FIG. 53 is a cross-sectional view of FIG. 51 along arrows 53.

900 Ninth Embodiment-double hook flat C clip

Figure 54A:
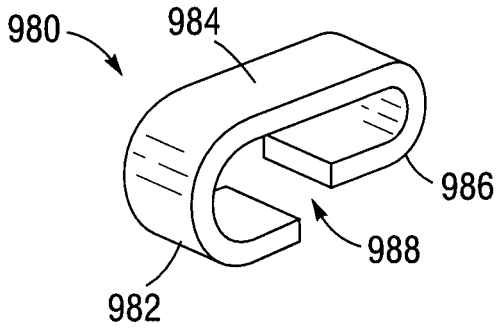

FIG. 54A is an upper side perspective view of a double hook flat C-clip.

Figure 54B:
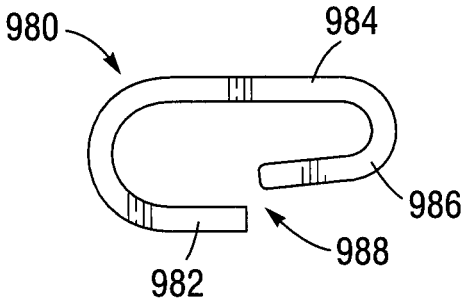

FIG. 54B is a side view of the double hook flat C-clip of FIG. 54A.

Figure 54C:
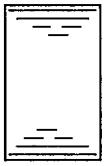

FIG. 54C is a front end view of the double hook flat C-clip of FIG. 54A.

Figure 54D:
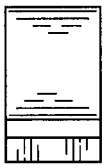

FIG. 54D is a rear end view of the double hook flat C-clip of FIG. 54A.

Figure 54E:
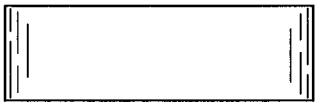

FIG. 54E is a top view of the double hook flat C-clip of FIG. 54A.

Figure 54F:
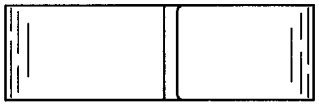

FIG. 54F is a bottom view of the double hook flat C-clip of FIG. 54A.

Figure 54G:
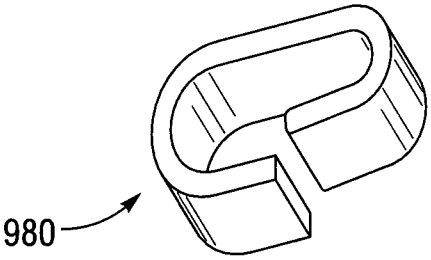

FIG. 54G is a lower side perspective view of the double hook flat C-clip of FIG. 54A.

Figure 55A:
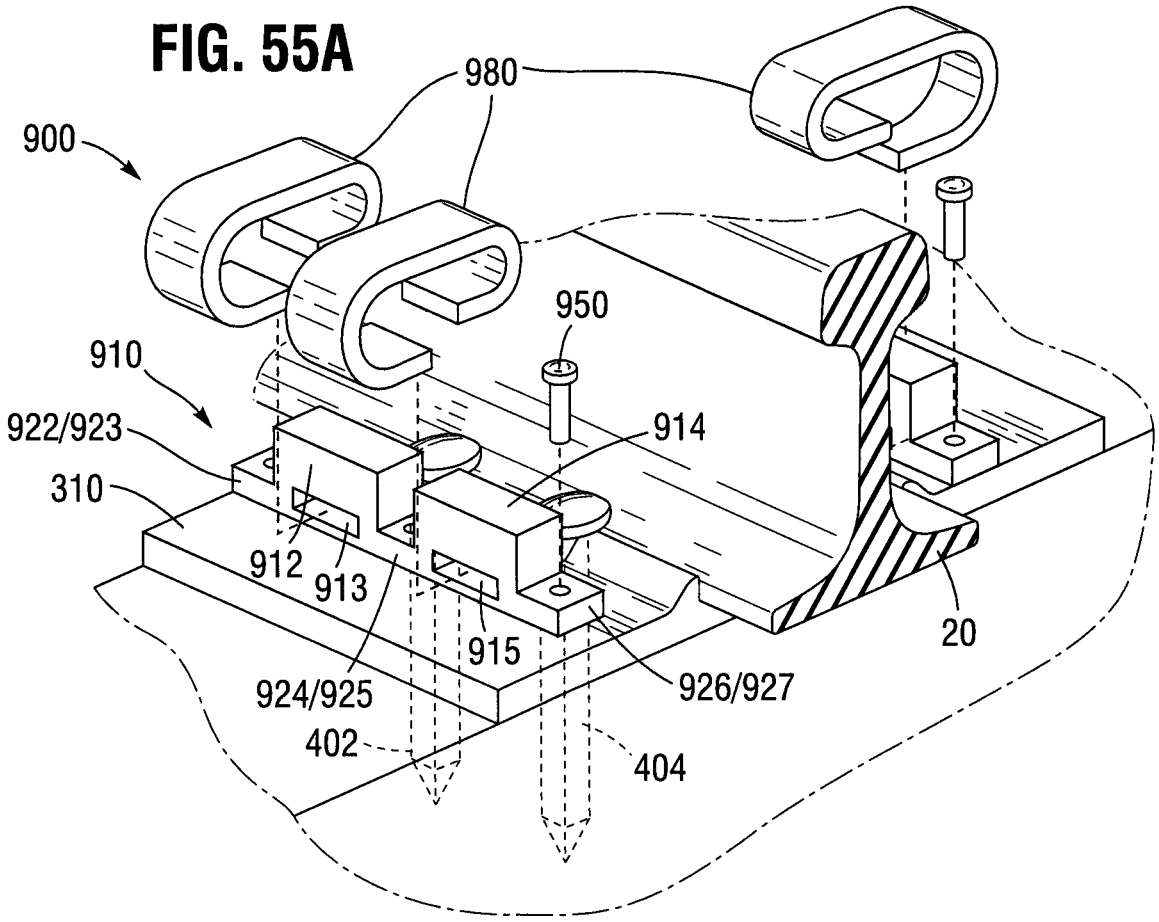

FIG. 55A is an exploded perspective view of using a left and right pair of the double hook flat C-clips of FIGS. 54A-54G with a left and right double box housing structures with side slots for holding spikes down through a rail tie plate about a rail.

Figure 55B:
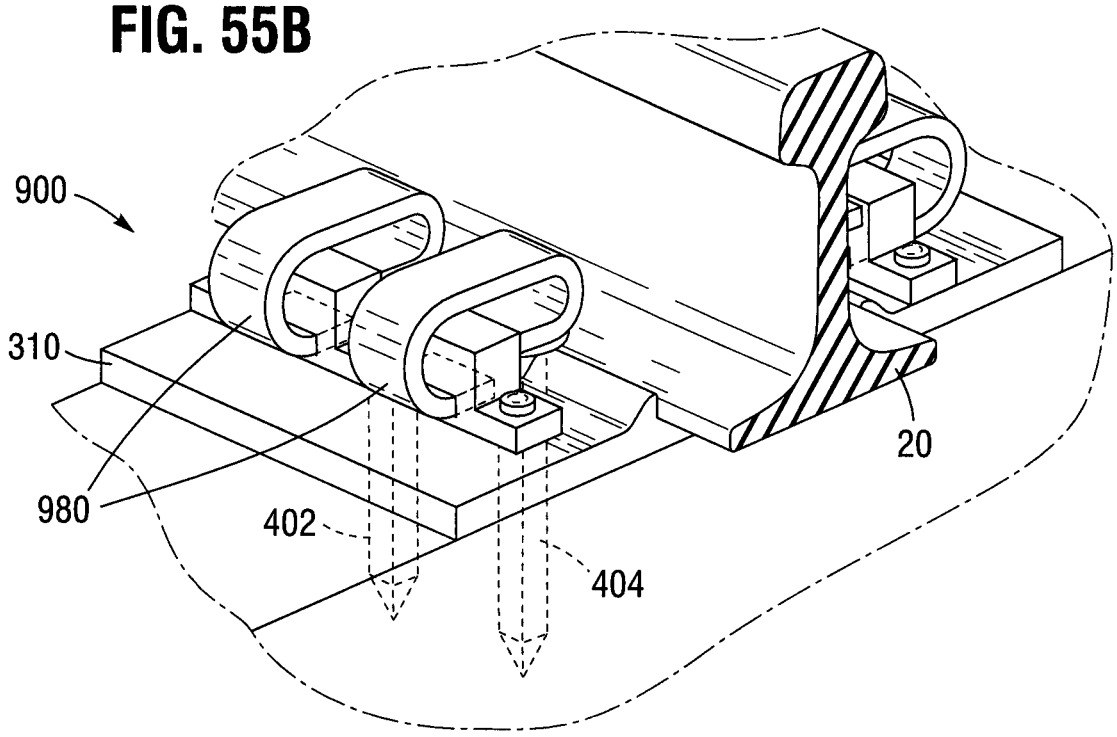

FIG. 55B is an assembled perspective view of FIG. 55A.

Figure 56:
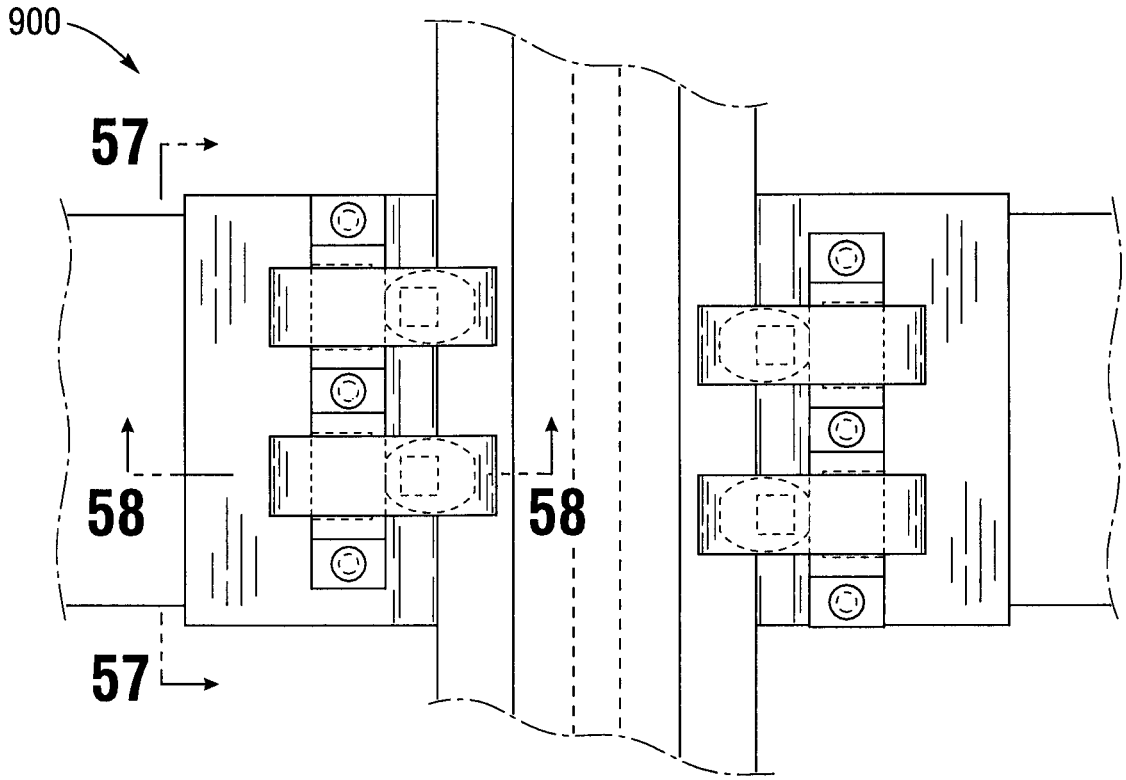
Figure 57:
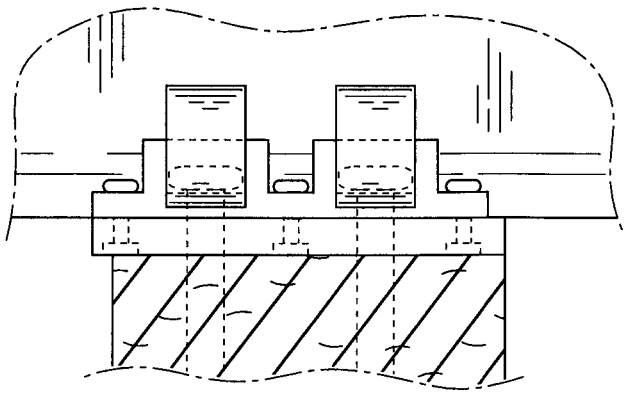

FIG. 56 is a top view of the assembled view of FIG. 57.

FIG. 57 is a front end view of FIG. 56 along arrows 48.

Figure 58:
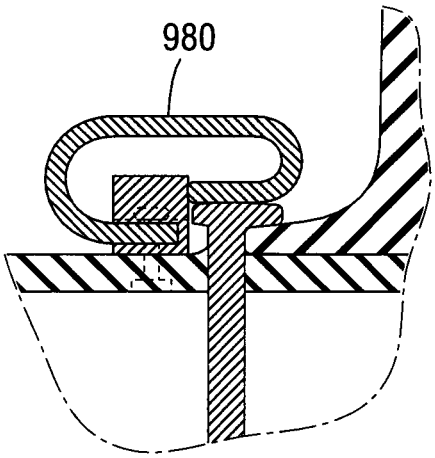

FIG. 58 is a cross-sectional view of FIG. 56 along arrows 58.

Figure 59A:
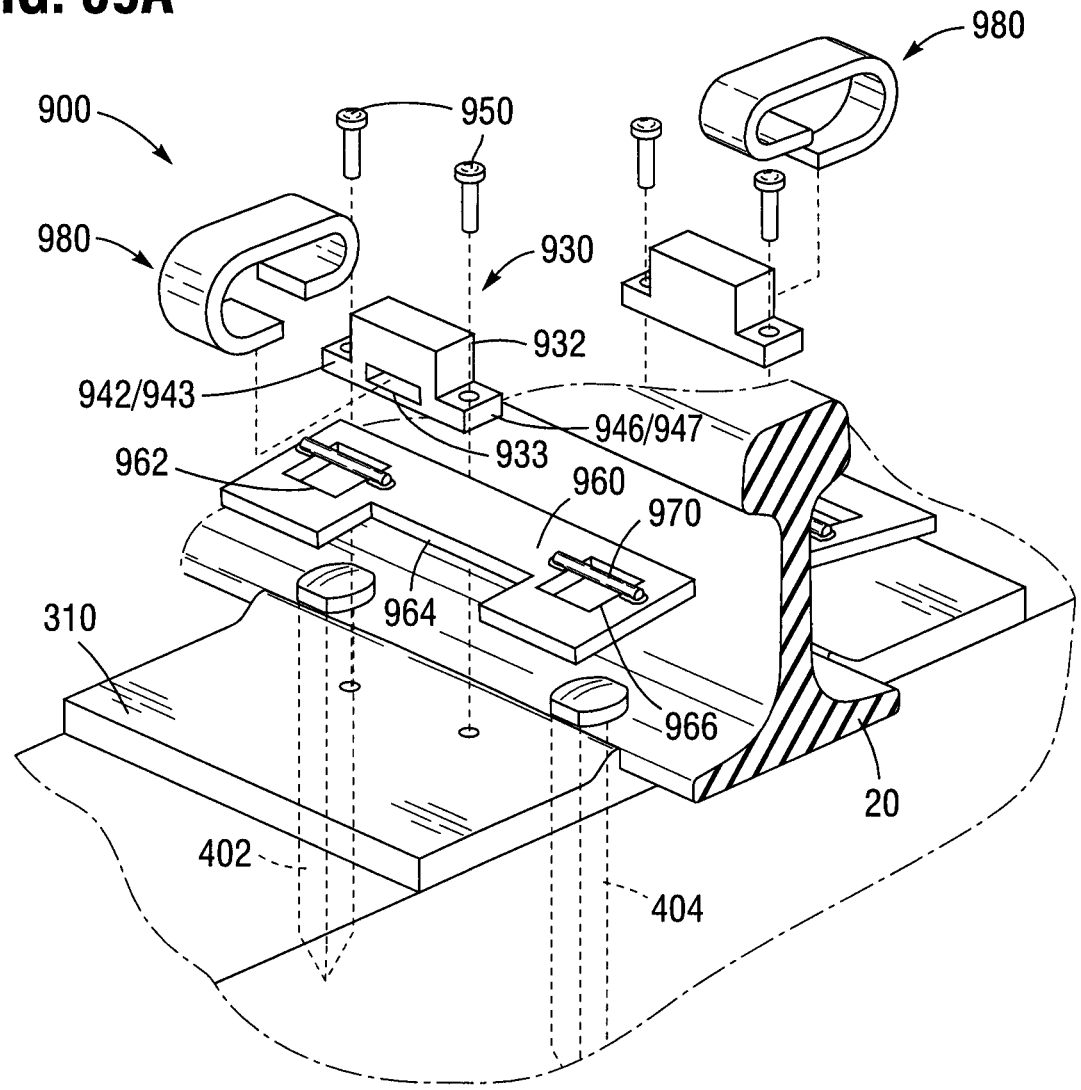

FIG. 59A is an exploded perspective view of using a left and right double hook flat C-clips of FIGS. 54A-54G with a left and right box housing structures with side slots and raised auxiliary plates for holding spikes through a rail tie plate about a railroad tie.

Figure 59B:
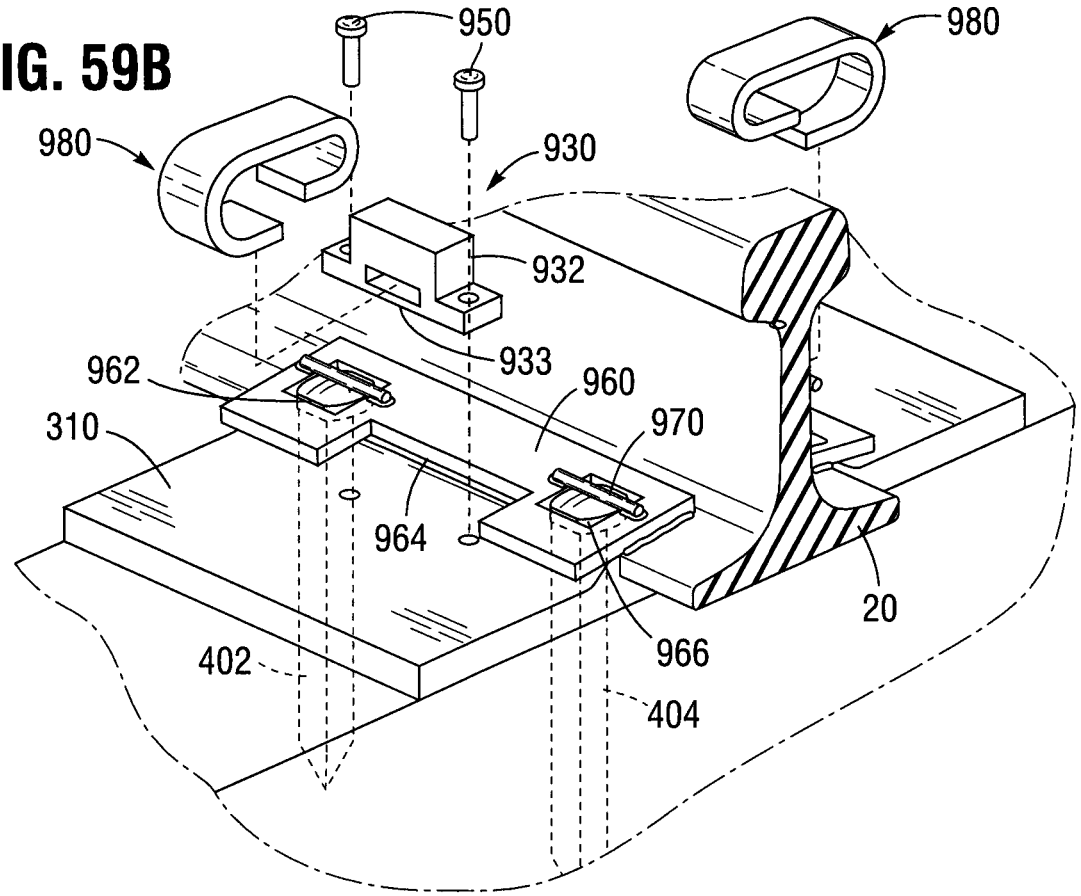

FIG. 59B is another exploded view of FIG. 59A with lowered auxiliary plates.

Figure 59C:
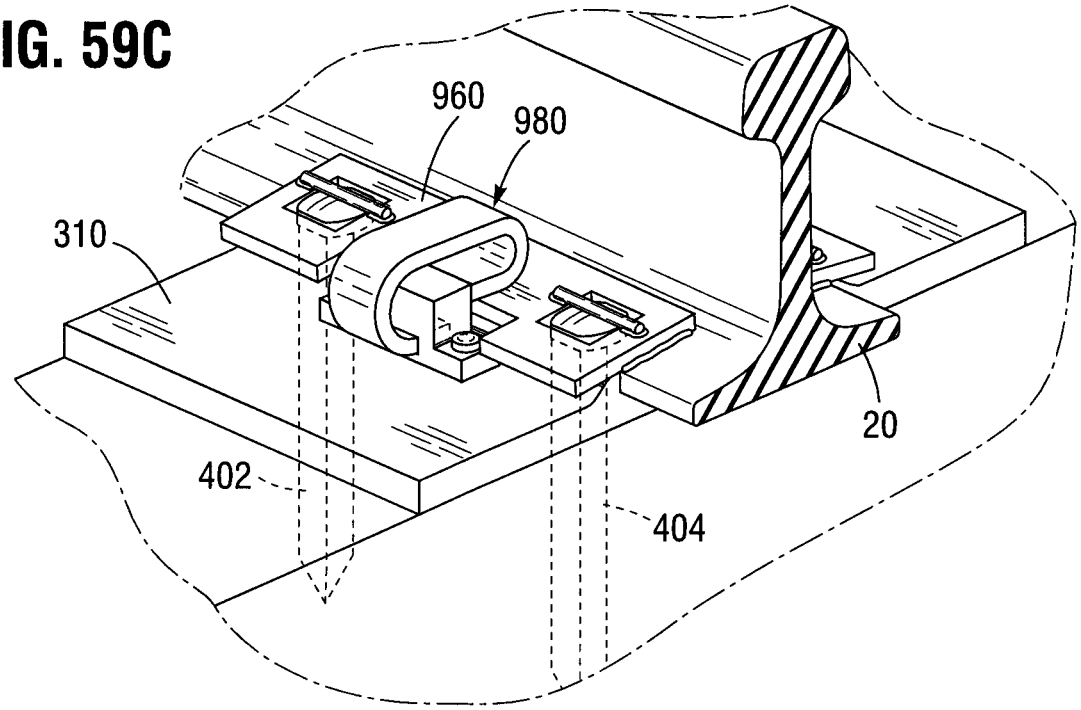

FIG. 59C is an assembled perspective view of FIGS. 59A-59B.

Figure 60:
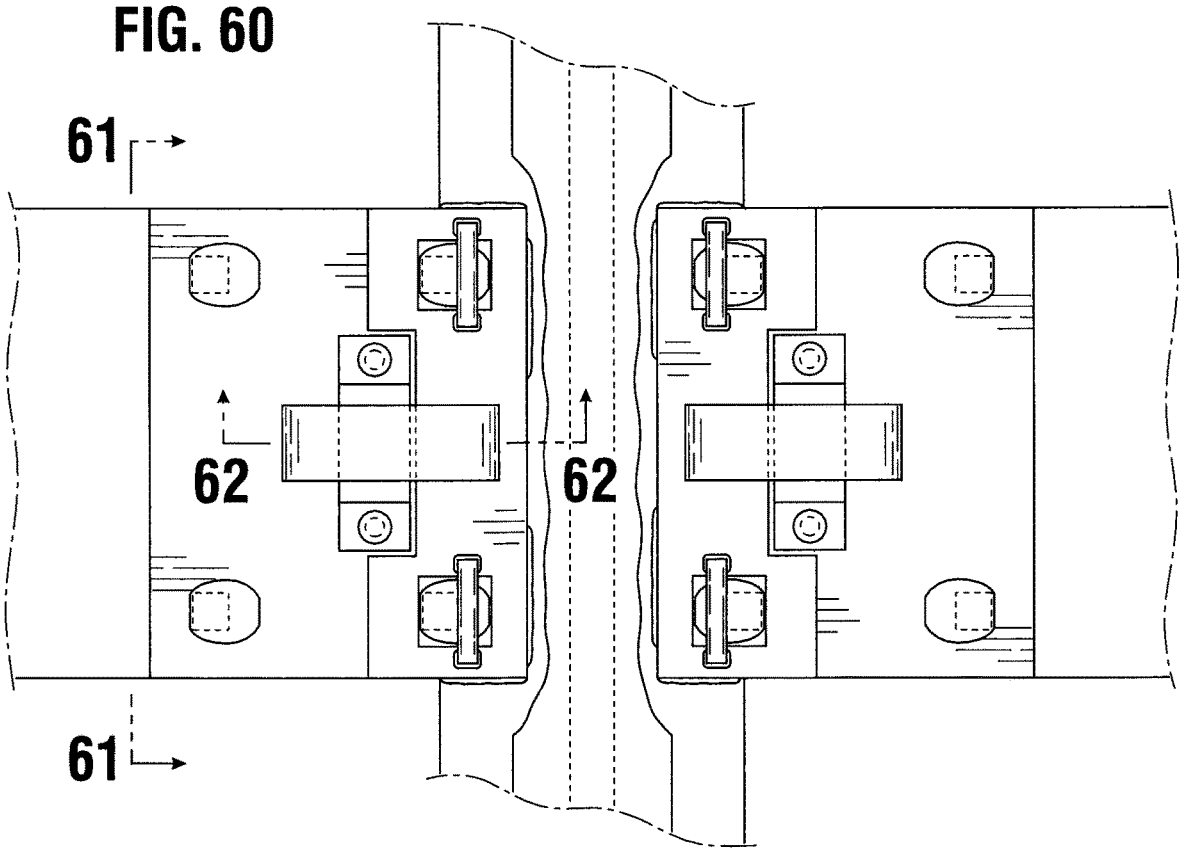

FIG. 60 is a top view of the assembled view of FIG. 59C.

Figure 61:
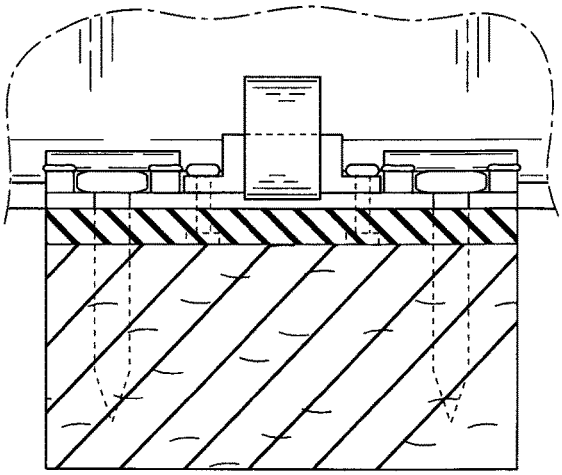

FIG. 61 is a front end view of FIG. 60 along arrows 61.

Figure 62:
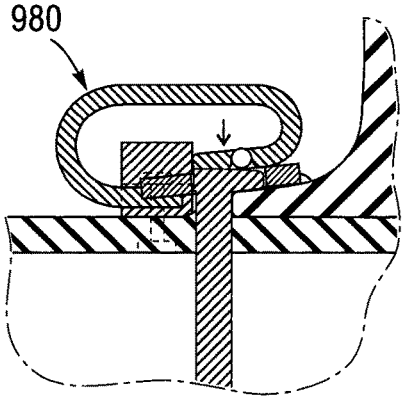

FIG. 62 is a cross-sectional view of FIG. 60 along arrows 62.

1000 Tenth Embodiment double hook two wire C clip

Figure 63A:
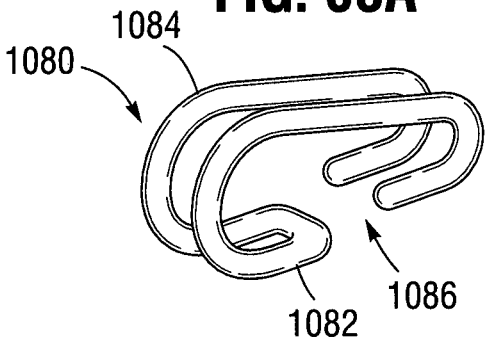
Figure 63B:
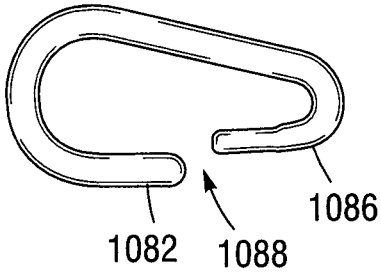

FIG. 63A is an upper front side perspective view of a double hook two wire C clip FIG. 63B is a side view of a double hook two wire C clip of FIG. 63A.

Figure 63C:
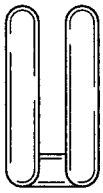

FIG. 63C is a front end view of a double hook two wire C clip of FIG. 63A.

Figure 63D:
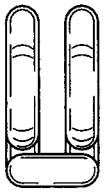

FIG. 63D is a rear end view of a double hook two wire C clip of FIG. 63A.

Figure 63E:
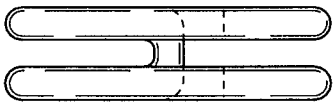

FIG. 63E is a top view of a double hook two wire C clip of FIG. 63A.

Figure 63F:
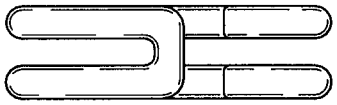

FIG. 63F is a bottom view of a double hook two wire C clip of FIG. 63A.

Figure 63G:
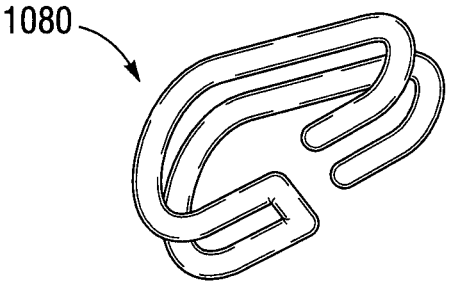

FIG. 63G is a lower rear side perspective view of a double hook two wire C clip of FIG. 63A.

Figure 64A:
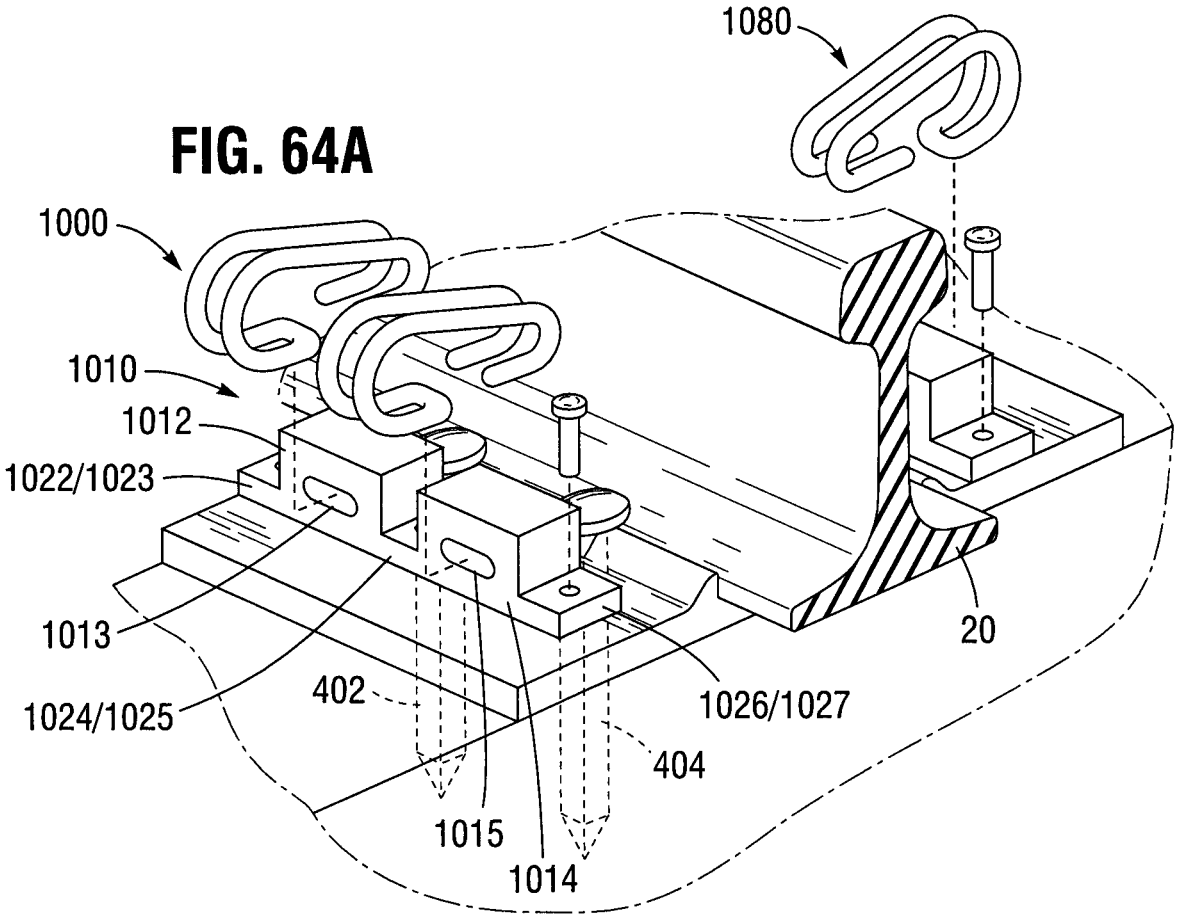

FIG. 64A is an exploded perspective view of using left and right pairs of the double hook two wire C clips of FIGS.

63A-63G with a left and right double box housing structures with side slots for holding spikes down through a rail tie plate about a rail.

Figure 64B:
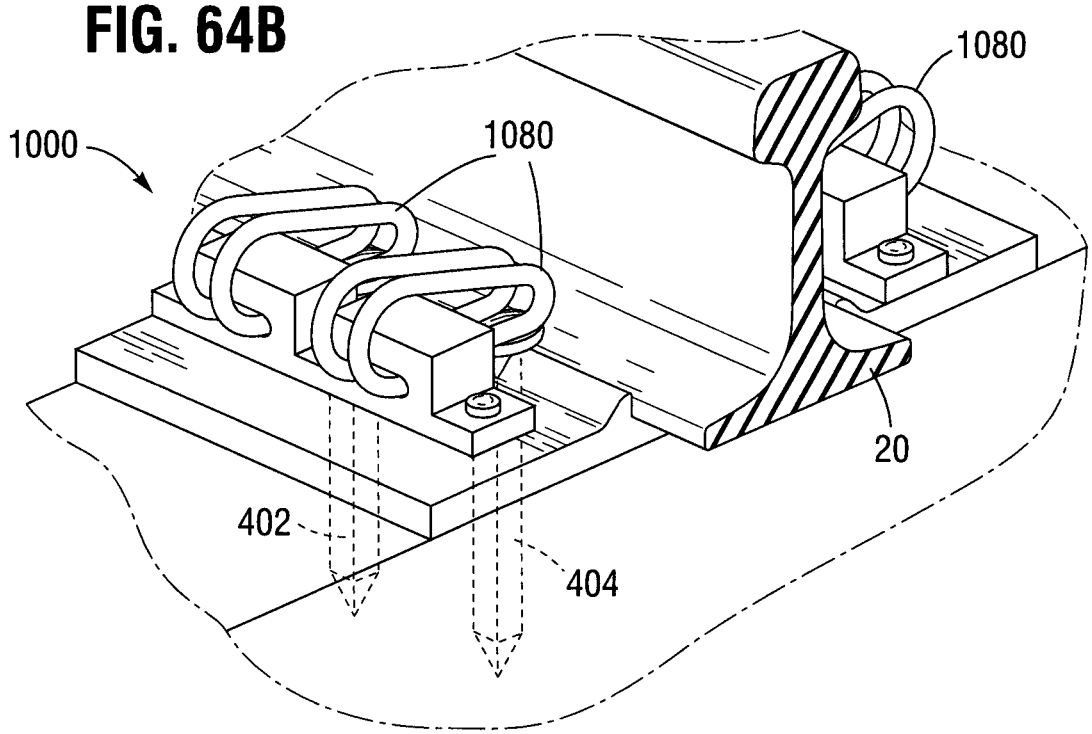

FIG. 64B is an assembled perspective view of FIG. 64A.

Figure 65A:
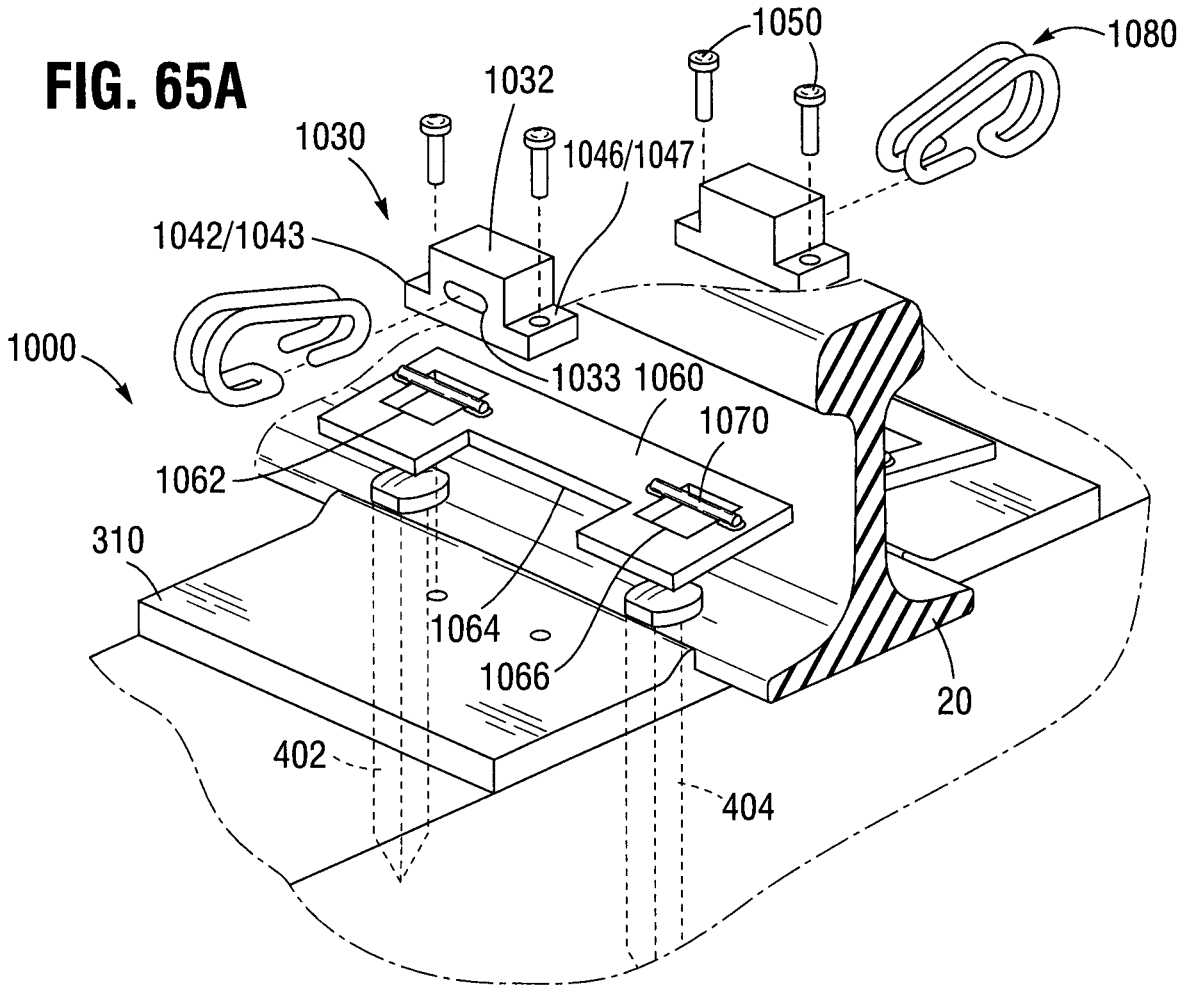

FIG. 65A is an exploded perspective view of using a left and right double hook two wire C clips of FIGS. 63A-63G with a left and right single box housing structures with side slots and raised auxiliary plates for holding spikes through a rail tie plate about a railroad tie.

Figure 65B:
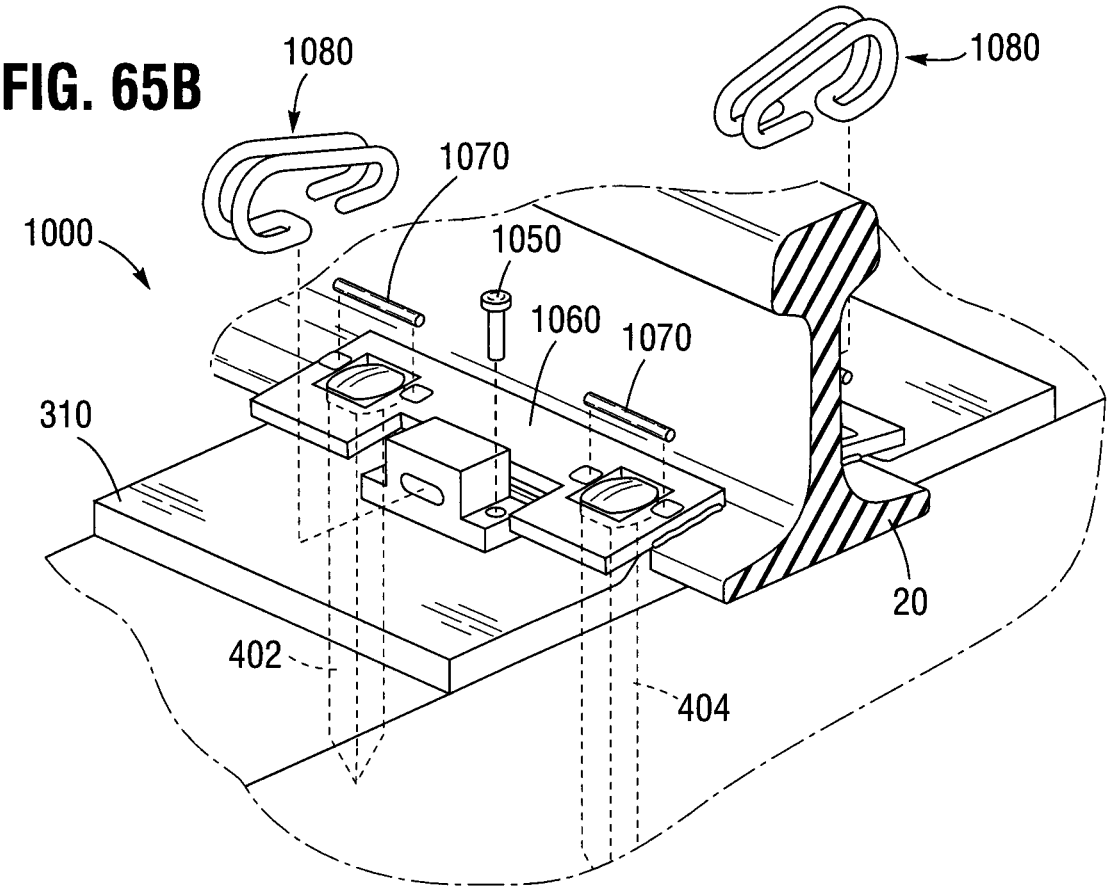

FIG. 65B is another exploded view of FIG. 65A with lowered auxiliary plates.

Figure 65C:
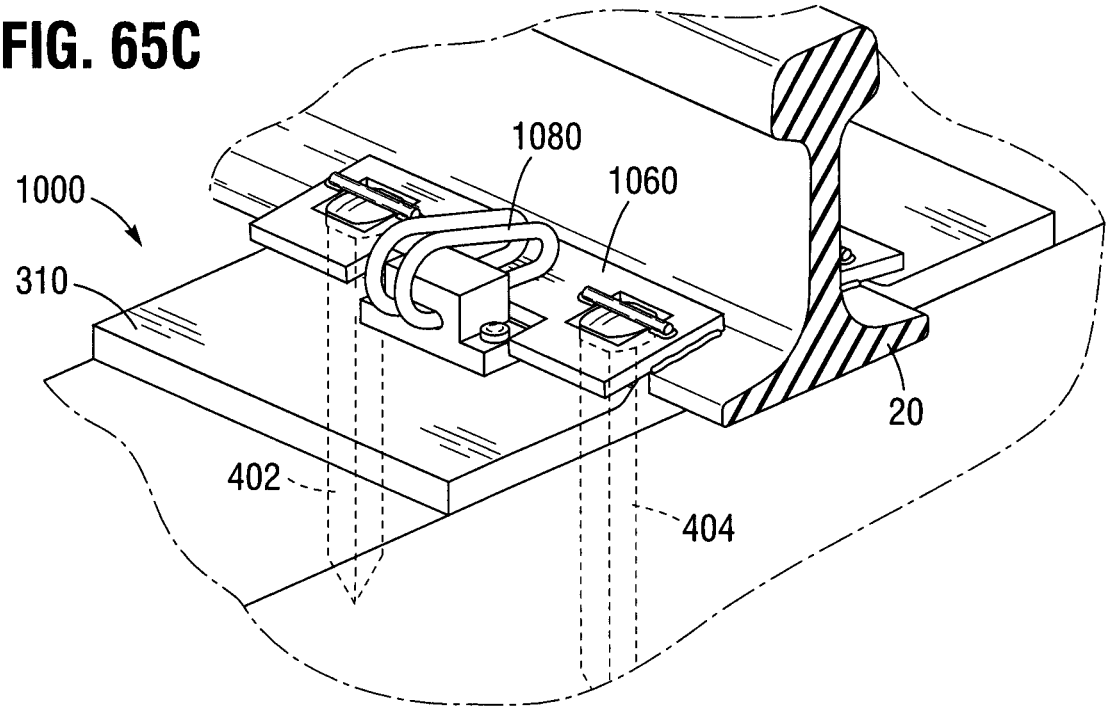

FIG. 65C is an assembled perspective view of FIGS. 65A-65B.

Figure 66:
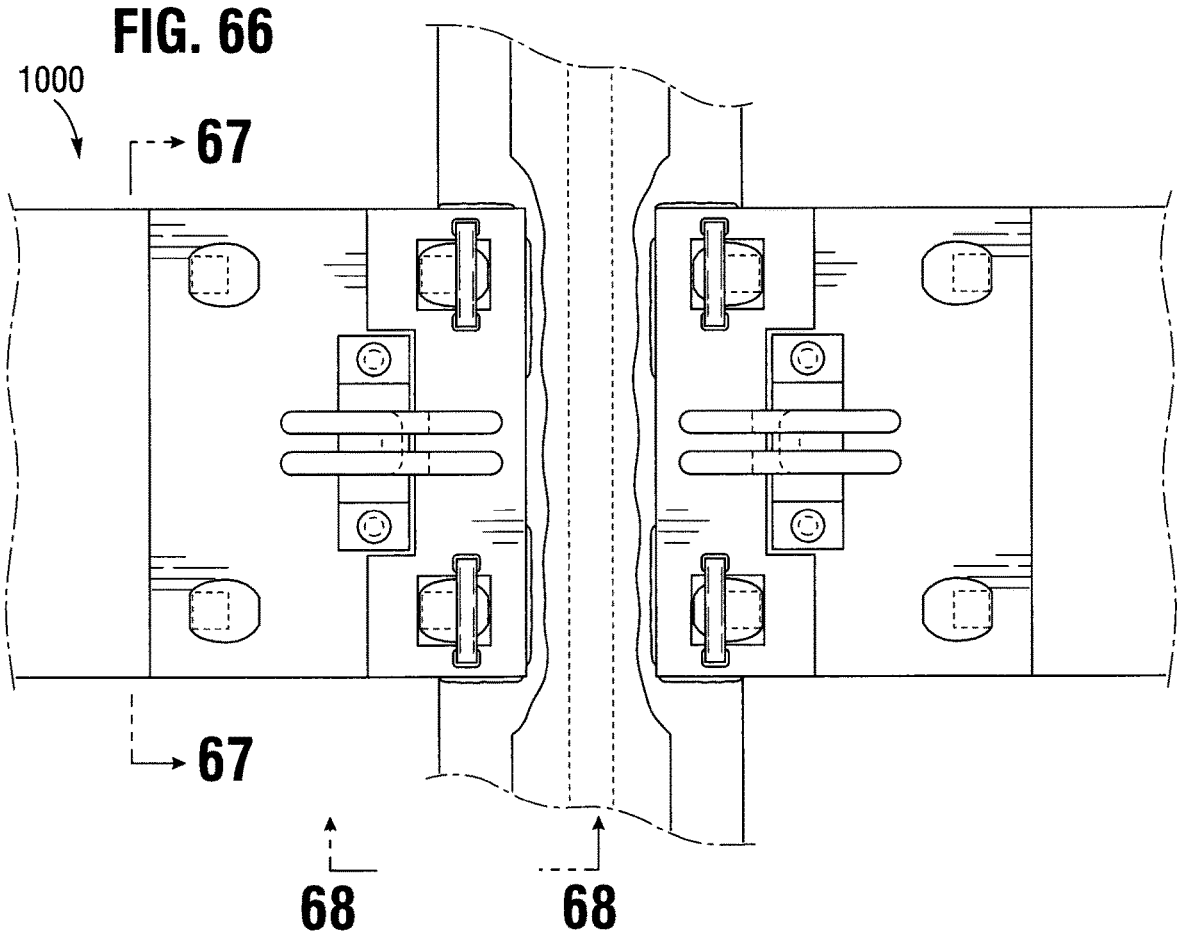

FIG. 66 is a top view of the assembled view of FIG. 65C.

Figure 67:
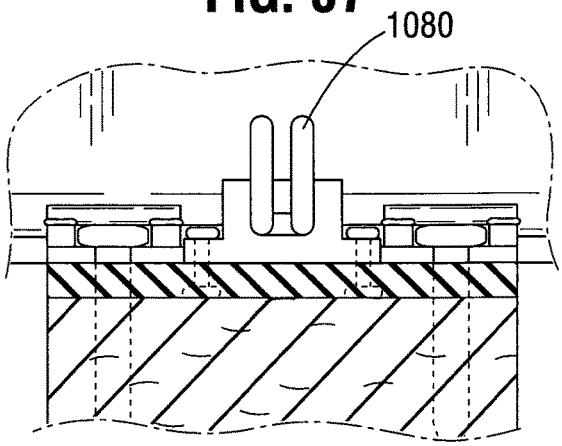

FIG. 67 is a front end view of FIG. 66 along arrows 67.

Figure 68:
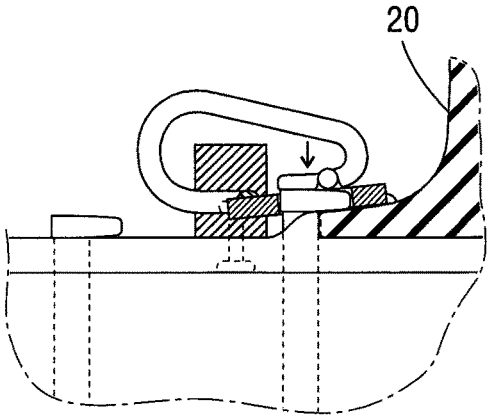

FIG. 68 is a cross-sectional view of FIG. 60 along arrows 68.

1100 Eleventh Embodiment G clip

Figure 69A:
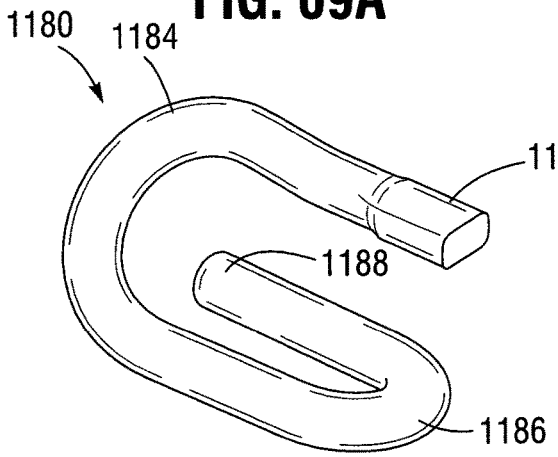
Figure 69B:
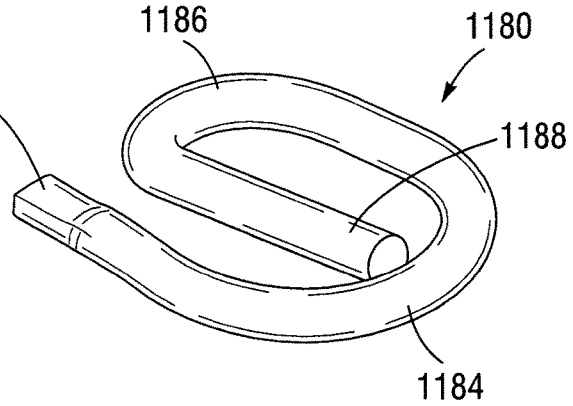

FIG. 69A is an upper perspective view of the G-clip FIG. 69B is a lower perspective view of the G-clip of FIG. 69A.

Figure 69C:
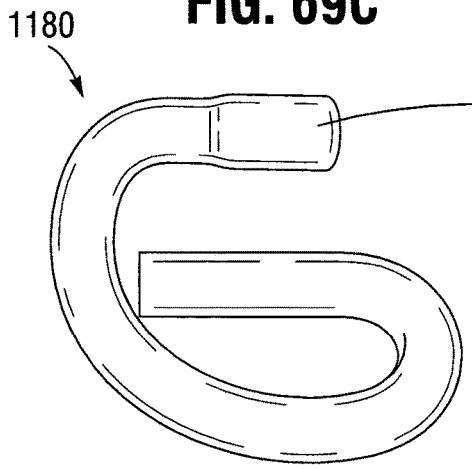

FIG. 69C is a top view of the G-clip of FIG. 69A.

Figure 69D:
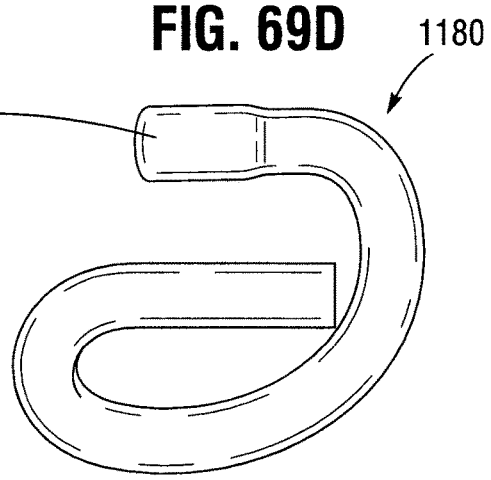

FIG. 69D is a bottom view of the G-clip of FIG. 69A.

Figure 69E:
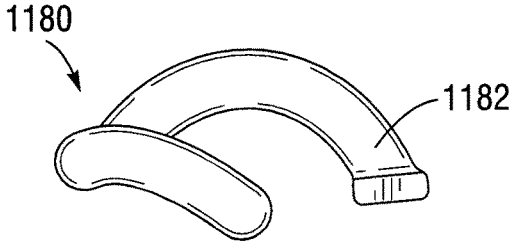

FIG. 69E is a right perspective view of the G-clip of FIG. 69A.

Figure 69F:
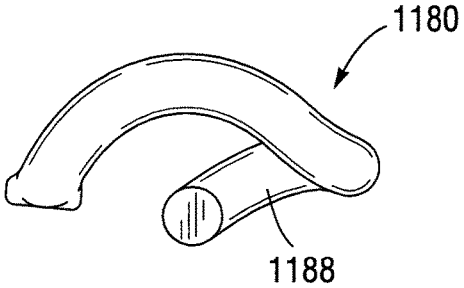

FIG. 69F is a left perspective view of the G-clip of FIG. 69A.

Figure 70A:
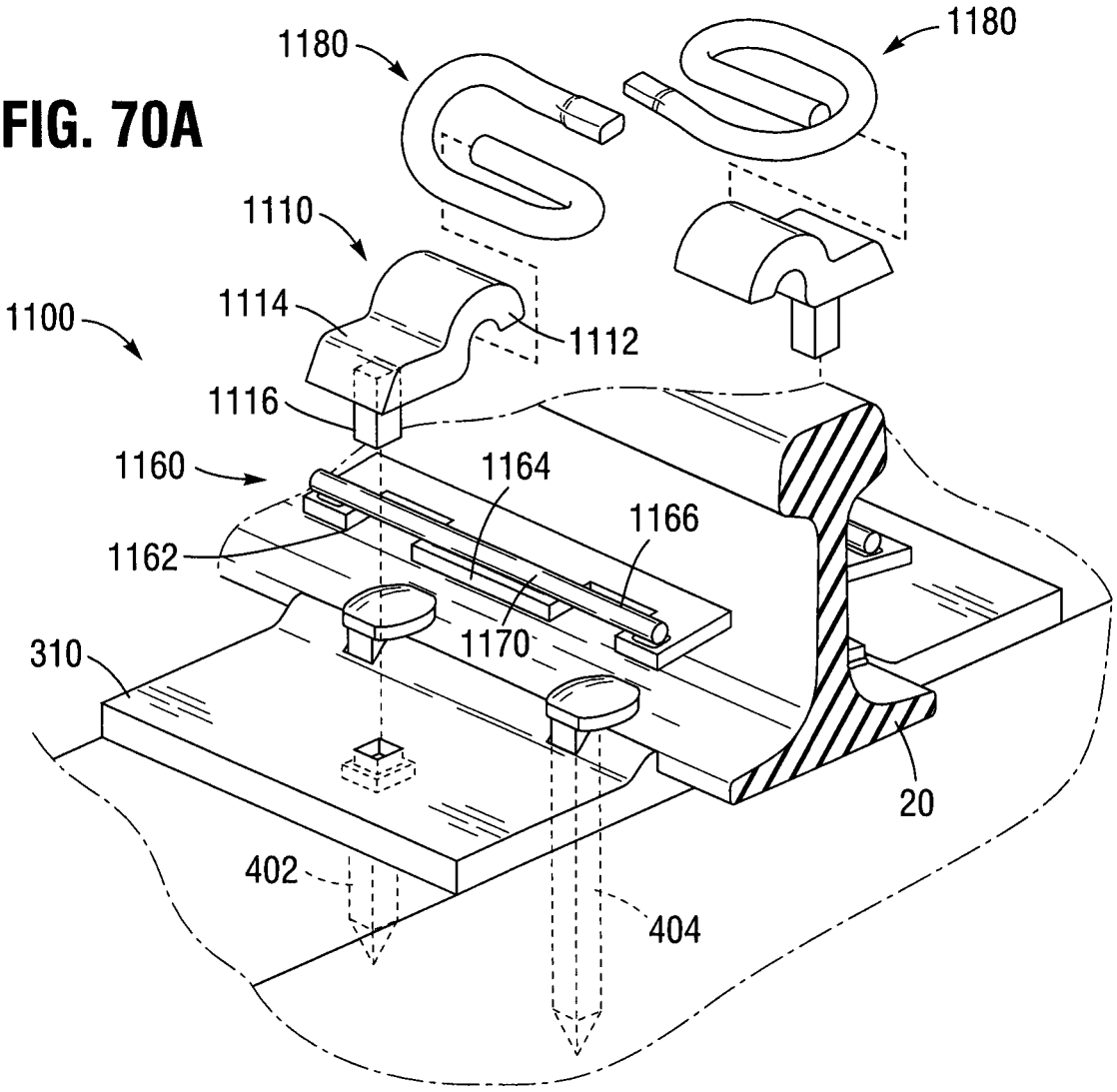

FIG. 70A is an exploded view of the G-clips with collars and raised auxiliary plates with pre-welded bars on both sides of the rail, above the spikes in the tie plate.

Figure 70B:
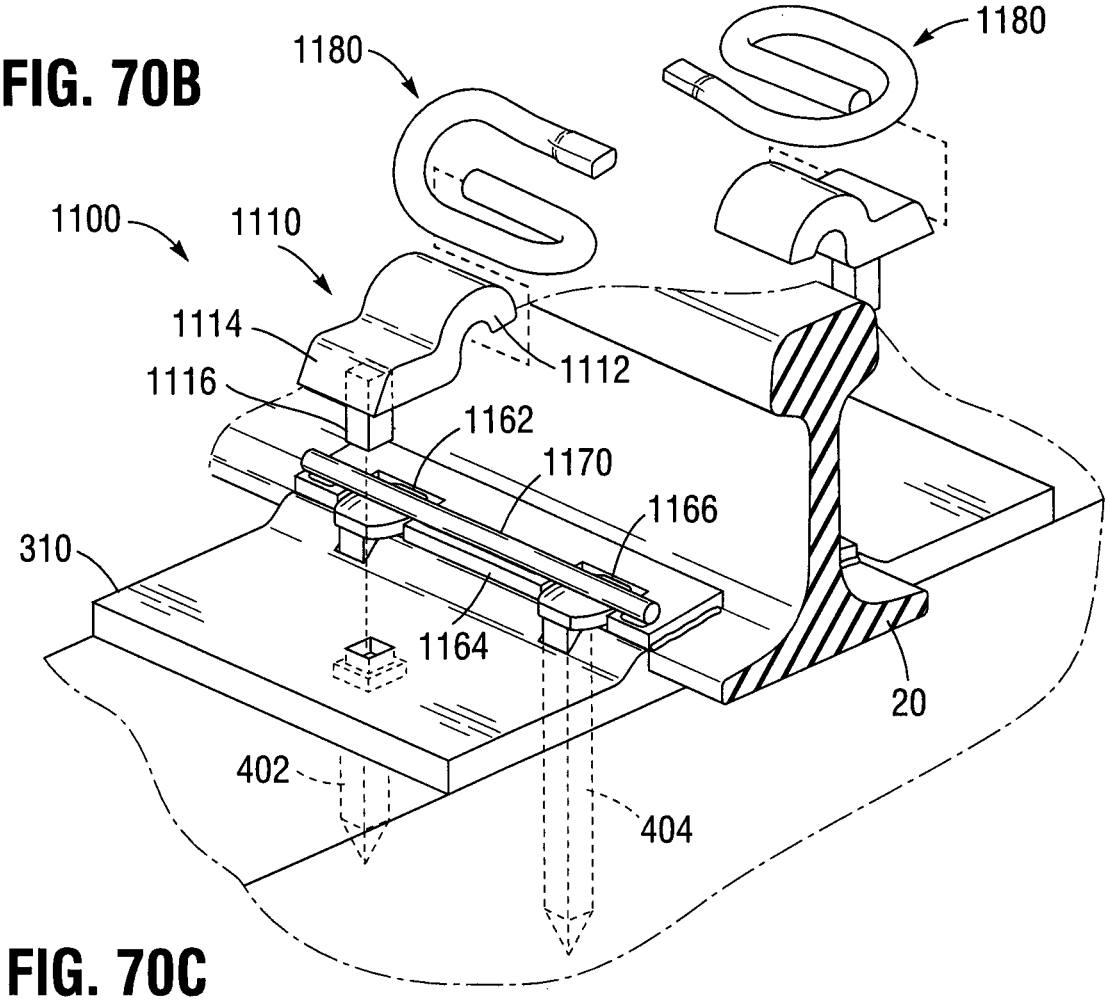

FIG. 70B is another exploded view of FIG. 70B with auxiliary plates with pre-welded bars on top of the spike heads and footer edge of the rail.

Figure 70C:
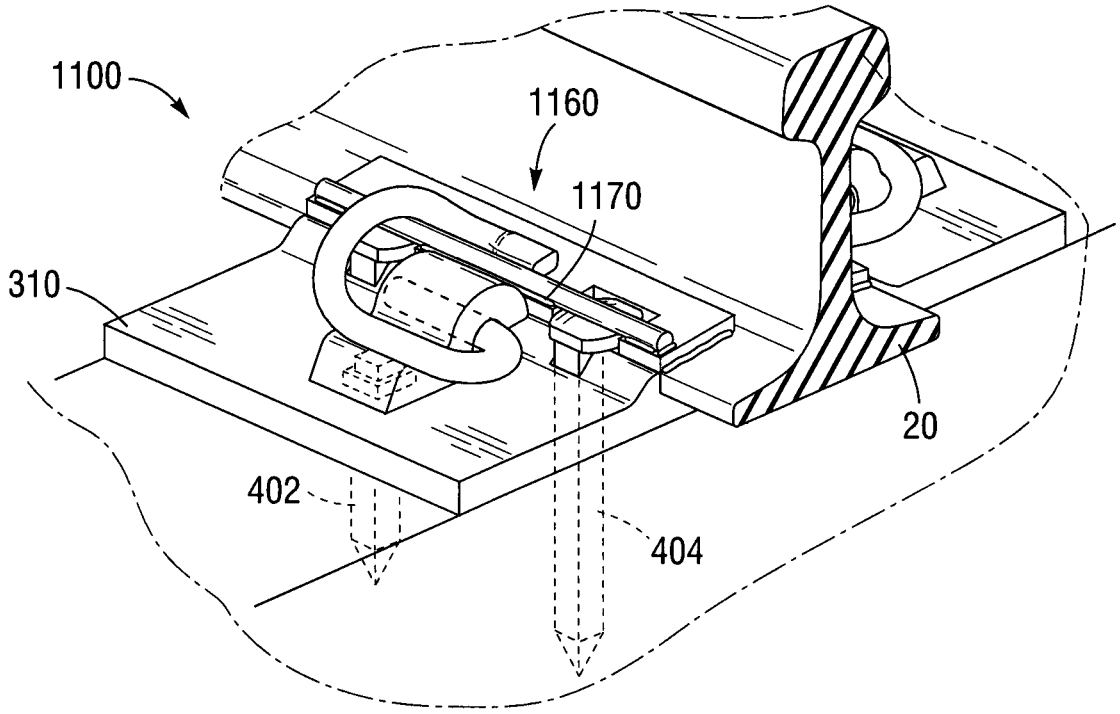

FIG. 70C is an assembled view of FIG. 70A-70B with collars fixably attached to the tie plate with the G-clips attached thereto pressing down on both the auxiliary plates over the spike heads and on the footer edge of the rail.

Figure 71:
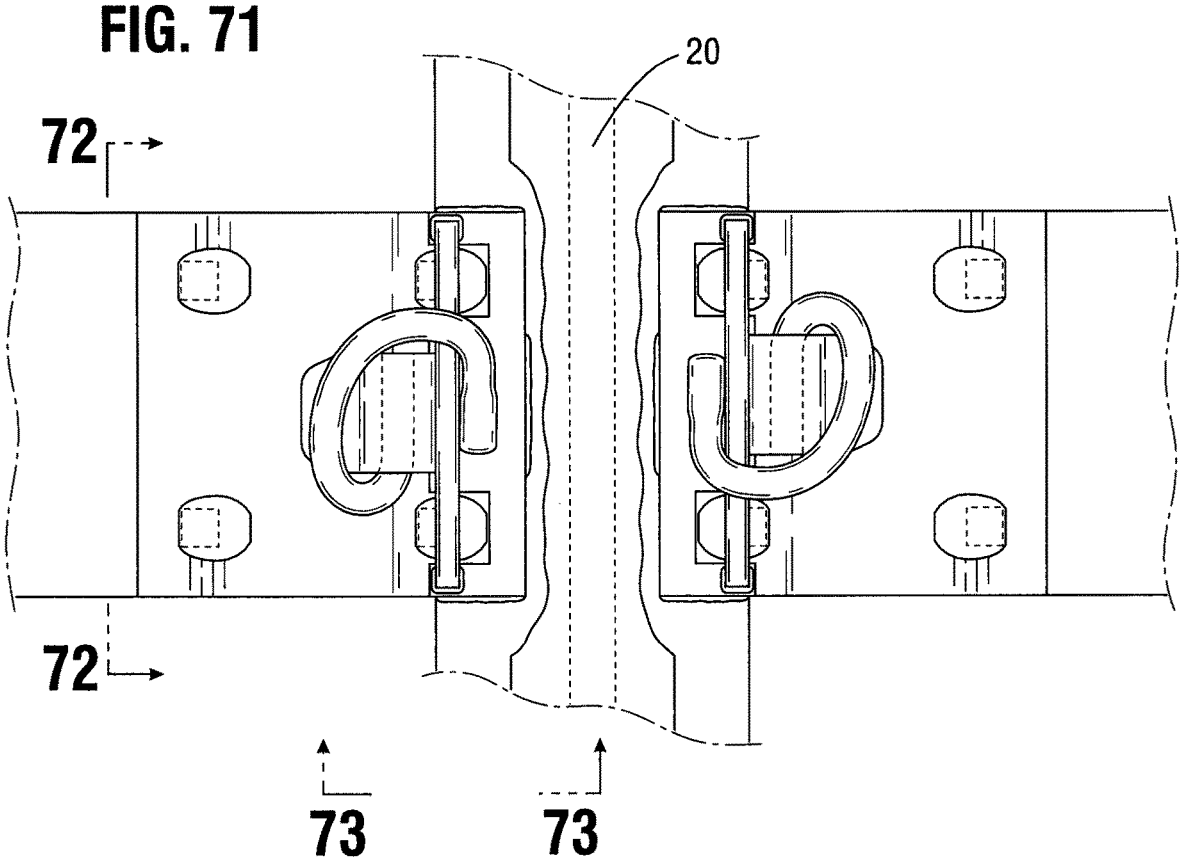

FIG. 71 is a top view of the assembled view of FIG. 70C.

Figure 72:
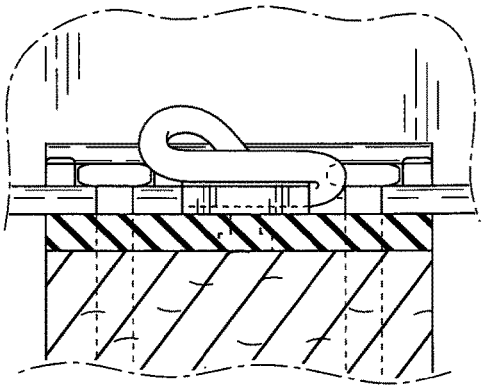

FIG. 72 is a front end view of FIG. 71 along arrows 72.

Figure 73:
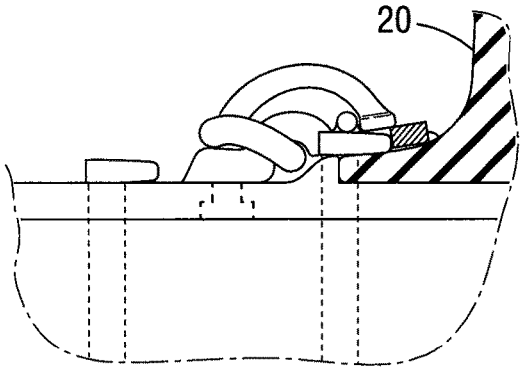

FIG. 73 is a cross-sectional view of FIG. 71 along arrows 73.

1200 Twelfth Embodiment W clip

Figure 74A:
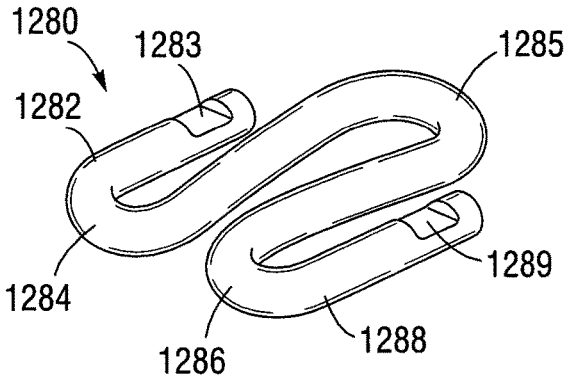

FIG. 74A is an upper perspective view of a W-clip.

Figure 74B:
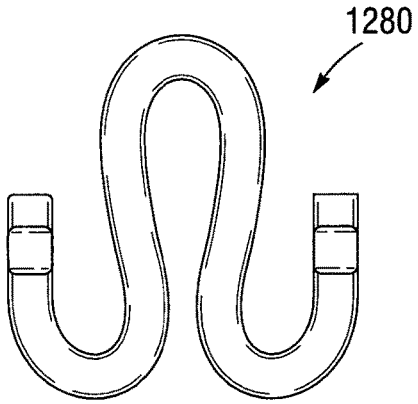

FIG. 74B is a top view of the W-clip of FIG. 74A.

Figure 74C:
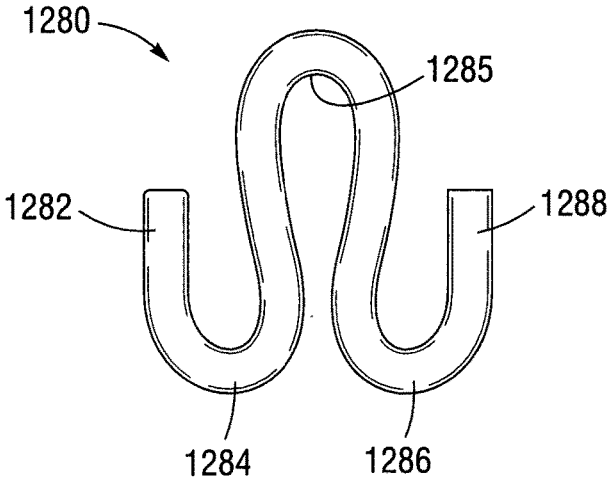

FIG. 74C is a bottom view of the W-clip of FIG. 74A.

Figure 74D:
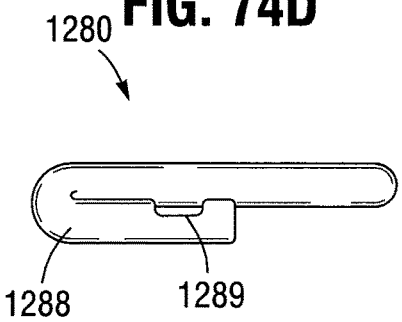

FIG. 74D is a right side view of the W-clip of FIG. 74A.

Figure 74E:
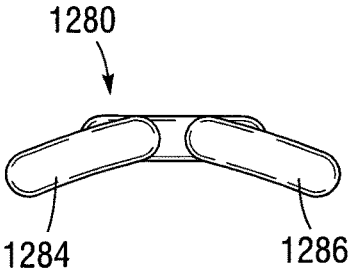

FIG. 74E is a rear end view of the W-clip of FIG. 74A.

Figure 74F:
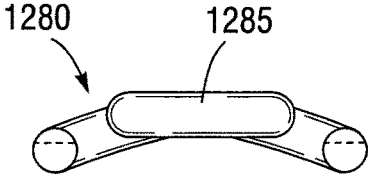

FIG. 74F is a front end view of the W-clip of FIG. 74A.

Figure 75A:
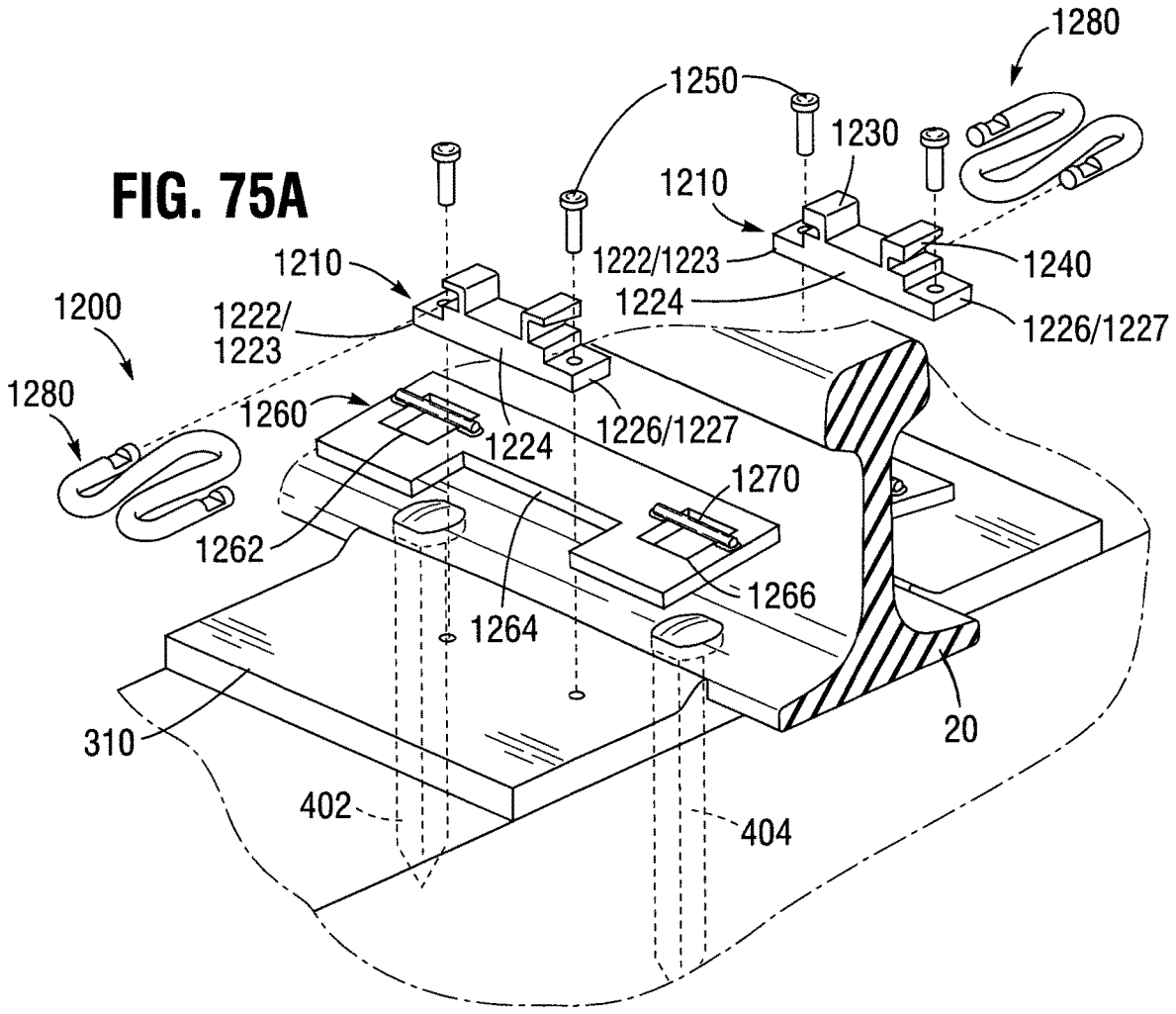

FIG. 75A is an exploded perspective view of the W-clips clip holder structure, raised auxiliary plate with pre-welded bars above a tie plate on sides of a rail.

Figure 75B:
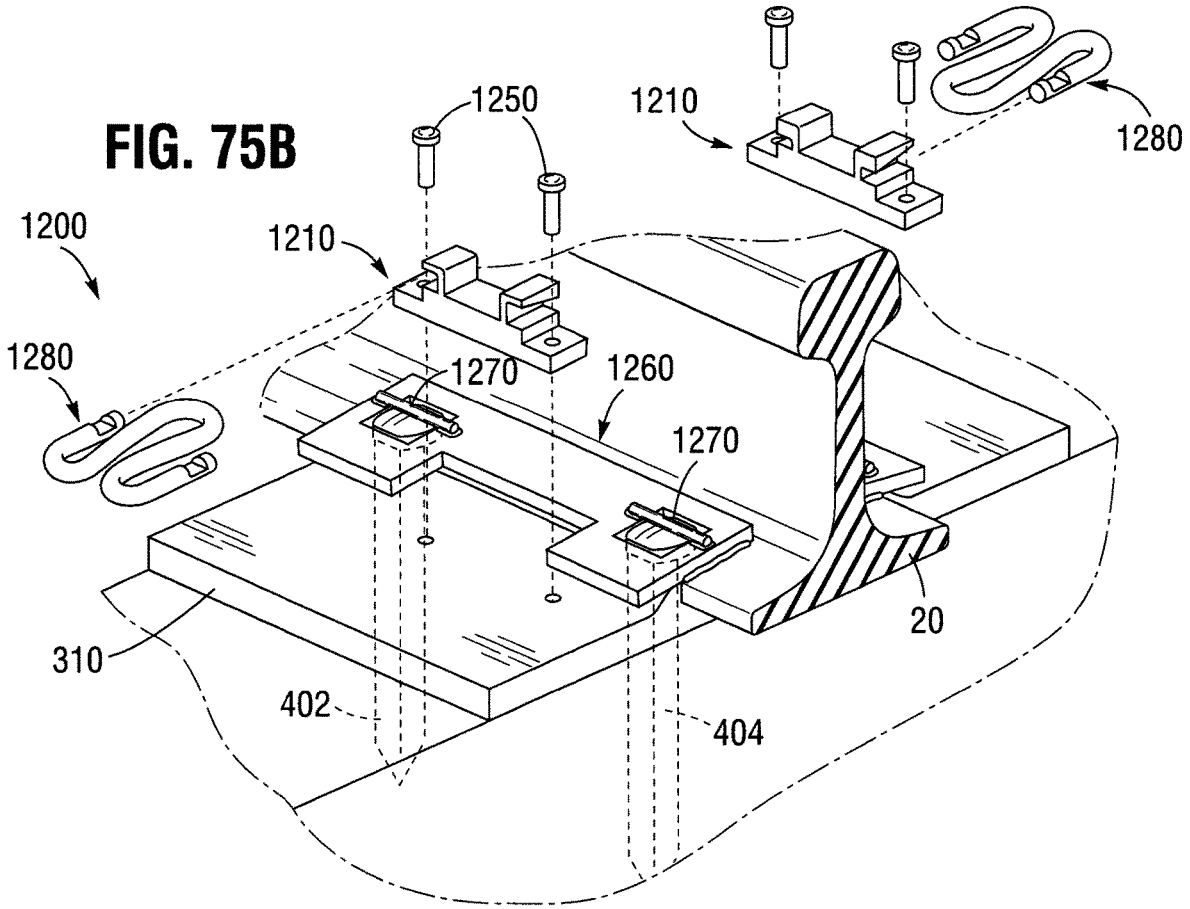

FIG. 75B is another exploded perspective view of FIG. 75A with the auxiliary plate with pre-welded bars installed on both sides of a rail.

Figure 75C:
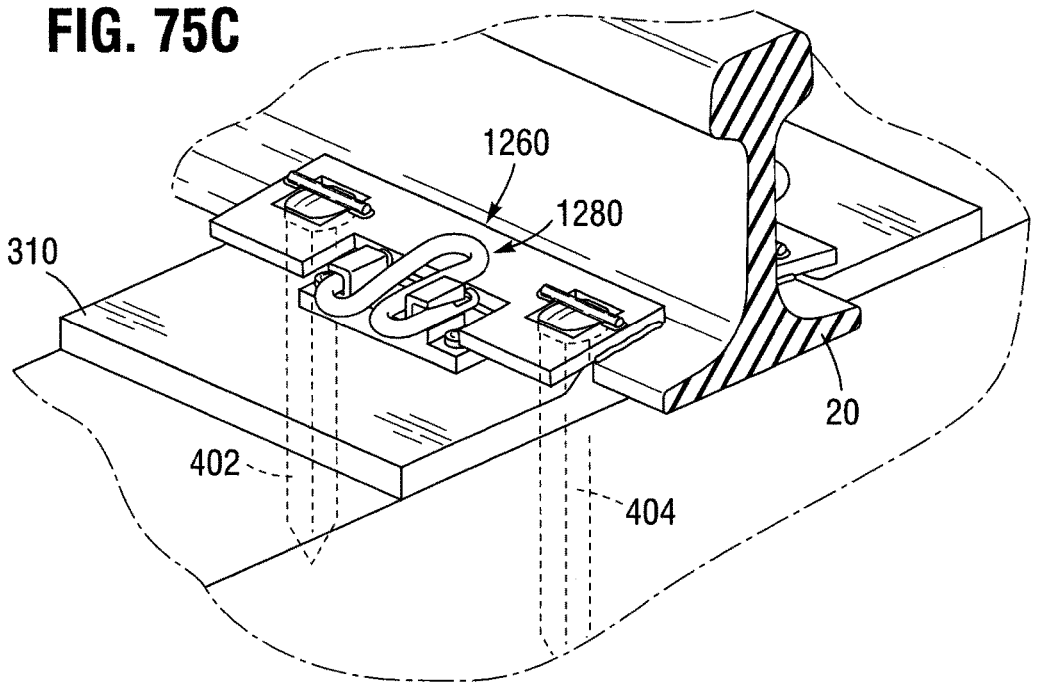

FIG. 75C is an assembled perspective view of FIGS. 74A-74B with W-clips pressed into the holder structure, which is riveted to the tie plate.

Figure 76:
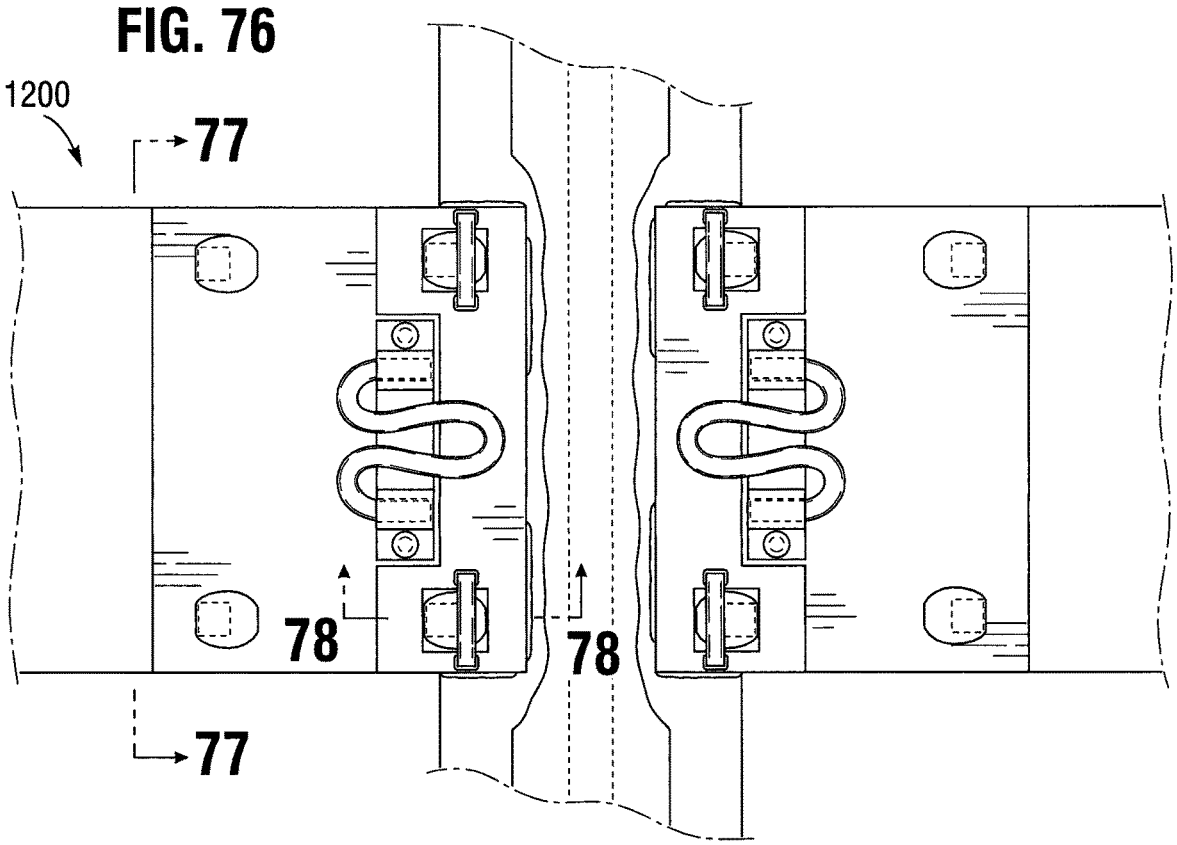

FIG. 76 is a top view of the assembled view of FIG. 75C.

Figure 77:
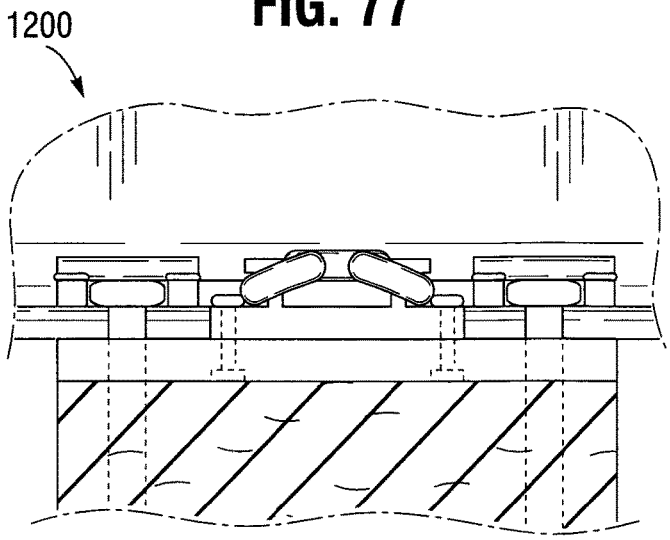

FIG. 77 is a front end view of FIG. 76 along arrows 77.

Figure 78:
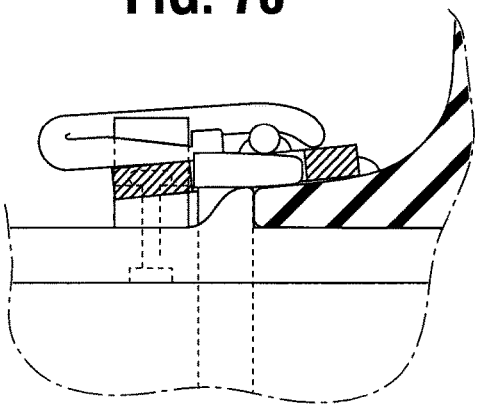

FIG. 78 is a cross-sectional view of FIG. 76 along arrows 78.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification does not include all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described-more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

Other technical advantages may become readily apparent to one of ordinary skill in the art after review of the following figures and description.

It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Unless otherwise specifically noted, articles depicted in the drawings are not necessarily drawn to scale.

A list of components will now be described.

1 Prior Art View of spikes attached to rail tie plate to hold rail to rail tie
2 spike
4 spike
6 spike
8 spike
10 Rail tie plate
12 first ridge
13 first hole
15 second hole
16 second ridge
20 Rail
30 rail tie
100 First Embodiment Rail Tie Plate with Holders for w Shaped Spring Clips
110 rail tie plate
112 first elongated ridge
113 first spike hole
115 second spike hole
116 second elongated ridge
117 third spike hole
119 fourth spike hole
120 left base plate
122 first left holder (box)
123 side openings for cotter pin
124 second left holder (box)
125 side openings for cotter pin
126 third left holder (box)

127 side openings for cotter pin
128 fourth left holder (box)
129 side openings for cotter pin
130 right base plate
132 first right holder (box)
133 side openings for cotter pin
134 second right holder (box)
135 side openings for cotter pin
136 third right holder (box)
137 side openings for cotter pin
138 fourth right holder (box)
139 side openings for cotter pin
140 W shaped spring clip
142 first leg
143 through-hole in first leg
144 mid portion
146 second leg
147 through-hole in second leg
152 first cotter pin
154 second cotter pin
156 third cotter pin
200 Second Embodiment Rail Tie Plate with Vertical Supports for Horizontal Bars
202 first spike
204 second spike
210 rail tie plate
212 first elongated ridge
213 first spike hole
215 second spike hole
216 second elongated ridge
217 third spike hole
219 fourth spike hole
222 first left vertical bracket
223 upper through-hole
224 first right vertical bracket
225 upper through hole
232 second left vertical bracket
233 upper through-hole
234 second right vertical bracket
235 upper through-hole
240 first elongated rod
241 through-hole in one end
247 through-hole in opposite end
250 second elongated rod
251 through-hole in one end
257 through-hole in opposite end
260 cotter pin(s)
300 Third Embodiment Rail Tie Plate with Vertical Threaded Bar Ends & Nuts
302 first spike
304 second spike
310 rail tie plate
312 first elongated ridge
213 first spike hole
315 second spike hole
316 second elongated ridge
317 third spike hole
319 fourth spike hole
322 first left stud with threaded end
323 upper through-hole
324 first right stud with threaded end
325 upper through hole
332 second left stud with threaded end
333 upper through-hole
334 second right stud with threaded end
335 upper through-hole
240 first flat plate
341 through-hole in one end
347 through-hole in opposite end
250 second flat plate
351 through-hole in one end
257 through-hole in opposite end
360 cotter pin(s)
370 nuts & washers
400 Fourth Embodiment Tie Plate with Inverted L-shaped brackets
402 first spike
404 second spike
410 tie plate
412 first elongated ridge
413 first spike hole
415 second spike hole
416 second elongated ridge
417 third spike hole
419 fourth spike hole
422 first left stud with threaded end
424 first right stud with threaded end
432 second left stud with threaded end
434 second right stud with threaded end
440 first horizontal plate
441 through-hole adjacent one end
442 first plates inverted L shape bracket
444 second inverted L shape bracket
446 third inverted L shape bracket
448 fourth inverted L shape bracket
449 through-hole adjacent opposite end
450 second horizontal plate
451 through-hole adjacent one end
452 first plates inverted L shape bracket
454 second inverted L shape bracket
456 third inverted L shape bracket
458 fourth inverted L shape bracket
459 through-hole adjacent opposite end
470 nuts & washers
480 W shaped spring clip
482 first leg
483 groove/notch in first leg
484 mid portion
486 second leg
487 groove/notch in second leg
500 Fifth Embodiment Tie Plate of plurality of metal structures and with horizontal channels/openings
502 first spike
504 second spike
510 tie plate
512 first elongated ridge
513 first spike hole
515 second spike hole
516 second elongated ridge
517 third spike hole
519 fourth spike hole
540 plurality of left metal structures with horizontal channel openings
542 first left metal structure with horizontal channel opening
543 first left structure side through-hole
544 second left metal structure with horizontal channel opening
545 second left structure side through-hole
546 third left metal structure with horizontal channel opening
547 third left structure side through-hole
548 fourth left metal structure with horizontal channel opening

549 fourth left structure side through-hole
550 cotter pins
560 plurality of right metal structures with horizontal channel openings
562 first right metal structure with horizontal channel opening
563 first right structure side through-hole
564 second right metal structure with horizontal channel opening
565 second right structure side through-hole
566 third right metal structure with horizontal channel opening
567 third right structure side through-hole
568 fourth right metal structure with horizontal channel opening
569 fourth right structure side through-hole
570 cotter pins
580 w shaped spring clip
582 first leg
583 through-hole in first leg
584 mid portion
586 second leg
587 through-hole in second leg
600 SIXTH Embodiment Tie Plate of plurality of metal structures with angled channel openings
602 first spike
604 second spike
610 tie plate
612 first elongated ridge
613 first spike hole
615 second spike hole
616 second elongated ridge
617 third spike hole
619 fourth spike hole
640 plurality of left metal structures with angled channel openings
642 first left metal structure with angled channel
643 first left structure side through-hole
644 second left metal structure with angled channel
645 second left structure side through-hole
646 third left metal structure with angled channel
647 third left structure side through-hole
648 fourth left metal structure with angled channel
649 fourth left structure side through-hole
650 cotter pins
660 plurality of right metal structures with angled channel openings
662 first right metal structure with angled channel
663 first right structure side through-hole
664 second right metal structure with angled channel
665 second right structure side through-hole
666 third right metal structure with angled channel
667 third right structure side through-hole
668 fourth right metal structure with angled channel
669 fourth right structure side through-hole
670 cotter pins
680 w shaped spring clip
682 first leg
683 through-hole in first leg
684 mid portion
686 second leg
687 through-hole in second leg
700 Seventh Embodiment-Concave back C clip
710 double box housing structure
712 left rectangular vertical frame
713 left rectangular frame base
714 right rectangular vertical frame
715 right rectangular frame base
722 left support tab
723 through-hole in left support tab
724 middle support tab connects each box housing structure
725 through-hole in middle support tab
726 right support tab
727 through-hole in right support tab
730 single box housing structure
732 rectangular vertical frame
733 rectangular frame base
742 left support tab
743 through-hole in left support tab
746 right support tab
747 through-hole in right support tab
750 rivet(s)
760 auxiliary plate
762 left spike notch
764 rectangular cut-out
766 right spike notch
770 bar(s)
780 flat concave back C clip
782 leg with concave top side & convex lower side
783 leg end
784 upward curved edge
786 downward curved edge
788 outer hook end
800 Eighth Embodiment-Convex back C clip
810 double box housing structure with upper slots
812 left rectangular vertical frame
813 upper slot left rectangular frame
814 right rectangular vertical frame
815 upper slot in right rectangular frame
822 left support tab
823 through-hole in left support tab
824 middle support tab connects each box housing structure
825 through-hole in middle support tab
826 right support tab
827 through-hole in right support tab
830 single box housing structure with upper slot
832 rectangular vertical frame
833 upper slot in rectangular frame base
842 left support tab
843 through-hole in left support tab
846 right support tab
847 through-hole in right support tab
850 rivet(s)
860 auxiliary plate
862 left spike notch
864 rectangular cut-out
866 right spike notch
870 bar(s)
880 flat convex back C clip with extended tail
882 leg (tail) with concave top side & convex lower side
883 leg end
884 upward curved hook
885 hook end
900 Ninth Embodiment-double hook flat C clip
910 double box housing structure with side slots
912 left box structure
913 side slot in left box structure
914 right box structure
915 side slot in right box structure
922 left support tab
923 through-hole in left support tab

924 middle support tab connects each box housing structure
925 through-hole in middle support tab
926 right support tab
927 through-hole in right support tab
930 single box structure with side slot
932 single box structure
933 side slot in single box structure
942 left support tab
943 through-hole in left support tab
946 right support tab
947 through-hole in right support tab
950 rivets
960 auxiliary plate
962 left spike notch
964 rectangular cut-out
966 right spike notch
970 bar(s)
980 double hook flat C clip
982 left inwardly facing hook
984 flat top
986 right inwardly facing hook
988 stepped space between hook ends
1000 Tenth Embodiment double hook two wire C clip
1010 double box housing structure with side slots
1012 left box structure
1013 side slot in left box structure
1014 right box structure
1015 side slot in right box structure
1022 left support tab
1023 through-hole in left support tab
1024 middle support tab connects each box housing structure
1025 through-hole in middle support tab
1026 right support tab
1027 through-hole in right support tab
1030 single box structure with side slot
1032 single box structure
1033 side slot in single box structure
1042 left support tab
1043 through-hole in left support tab
1046 right support tab
1047 through-hole in right support tab
1050 rivets
1060 auxiliary plate
1062 left spike notch
1064 rectangular cut-out
1066 right spike notch
1070 bar(s)
1080 double hook two wire C-clip
1082 left inwardly facing hook
1084 flat top
1086 right inwardly facing hook
1088 Stepped space between hook ends
1100 Eleventh Embodiment G clip
1110 collar
1112 front curved end
1114 base
1116 stud extending downward
1160 auxiliary plate
1162 left notch
1164 middle rectangular section
1166 right notch
1170 bar
1180 G clip
1182 flat protruding end
1184 first bend
1186 second bend
1188 straight end
1200 Twelfth Embodiment W-clip
1210 Clip holder structure
1220 base plate
1222 left tab
1223 through-hole in left tab
1224 raised middle section
1226 right tab
1227 through-hole in right tab
1230 left facing bracket
1240 right facing bracket
1250 rivets
1260 auxiliary plate
1262 left notch
1264 middle rectangular cut-out
1266 right notch
1270 bar(s)
1280 W-clip
1282 left leg
1283 notch on left leg end
1284 left bend
1285 middle bend
1286 right bend
1288 right leg
1289 notch on right leg end

First Embodiment

Figure 3:
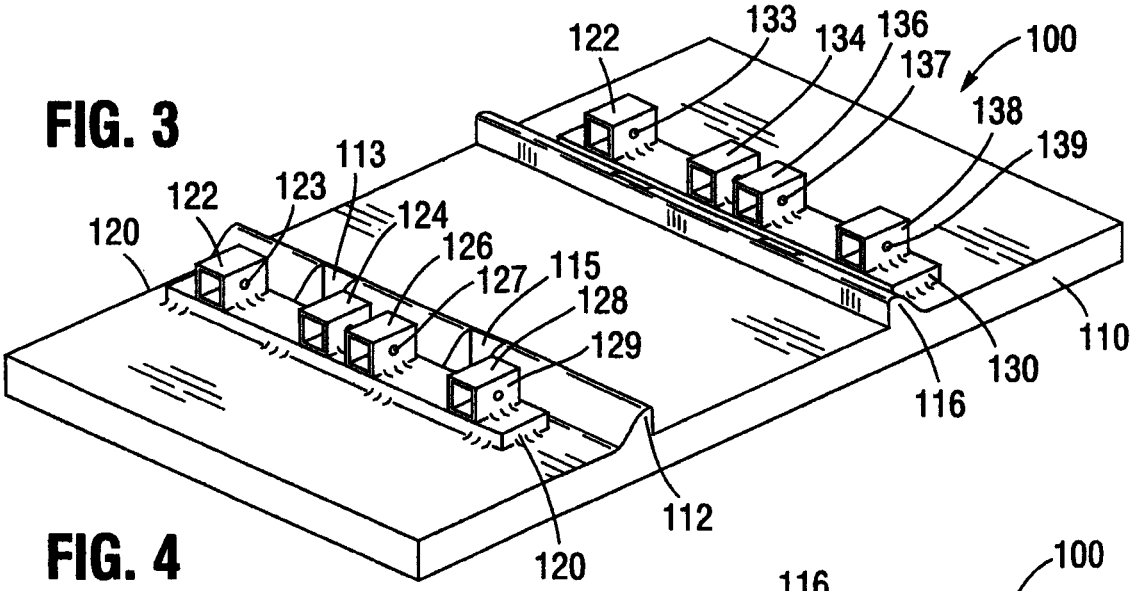
FIG. 3 is an upper perspective view of a spring clip tie plate embodiment.
Figure 4:
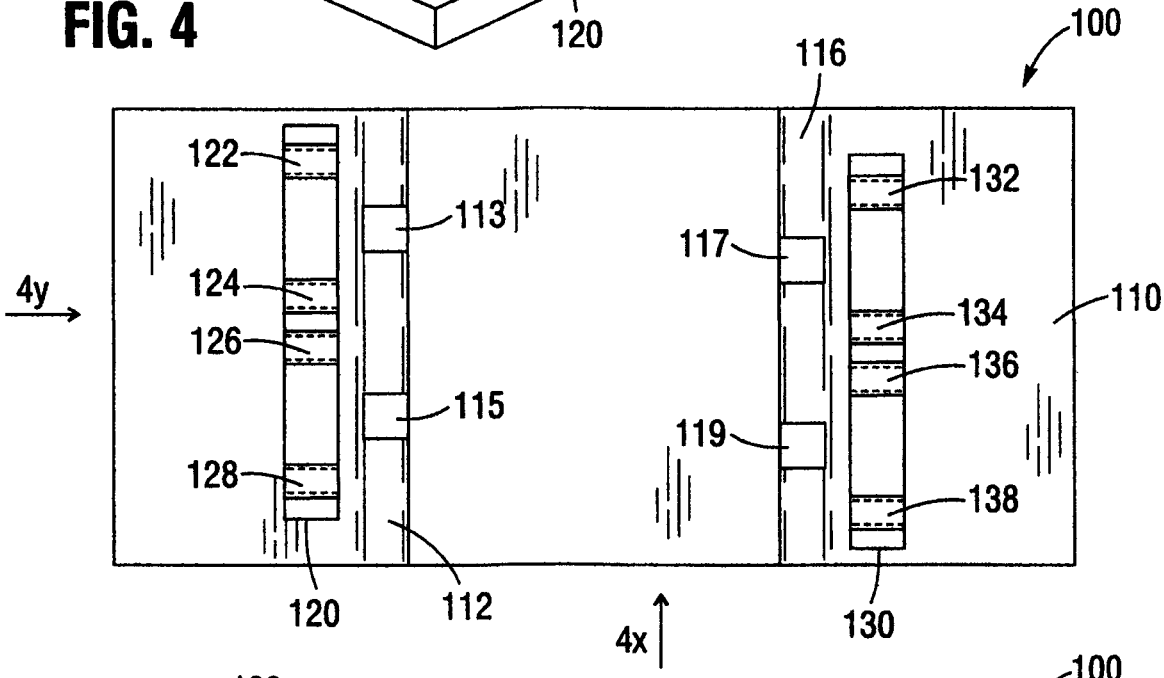
FIG. 4 is a top view of the spring clip tie plate of FIG. 3.
Figure 5:
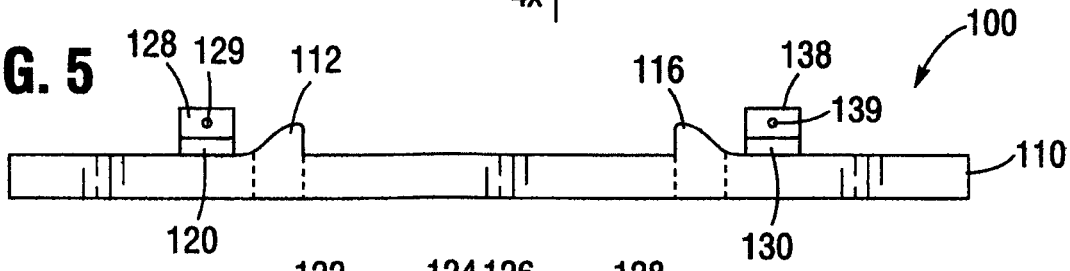
FIG. 5 is a side view of the spring clip tie plate of FIG. 4 along arrow 4X.
Figure 6:
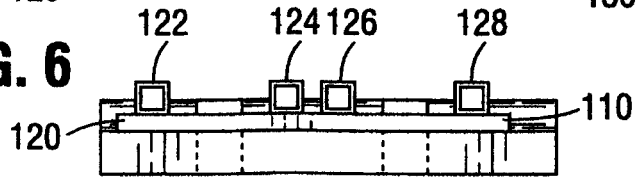
FIG. 6 is a front end view of the spring clip tie plate of FIG. 4 along arrow 4Y.

FIG. 3 is an upper perspective view of a spring clip tie plate 100 FIG. 4 is a top view of the spring clip tie plate 100 of FIG. 3. FIG. 5 is a side view of the spring clip tie plate 100 of FIG. 4 along arrow 4X. FIG. 6 is a front end view of the spring clip tie plate 100 of FIG. 4 along arrow 4Y.

Figure 1:
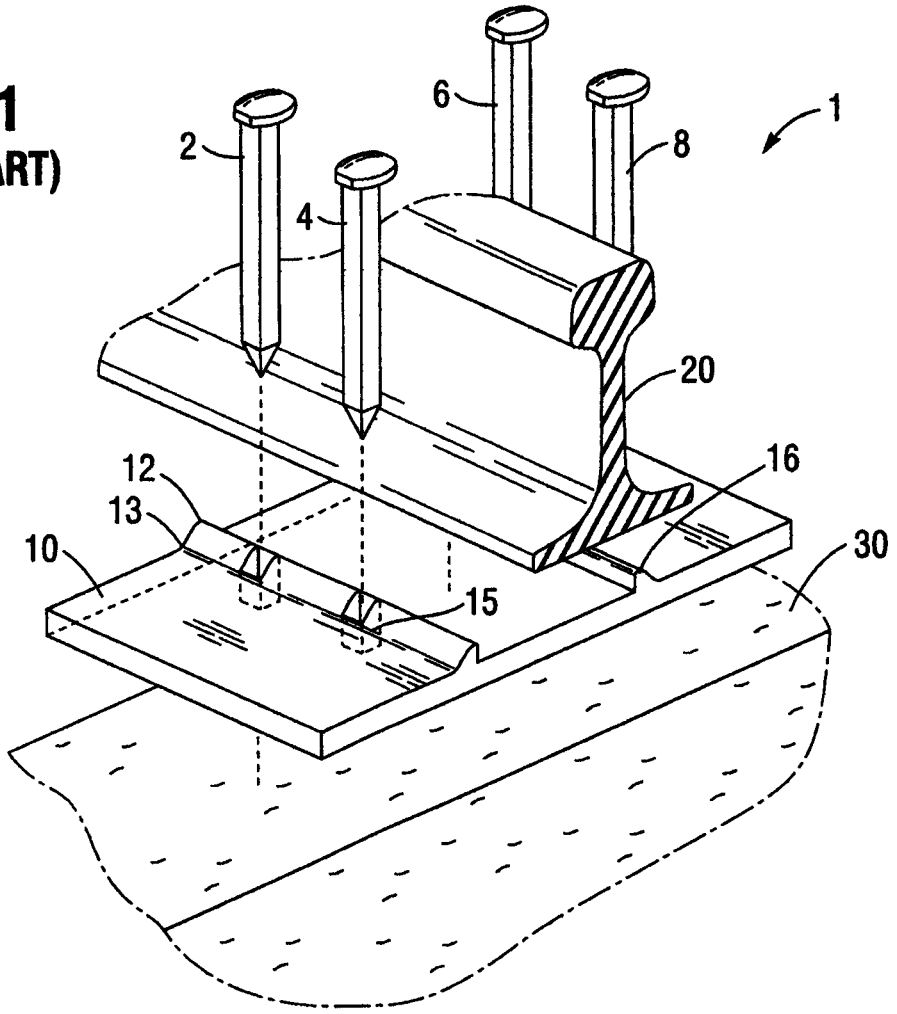
FIG. 1 (PRIOR ART)
FIG. 1 is an upper perspective exploded view of a prior art assembly of a spikes about to be attached to a rail tie plate to hold down a rail to a rail tie.
Figure 2:
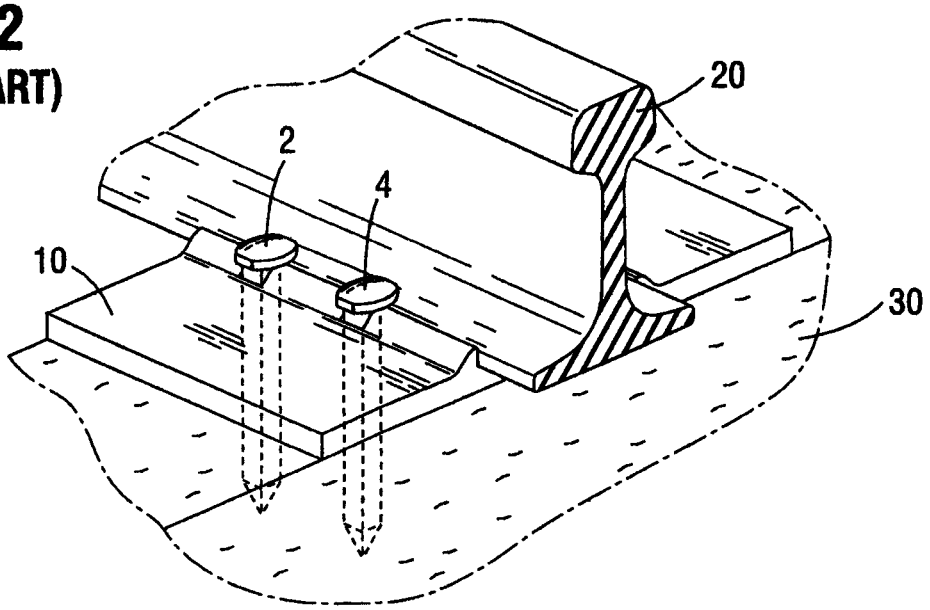
FIG. 2 (PRIOR ART)
FIG. 2 is an upper perspective assembled view of FIG. 1 with spikes attached through a rail tie plate holding a rail to a rail tie.

Referring to FIGS. 3-6, a tie plate 110 similar to those shown and described in the prior art of FIGS. 1A and 1B and can be modified.

The new railroad tie plate embodiment 100 can be manufactured in a factory and replaces the old railroad tie plate. This happens when the railroad ties need replacing or when service work needs to be done. It also happens when new rail track is laid down.

A first plurality of holders that can have box shapes 122, 124, 16, 128 can be fixed to an upper surface of a left rectangular base plate 120 by being welded, and the like. Each of the first plurality of holders can have side through-holes 123, 125, 127, 129 running from one side of each box shape through to another side of each box shape. The outer facing sides of each of the plurality of holders 122, 124, 126, 128 can be open. The left base plate 120 with first plurality of holders 122, 124, 126, 128 can be attached to an upper surface of the tie plate 110 adjacent to an outer side of the first raised ridge 112 by being welded, and the like.

A second plurality of holders that can have box shapes 132, 134, 136, 138 can be fixed to an upper surface of a right rectangular base plate 120 by being welded, and the like. Each of the second plurality of holders can have side through-holes 133, 135, 137, 139 running from one side of each box shape through to another side of each box shape. The outer facing sides of each of the plurality of holders 132, 134, 136, 138 can be open. The right base plate 130 with second plurality of holders 132, 134, 136, 138 can be attached to an upper surface of the tie plate 110 adjacent to an outer side of the second raised ridge 114 by being welded, and the like.

The tie plate 110 can include a first spike hole 113, and second spike hole 115 running from a top side of the tie plate 110 through the elongated ridge 112, through the bottom side of the tie plate 110. The tie plate 110 can include a third spike hole 117, and fourth spike hole 119 running from a top side of the tie plate 110 through the other elongated ridge 116, through the bottom side of the tie plate 110.

Figure 7A:
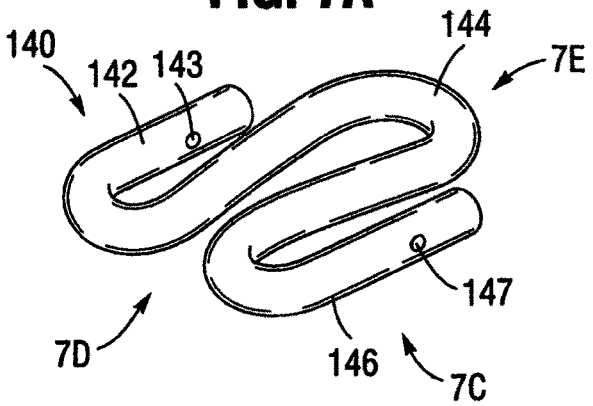
FIG. 7A is an upper perspective view of a w spring clip.
Figure 7B:
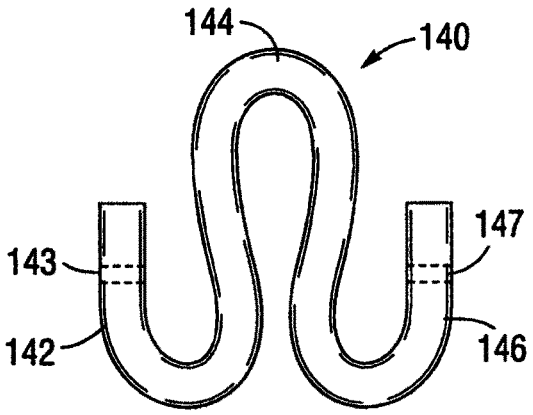
FIG. 7B is a top view of the w spring clip of FIG. 7A.
Figure 7C:
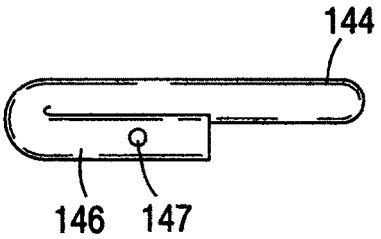
FIG. 7C is a side view of the w spring clip of FIG. 7A along arrow 7C.
Figure 7D:
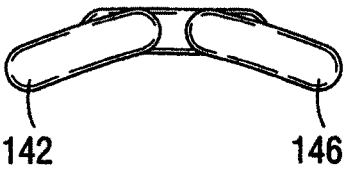
FIG. 7D is a front view of the w spring clip of FIG. 7A along arrow 7D.
Figure 7E:
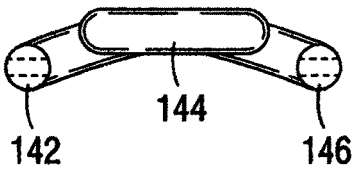
FIG. 7E is a rear view of the w spring clip of FIG. 7A along arrow 7E.

FIG. 7A is an upper perspective view of a W spring clip 140. FIG. 7B is a top view of the W spring clip 140 of FIG. 7A. FIG. 7C is a side view of the W spring clip 140 of FIG. 7A along arrow 7C. FIG. 7D is a front view of the W spring clip 140 of FIG. 7A along arrow 7D. FIG. 7E is a rear view of the W spring clip 140 of FIG. 7A along arrow 7E.

Each W spring clip 140 can be made from steel, spring steel and the like, with a first leg 142, through-hole 143 running from one side of the first leg 142 to welded, and the other side, curved (bent) midportion 144, a second leg 146 and a through-hole 147 running from one side of the second leg 146 to the other side.

A process for using invention will now be described; A machine on the tracks pulls existing spikes out on a section of track. Then a machine, such as a crane, lifts the tracks high enough to remove the existing railroad tie plates. Then the wooden tie is pulled out from underneath the rails. Then new ties are inserted under the rails as they are still lifted up. Once the wooden ties are in place the new railroad tie plates 100 are slid under the rail which is then lowered on to the plates 110. Each rail 20 sits between two bumps (elongated parallel ridges 112, 116, which form a pocket for the rail 20.

Referring to FIGS. 1-6 and 8, the spikes 6, 8 are then driven into the spike holes 113, 115, and another pair of spikes (not shown) driven into the spike holes 117, 119.

Figure 8A:
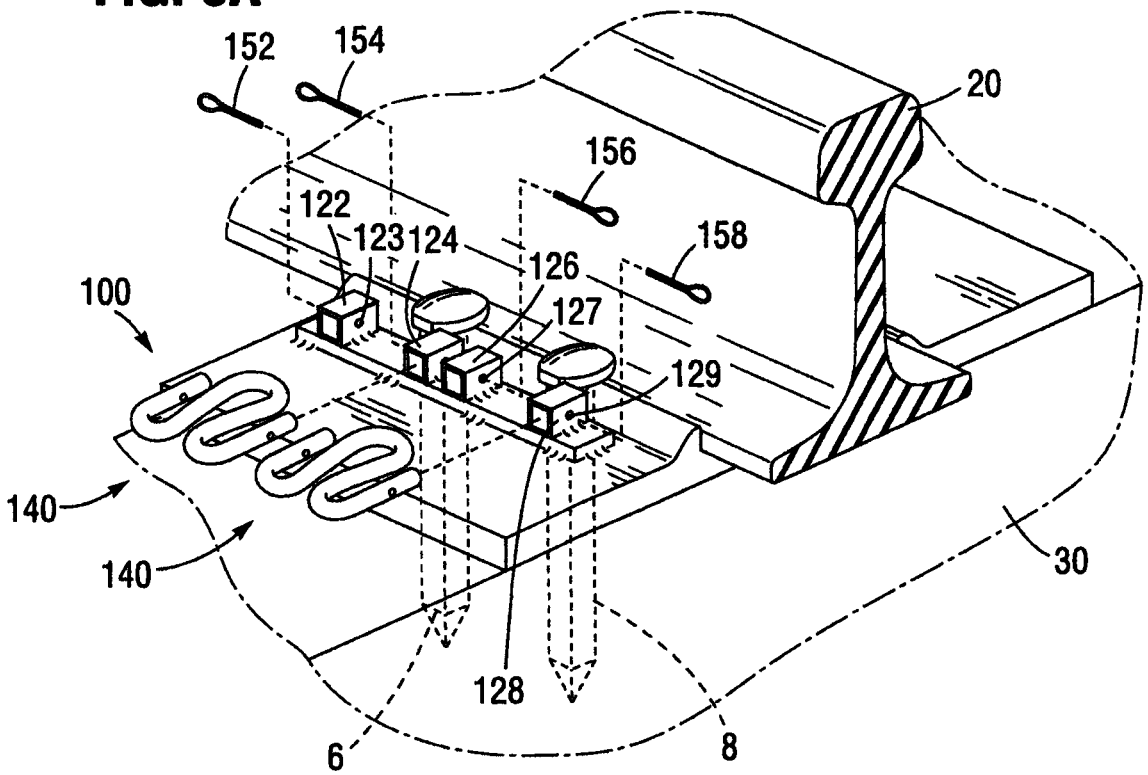
FIG. 8A is an upper perspective view of the spring clip tie plate of FIGS. 3-6 mounted between a rail and a tie, with the w spring clip(s) of FIGS. 7A-7C about to be attached.

FIG. 8A is an upper perspective view of the spring clip tie plate 100 of FIGS. 3-6 mounted between a rail 20 and a tie 30, with the W spring clip(s) 140 of FIGS. 7A-7C about to be attached.

Figure 8B:
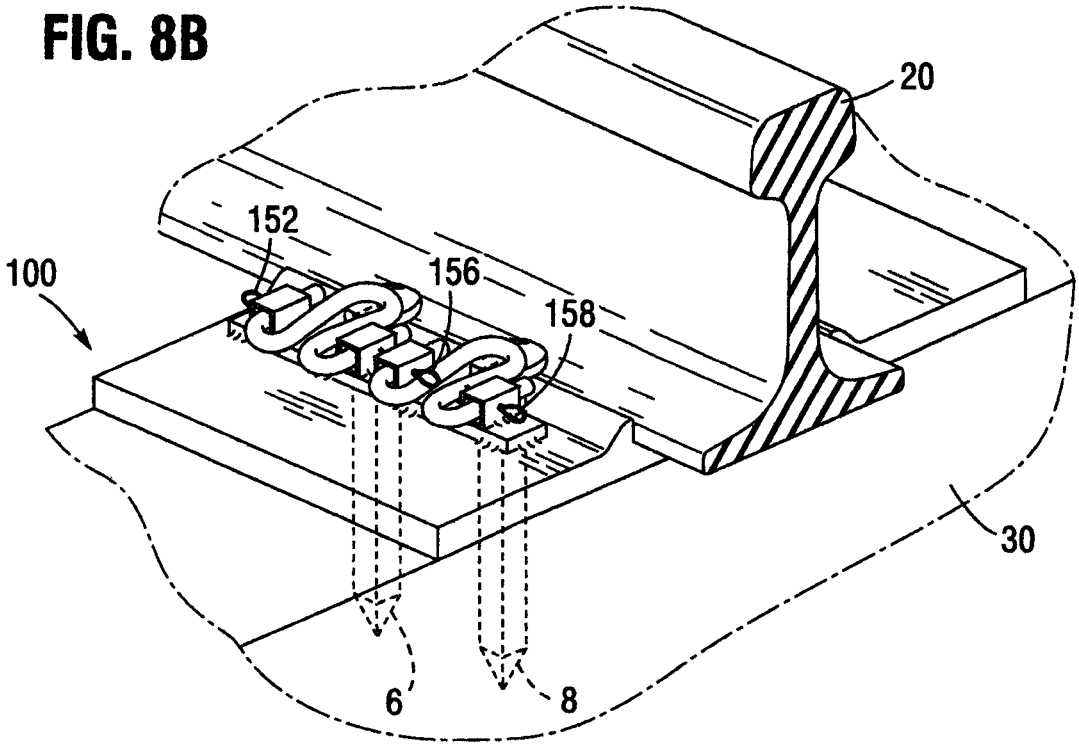
FIG. 8B is an upper perspective view of FIG. 8A with the w spring clip(s) assembled with the spring clip tie plate.

FIG. 8B is an upper perspective view of FIG. 8A with the W spring clip(s) 140 assembled with the spring clip tie plate embodiment 100.

Referring to FIGS. 7A-7E and 8A-8B, the free ends 142, 146 of the w clips 140 by the W clips are pushed into the apertures outer side openings in the plurality of holders 122, 124, 126, 128, 132, 134, 135, 138 and the bent midportion 144 of the W spring clips 140 are pushed and over the top of the spike heads on the spikes 6, 8.

Referring to FIGS. 3, 8A and 8B, to lock the W clips 140 in place, cotter pins 152, 154, 156, 158 are then pushed into the holes securing and locking the legs 142*m* 146 of the w clips 140 to the tie plate 110.

The other side of the rail 20 is similarly attached to the rail tie with another set of w clips 140 in a similar manner.

Second Embodiment

The new railroad tie plate embodiment 200 can be manufactured in a factory and replaces the old railroad tie plate. This happens when the railroad ties need replacing or when service work needs to be done. It also happens when new rail track is laid down.

A process for using invention will now be described which is similar to the process for installing the first embodiment above. A machine on the tracks pulls existing spikes out on a section of track. Then a machine, such as a crane, lifts the tracks high enough to remove the existing railroad tie plates. Then the wooden tie is pulled out from underneath the rails. Then new ties are inserted under the rails as they are still lifted up. Once the wooden ties are in place the new railroad tie plates 210 (shown in FIGS. 9-12) are slid under the rail which is then lowered on to the plates 210.

Each rail 20 sits between two bumps (elongated parallel elongated ridges 212, 216 on the rail tie plate 210 which form a pocket for the rail 20.

Figure 13A:
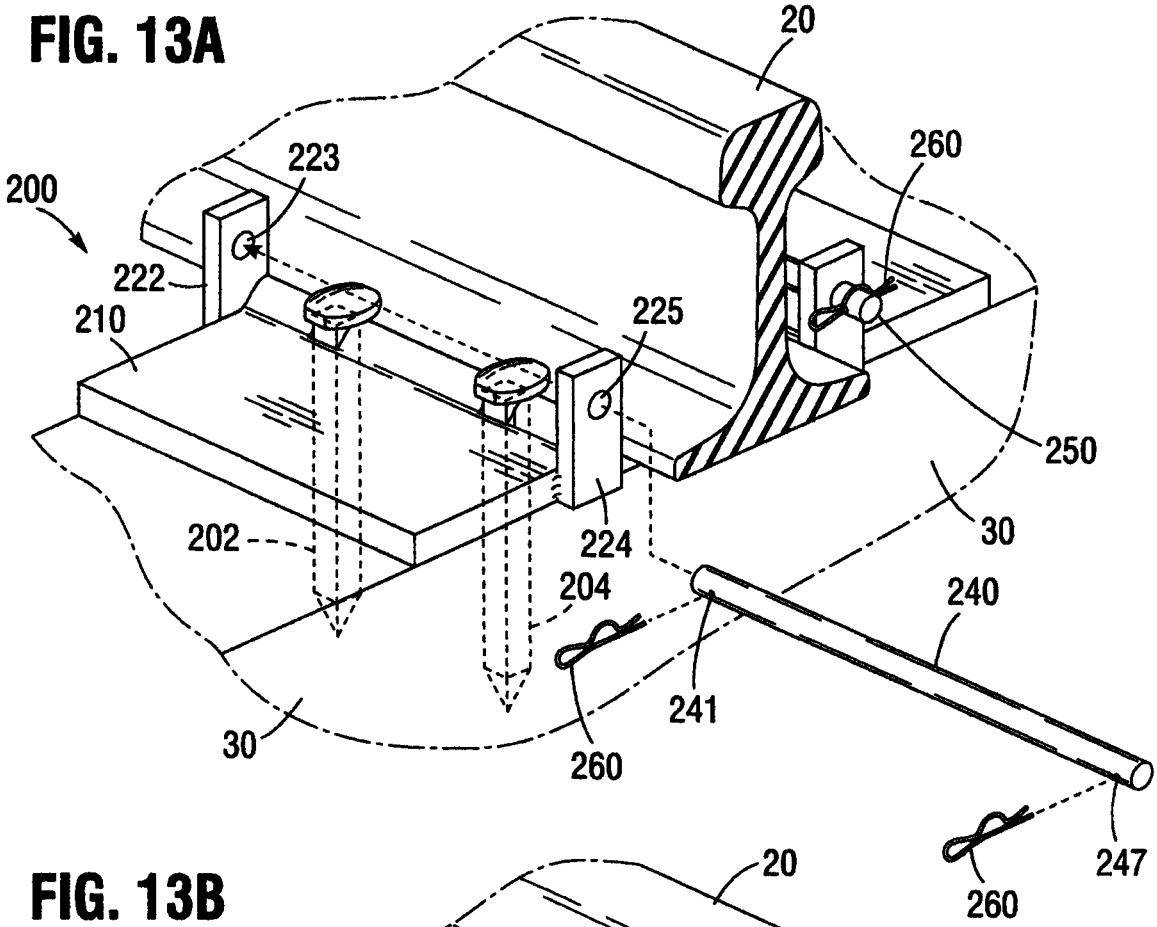
FIG. 13A is an upper perspective view of the tie plate with vertical steel brackets of FIGS. 10-12 mounted between a rail and tie with a steel rod ready to be inserted through holes in the vertical brackets/
Figure 13B:
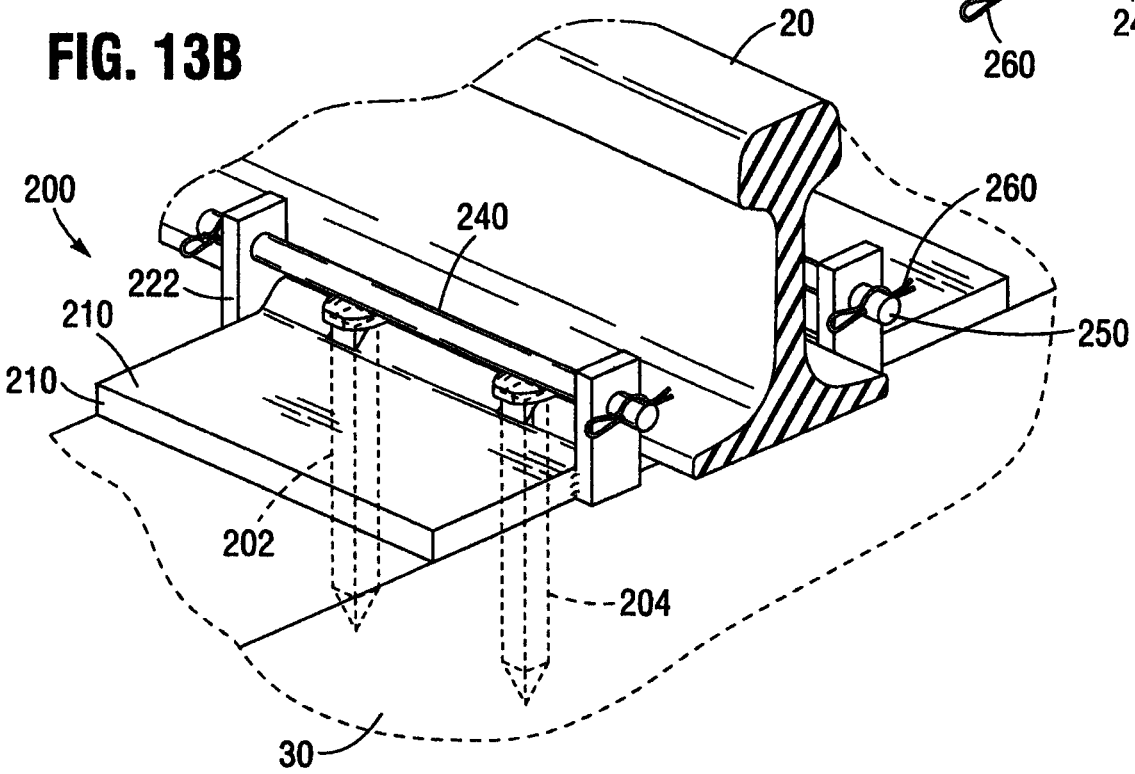
FIG. 13B is an upper perspective view of FIG. 13A with the steel rod mounted through the holes in the vertical brackets over the top of the spikes and locked in place with cotter pins.

Spikes 202, 204 (shown in FIGS. 13A-13B are then driven into spike holes 213, 215 in the tie plate 210 and another pair of spikes (not shown) driven into another set of spike holes 217, 219.

Figure 9:
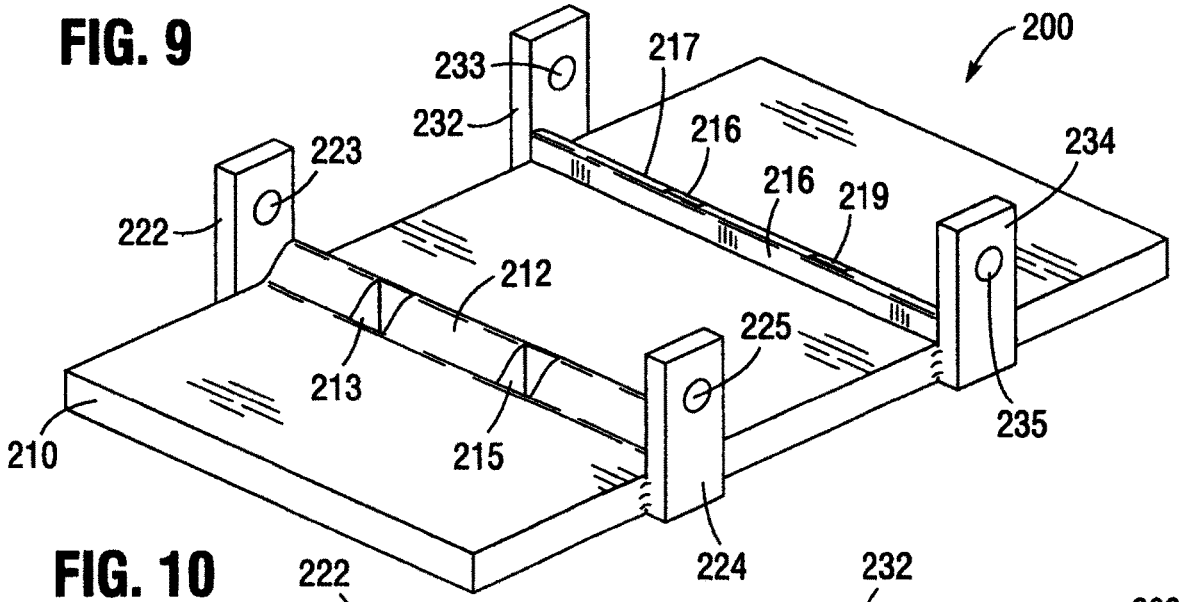
FIG. 9 is an upper perspective view of a second embodiment of a tie plate with vertical steel brackets for supporting steel rods to retain railroad spikes.
Figure 10:
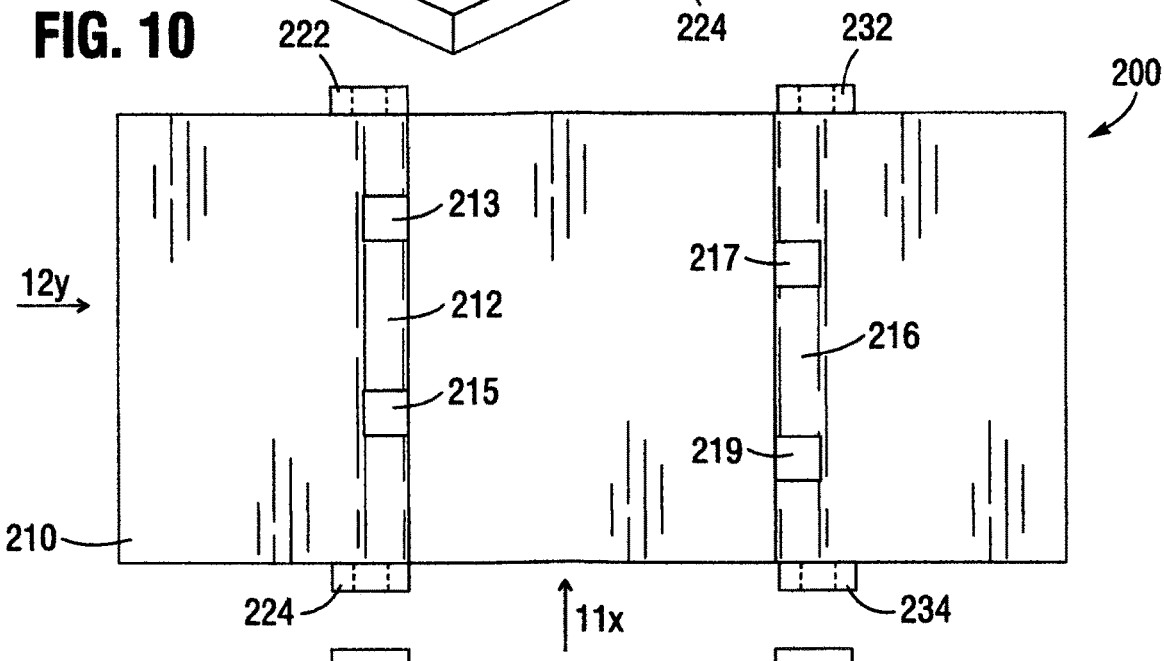
FIG. 10 is a top view of the tie plate with vertical steel brackets of FIG. 9.

FIG. 9 is an upper perspective view of a second embodiment 200 of a tie plate 210 with vertical steel brackets 222, 224, 322, 324 for supporting steel rods to retain railroad spikes. FIG. 10 is a top view of the tie plate 210 with vertical steel brackets 222, 224, 322, 324 of FIG. 9.

Figure 11:
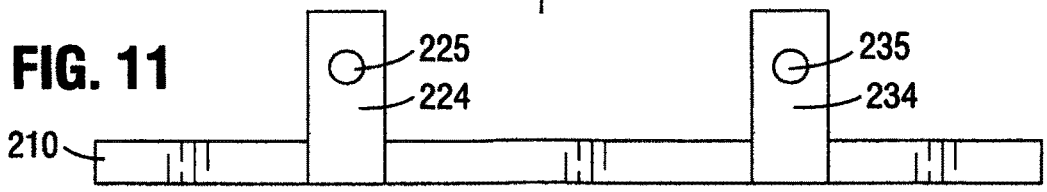
FIG. 11 is a side view of the tie plate with vertical steel brackets of FIG. 10 along arrow 11X.
Figure 12:
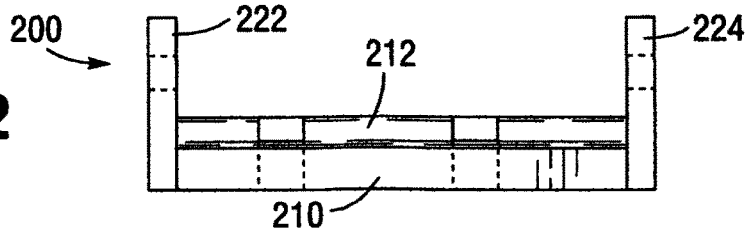
FIG. 12 is a front end view of the tie plate with vertical steel brackets of FIG. 10 along arrow 12Y.

FIG. 11 is a side view of the tie plate 210 with vertical steel brackets 222, 224, 322, 324 of FIG. 10 along arrow 11X. FIG. 12 is a front end view of the tie plate 210 with vertical steel brackets 222, 224, 322, 324 of FIG. 10 along arrow 12Y.

Referring to FIGS. 9-12, a rail tie plate 210 can have a first spike hole 213, and second spike hole 215 running from a top side of the tie plate 210 through the elongated ridge 212, through the bottom side of the tie plate 210. The tie plate 210 can include a third spike hole 217, and fourth spike hole 219 running from a top side of the tie plate 210 through the second elongated ridge 216, through the bottom side of the tie plate 210.

A first left bracket 222 can be welded to the outer side of the tie plate 210 along the left side of the first elongated ridge 212, and a first right bracket 224 can be welded to an opposite outer side of the tie plate 210 along the right side of the first elongated ridge 212.

A second left bracket 232 can be welded to the outer side of the tie plate 210 along the left side of the second elongated ridge 216, and a second right bracket 224 can be welded to an opposite outer side of the tie plate 210 along the right side of the second elongated ridge 216.

The vertical brackets 222, 224, 232, 234 can each have upper through-holes 223, 235, 233, 235 passing from one side of each bracket to an opposite side.

FIG. 13A is an upper perspective view of the tie plate 210 with vertical steel brackets 222, 224, 232, 234 of FIGS. 10-12 mounted between a rail 20 and tie 30 with a steel rod 240 ready to be inserted through holes in the vertical brackets 222, 224. One end or steel rod 240 with through-hole 241 is inserted into through-hole 225 of second vertical bracket 224 and then through through-hole 223 of first elongated bracket 222.

FIG. 13B is an upper perspective view of FIG. 13A with the steel rod mounted 240 through the holes 223, 225 in the first vertical brackets 222, 224 over the top of the spikes 202, 204 and locked in place with cotter pins 260 inserted into through-holes 241, 247 in the ends of first elongated rod 240. As shown in FIG. 13B, a second elongated rod 250 having ends with through holes 251, 257 can be similarly mounted in second left vertical bracket 232, and second right vertical bracket 234 and locked in place with additional cotter pins 260 to be used to retain another set of spikes (not shown) in place.

Third Embodiment

The new railroad tie plate embodiment 300 can be manufactured in a factory and replaces the old railroad tie plate. This happens when the railroad ties need replacing or when service work needs to be done. It also happens when new rail track is laid down.

A process for using invention will now be described which is similar to the process for installing the first and second embodiment above. A machine on the tracks pulls existing spikes out on a section of track. Then a machine, such as a crane, lifts the tracks high enough to remove the existing railroad tie plates. Then the wooden tie is pulled out from underneath the rails. Then new ties are inserted under the rails as they are still lifted up. Once the wooden ties are in place the new railroad tie plates 310 (shown in FIGS. 9-12) are slid under the rail which is then lowered on to the plates 310.

Each rail 20 sits between two bumps (elongated parallel elongated ridges 312, 316 on the rail tie plate 310 which form a pocket for the rail 20.

Figure 18A:
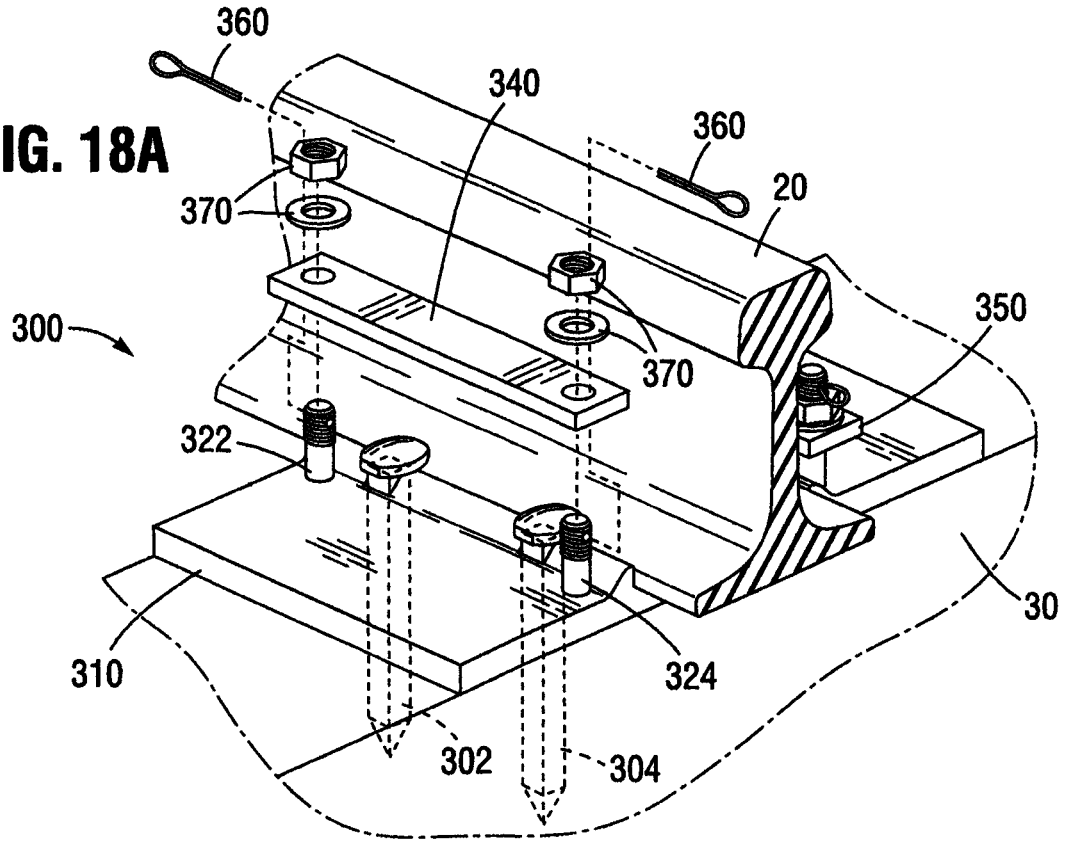
FIG. 18A is an upper perspective view of the tie plate of FIGS. 14-17 mounted between a rail and tie with a flat plate about to be attached to the upwardly facing threaded end vertical studs and nuts and washers used on the threaded ends with cotter pins.
Figure 18B:
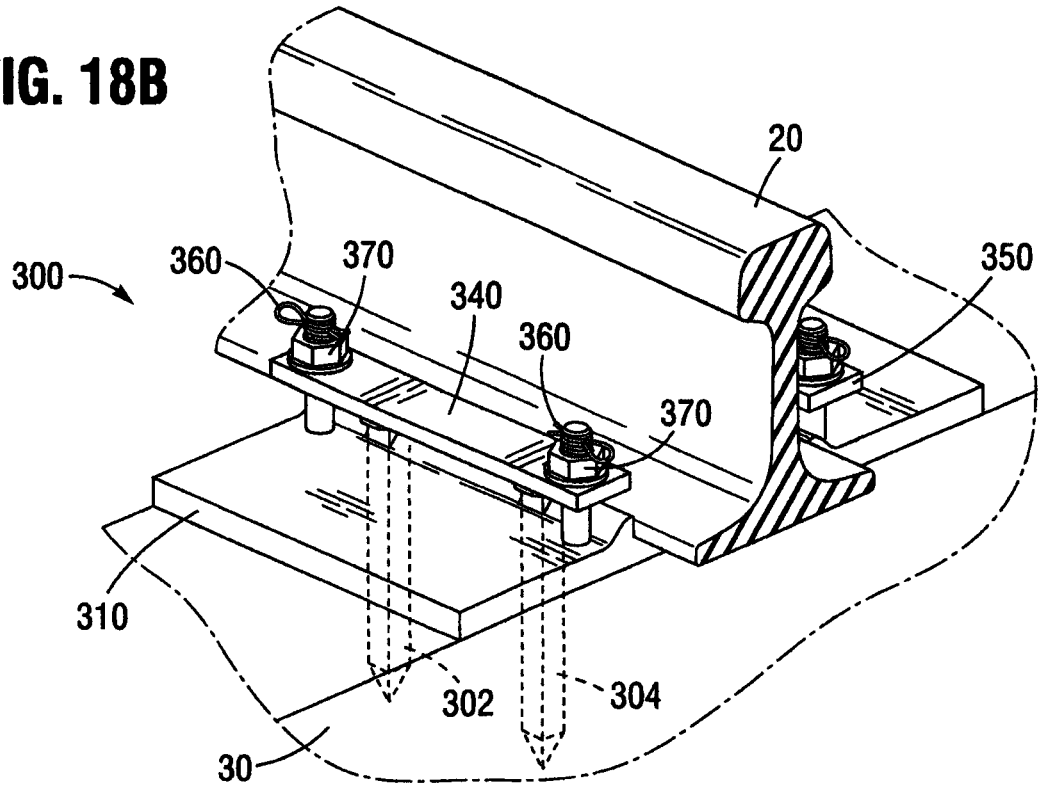
FIG. 18B is an upper perspective view of FIG. 18A with the flat plate attached to the threaded ends of the vertical studs with nuts washers over the top of the spikes and locked in place with cotter pins.

Spikes 302, 304 (shown in FIGS. 18A-18B are then driven into spike holes 313, 315 in the tie plate 210 and another pair of spikes (not shown) driven into another set of spike holes 317, 319.

Figure 14:
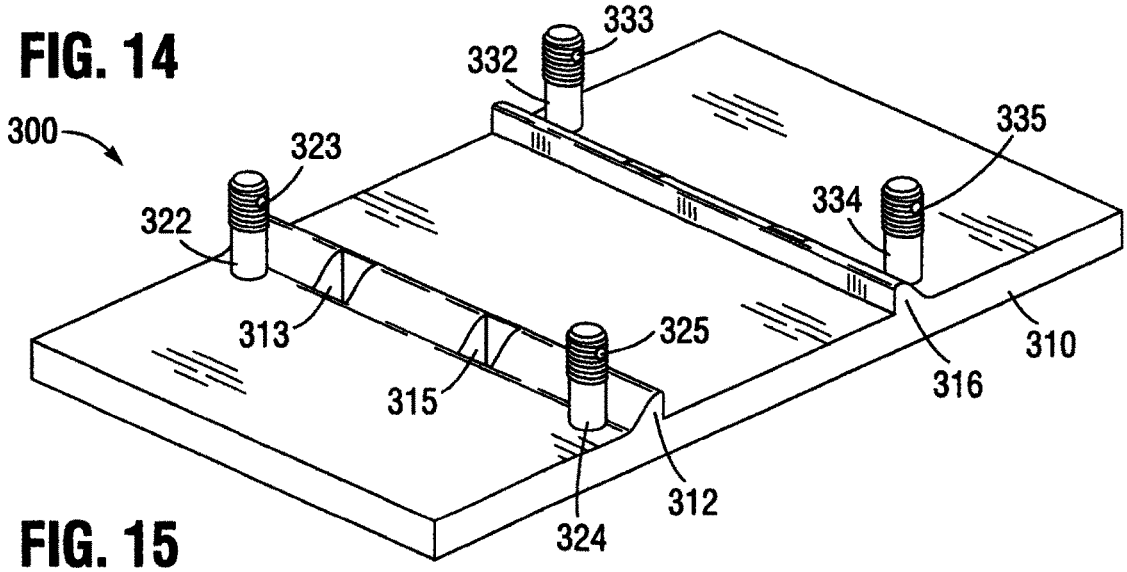
FIG. 14 is an upper perspective view of a third embodiment of a tie plate with upwardly facing vertical studs having threaded ends for flat plates to be attached to retain railroad spikes.

FIG. 14 is an upper perspective view of a third embodiment 300 of a tie plate with upwardly facing vertical studs 322, 324, 332, 334 having threaded ends for flat plates 340, 350 to be attached to retain railroad spikes.

Figure 15:
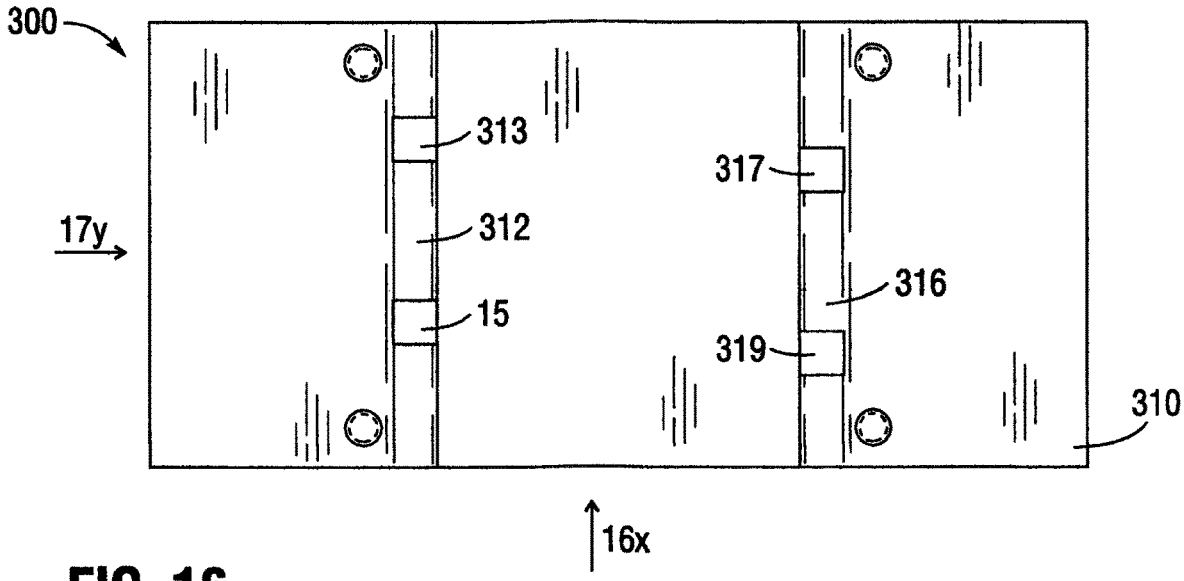
FIG. 15 is a top view of the tie plate with upwardly facing threaded end vertical studs of FIG. 14.
Figure 16:
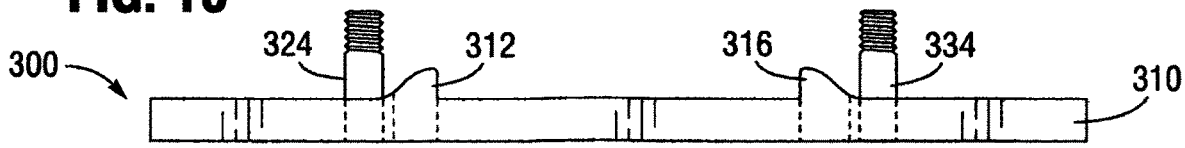
FIG. 16 is a side view of the tie plate with upwardly facing threaded end vertical studs of FIG. 15 along arrow 16X.
Figure 17:
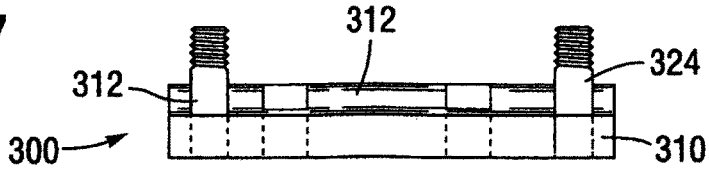
FIG. 17 is a front end view of the tie plate with upwardly facing threaded end vertical studs of FIG. 15 along arrow 17Y.

FIG. 15 is a top view of the tie plate 310 with upwardly facing threaded end vertical studs 322, 324, 332, 334 of FIG. 14. FIG. 16 is a side view of the tie plate 310 with upwardly facing threaded end vertical studs 322, 324, 332, 334 of FIG. 15 along arrow 16X. FIG. 17 is a front end view of the tie plate 310 with upwardly facing threaded end vertical studs 322, 324, 332, 334 of FIG. 15 along arrow 17Y.

Referring to FIGS. 14-17, a rail tie plate 310 can have a first spike hole 313, and second spike hole 315 running from a top side of the tie plate 310 through the first elongated ridge 312, through the bottom side of the tie plate 310. The tie plate 310 can include a third spike hole 317, and fourth spike hole 319 running from a top side of the tie plate 310 through the second elongated ridge 316, through the bottom side of the tie plate 310.

A first left stud with threaded end 322 can be welded through the tie plate 310 along a left side of the first elongated ridge 312, and a first right stud with threaded end 324 can be welded through the tie plate 310 along the right side of the first elongated ridge 312.

A second left stud with threaded end 332 can be welded through the tie plate 310 along the left side of the second elongated ridge 316, and a second right stud with threaded end 334 can be welded through the tie plate 310 along the right side of the second elongated ridge 316.

The vertical oriented studs with threaded ends 322, 324, 332, 334 can each have upper through-holes 323, 325, 333, 335 passing from one side of each threaded ends to an opposite side.

FIG. 18A is an upper perspective view of the tie plate 310 of FIGS. 14-17 mounted between a rail 20 and tie 30 with a flat plate about to be attached to the studs and nuts used on the threaded ends with cotter pins.

FIG. 18B is an upper perspective view of FIG. 18A with the flat plate attached to the threaded ends of the vertical studs with nuts and washers over the top of the spikes 302, 304 and locked in place with cotter pins 360.

As shown in FIG. 18B, a second flat plate 350 having ends with through holes 351, 357 can be similarly mounted in second left vertical stud with threaded end 332, and second right vertical stud with threaded end 334 and locked in place with nuts & washers 370 and additional cotter pins 360 to be used to retain another set of spikes (not shown) in place.

Fourth Embodiment

Figure 19A:
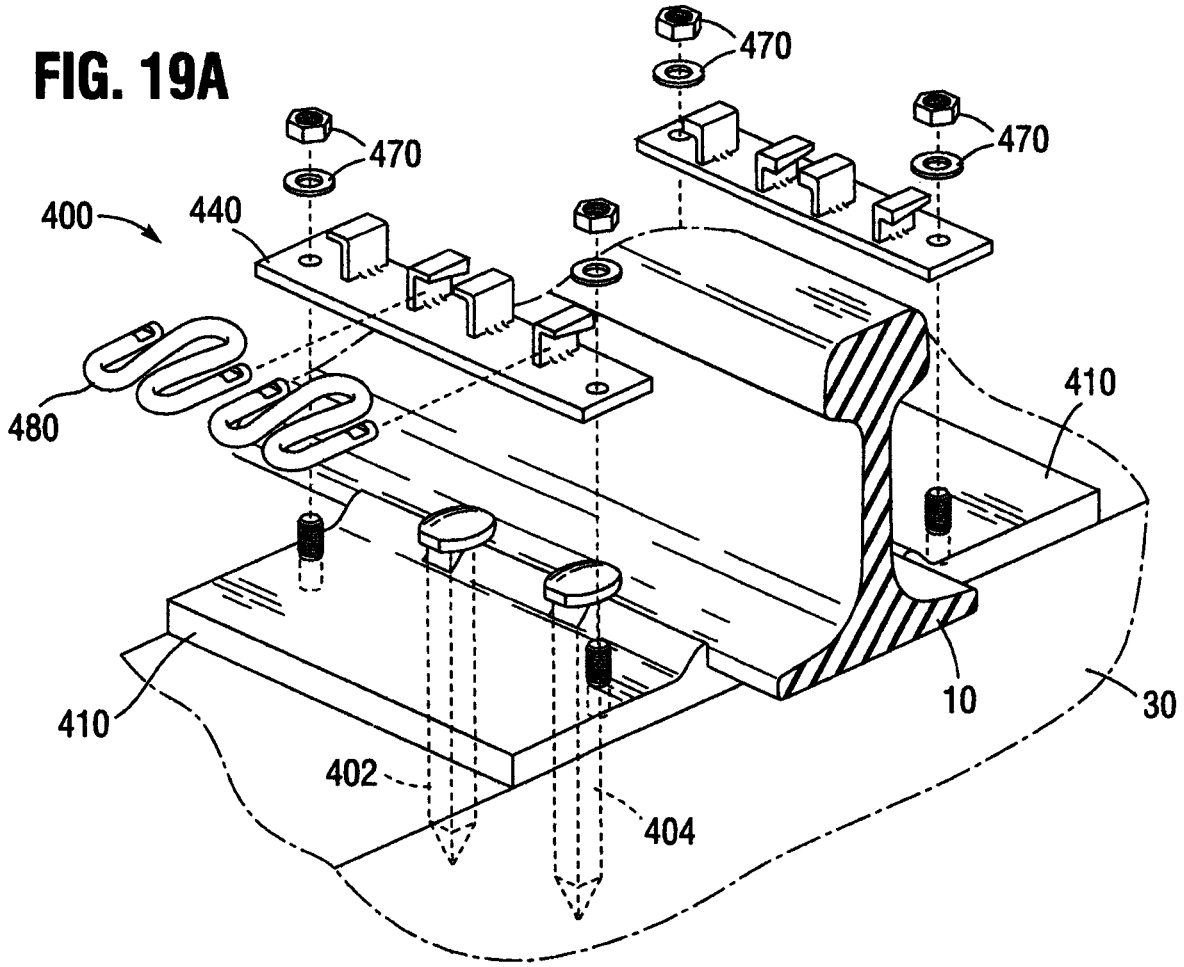
FIG. 19A is an upper perspective view of another unassembled spring clip tie plate with w spring clip(s) about to be attached in a fourth embodiment.

FIG. 19A is an upper perspective view of another unassembled spring clip tie plate 410 with w spring clip(s) 480 about to be attached in a fourth embodiment 400

Figure 19B:
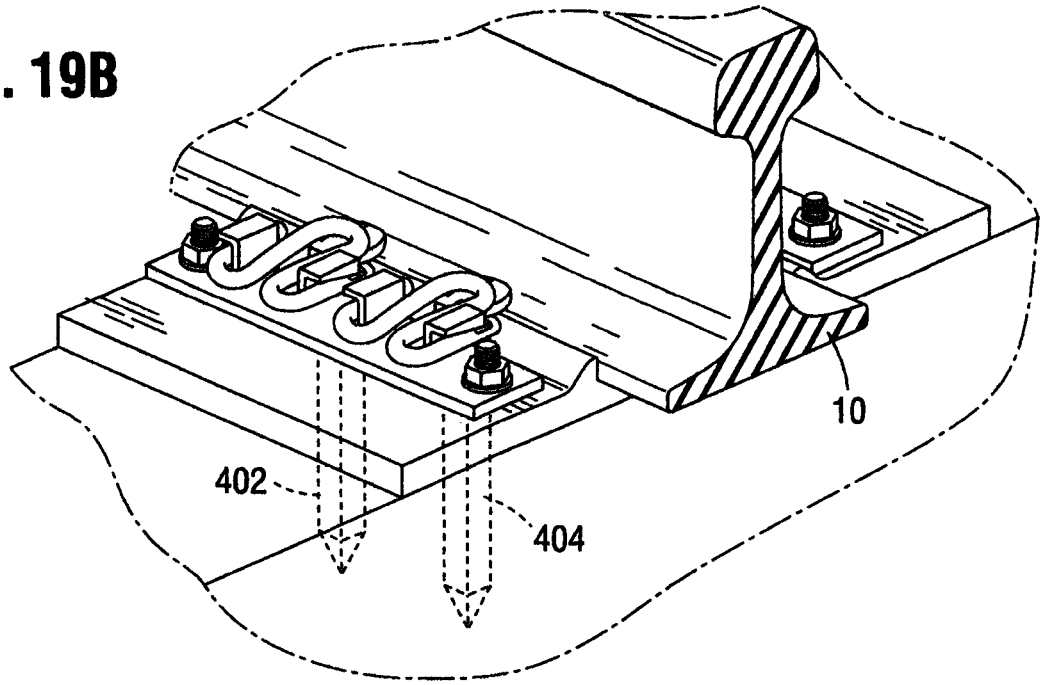
FIG. 19B is an upper perspective view of FIG. 19A with the w spring clip(s) assembled with the spring clip tie plate retaining the spikes.

FIG. 19B is an upper perspective view of FIG. 19A with the w spring clip(s) 480 assembled with the spring clip tie plate 410 retaining the spikes 402, 404.

Figure 20:
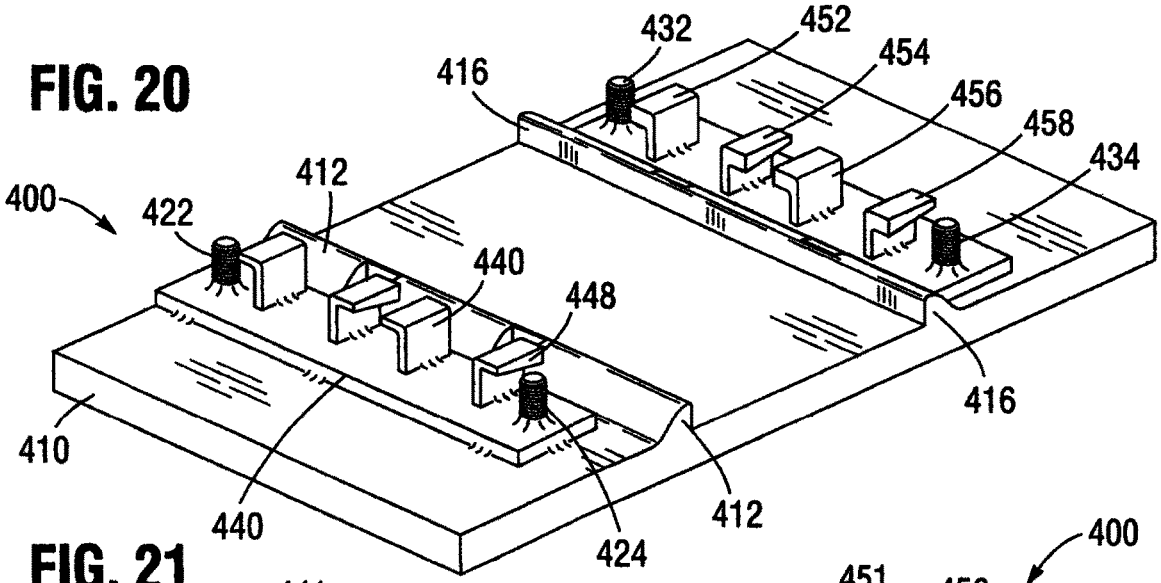
FIG. 20 is an upper perspective view of a fourth embodiment of the assembled spring clip tie plate of FIG. 19B.
Figure 21:
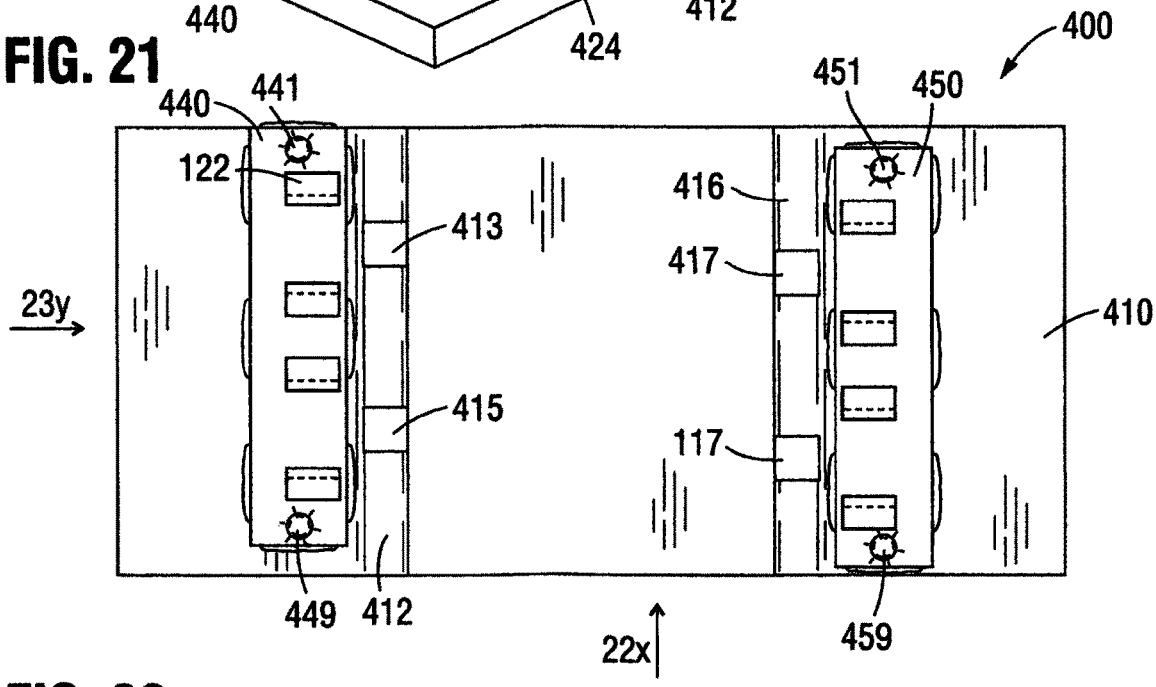
FIG. 21 is a top view of the assembled spring clip tie plate of FIG. 20.
Figure 22:
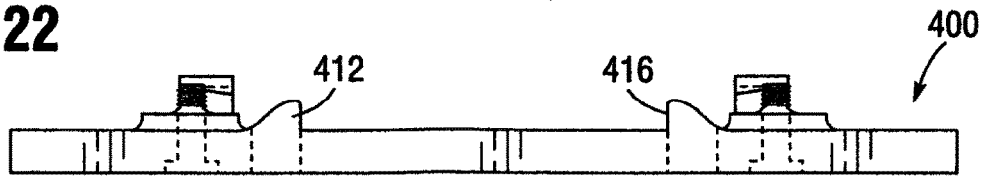
FIG. 22 is a side view of the assembled spring clip tie plate of FIG. 21 along arrow 22X.
Figure 23:
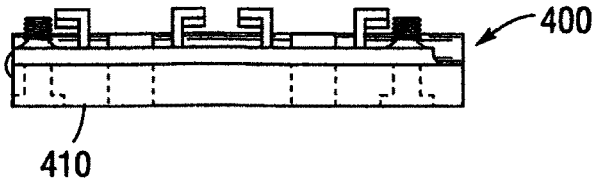
FIG. 23 is a front end view of the assembled spring clip tie plate of FIG. 21 along arrow 23Y.

FIG. 20 is an upper perspective view of a fourth embodiment 400 of the assembled spring clip tie plate 410 of FIG. 19B. FIG. 21 is a top view of the assembled spring clip tie plate 410 of FIG. 20. FIG. 22 is a side view of the assembled spring clip tie plate 410 of FIG. 21 along arrow 22X. FIG. 23 is a front end view of the assembled spring clip tie plate 410 of FIG. 21 along arrow 23Y.

Figure 24A:
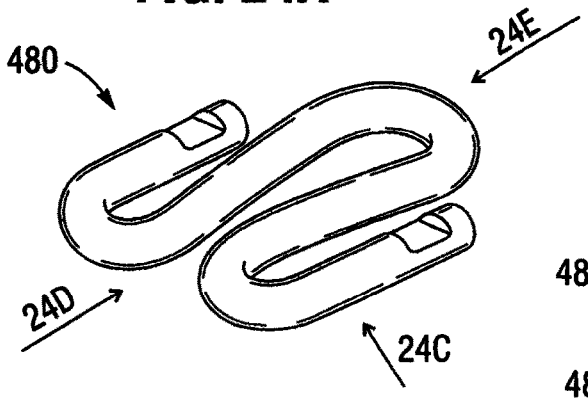
FIG. 24A is an upper perspective view of a w spring clip used in FIGS. 19A-19B.
Figure 24B:
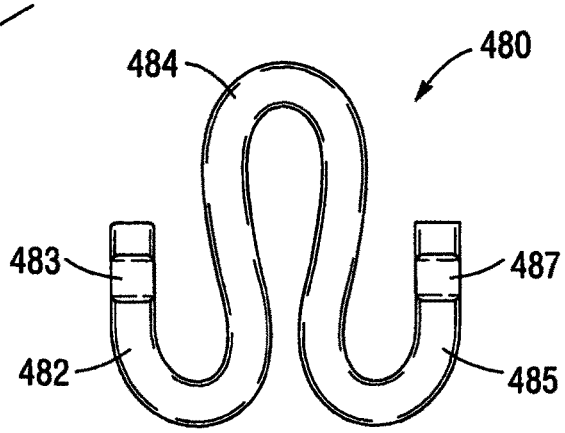
FIG. 24B is a top view of the w spring clip of FIG. 24A.
Figure 24C:
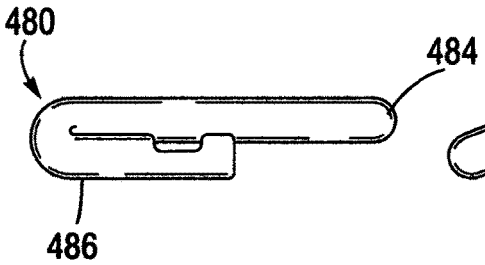
FIG. 24C is a side view of the w spring clip of FIG. 24A along arrow 24C.
Figure 24D:
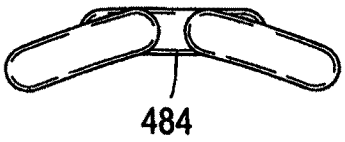
FIG. 24D is a front view of the w spring clip of FIG. 24A along arrow 24D.
Figure 24E:
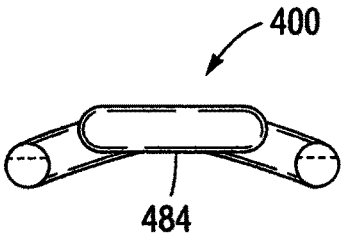
FIG. 24E is a rear view of the w spring clip of FIG. 24A along arrow 24E.

FIG. 24A is an upper perspective view of a w spring clip 480 used in FIGS. 19A-19B. FIG. 24B is a top view of the w spring clip 480 of FIG. 24A. FIG. 24C is a side view of the w spring clip of FIG. 24A along arrow 24C. FIG. 24D is a front view of the w spring clip 480 of FIG. 24A along arrow 24D. FIG. 24E is a rear view of the w spring clip 480 of FIG. 24A along arrow 24E.

The w spring clip 480 can be similar to the spring clip used and described in U.S. Pat. No. 5,520,330 to Brown et al., which is incorporated by reference in its' entirety.

Referring to FIGS. 24A-24E, the w spring clip 480 can include a first leg 482 with groove/notch 483, and a bent midportion 484, and second leg 486 with groove/notch 487.

Referring to FIGS. 19A-24E, the fourth embodiment 400 can include a tie plate 410 having a first elongated ridge 412 parallel to a second elongated ridge 416 that is used to orient the rail 10 therebetween.

The tie plate 410 includes a first set of spike holes 413, 415 for allowing spikes 402, 404 to pass through adjacent to the first raised ridge 412 and a second set of spike holes spikes 417, 419 adjacent a second raised ridge 416 for allowing a second set of spikes (not shown) to pass through. The spikes are used to attach the tie plate to a railroad tie 30.

The tie plate 410 includes a first pair of upwardly extending studs 422, 424 with threaded ends fixed to the tie plate 410 adjacent to the first raised ridge 412, and a second pair of upwardly extending studs 432, 434 with threaded ends fixed to the tie plate 41—adjacent to the second raised ridge 416.

A first horizontal metal plate 440 can include upwardly facing first inverted L shaped brackets 442, 444, 446, 448, and through-holes 441, 449 for allowing the threaded ends of the first studs 422, 424 to pass therethrough, with fasteners 470 for attaching the first horizontal plate 440 to the threaded ends of the first studs 422, 424. The fasteners 470 can include nuts with or without washers.

The first inverted L shaped brackets, 442, 444, 446, 448 can be welded to an upper surface of the first horizontal plate 440 or forged thereon.

The tie plate 410 can include a second horizontal metal plate 450 with upwardly facing first inverted L shaped brackets 452, 454, 456, 458, and through-holes 451, 459 for allowing the threaded ends of a second set of studs 432, 434 to pass therethrough, with fasteners 470 for attaching the second horizontal plate 450 to the threaded ends of the second studs 432, 434. The fasteners 470 can include nuts with or without washers.

Similarly, the second inverted L shaped brackets, 452, 454, 456, 458 can be welded to an upper surface of the second horizontal plate 450 or forged thereon.

A pair of w shaped spring clips 480 can inserted into the first inverted L-shaped brackets 442, 444, 446, 448 with mid portions 484 of the w shaped spring clips 480 pushed over tops of the first set of spikes 402, 404 to retain the first set of spikes 402, 404 from coming out of the tie plate 410.

Similarly, another pair of pair of w shaped spring clips 480 can inserted into the second inverted L-shaped brackets 452, 454, 456, 458 with mid portions 484 of the w shaped spring clips 480 pushed over tops of another pair of spikes (not shown) to retain another pair of spikes from coming out of the tie plate 410.

Referring to FIGS. 19A-19B, 20 and 21, the horizontal plates 440, 450 can further be welded about perimeter edges to tie plate 410. Fasteners 470 can further be welded to the studs 422, 424, 432, 434.

Referring to FIGS. 19A, 19B, and 24B, the overhanging angled lip edges on inverted L-shaped brackets 442, 444, 446, 448, 452, 454, 456, 458 can fit into and engage with the grooves (notches) 483, 487 on legs 482, 486 of the spring clip(s) 480, locking the spring clip(s) 480 in place.

Figure 19C:
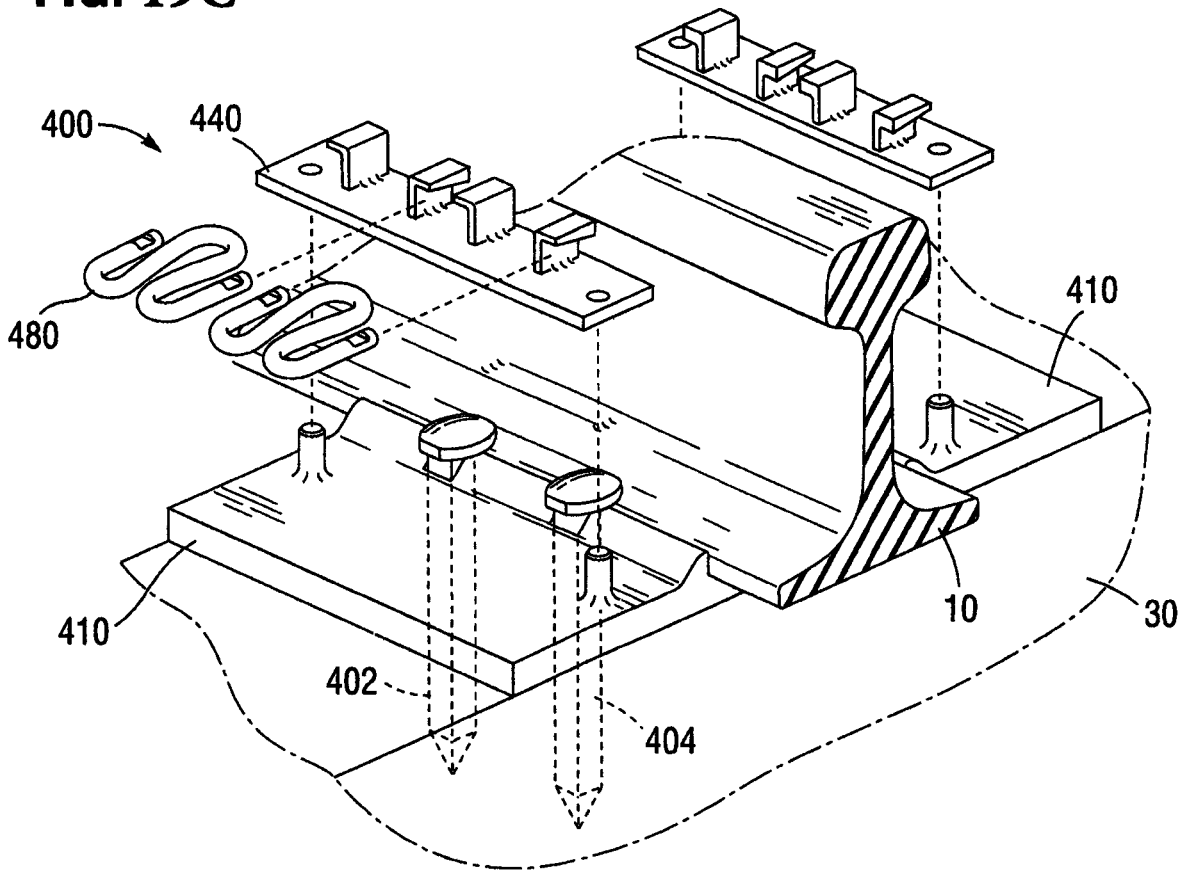
FIG. 19C is an upper perspective view of an alternative unassembled spring clip tie plate with w spring clip(s) about to be attached in a fourth embodiment in FIG. 19A.

FIG. 19C is an upper perspective view of an alternative unassembled spring clip tie plate with w spring clip(s) 480 about to be attached in a fourth embodiment in FIG. 19A.

Figure 19D:
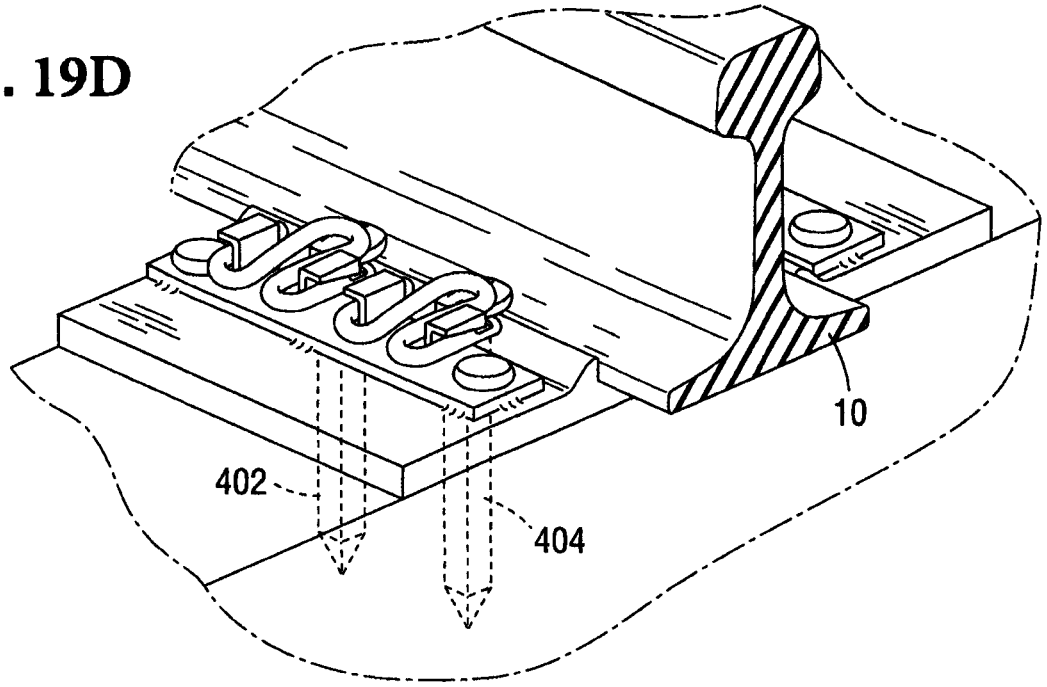
FIG. 19D is an upper perspective view of FIG. 19C with the w spring clip(s) assembled with the spring clip tie plate retaining the spikes.

FIG. 19D is an upper perspective view of FIG. 19C with the w spring clip(s) 480 assembled with the spring clip tie plate retaining the spikes.

Referring to FIGS. 19C-19D, upwardly protruding studs/rods 422, 424 without threaded ends can be used where the top of the studs/rods are heated and a hydraulic press, and the like, compresses the upper ends forming a head attaching a horizontal plate 440 to the tie plate 410. Alternatively, the upper ends of the studs 422, 424 can be welded or forged to the horizontal plate 440, and perimeter edges of horizontal plate 440 can be welded or forged to tie plate 410.

Fifth Embodiment

Figure 25A:
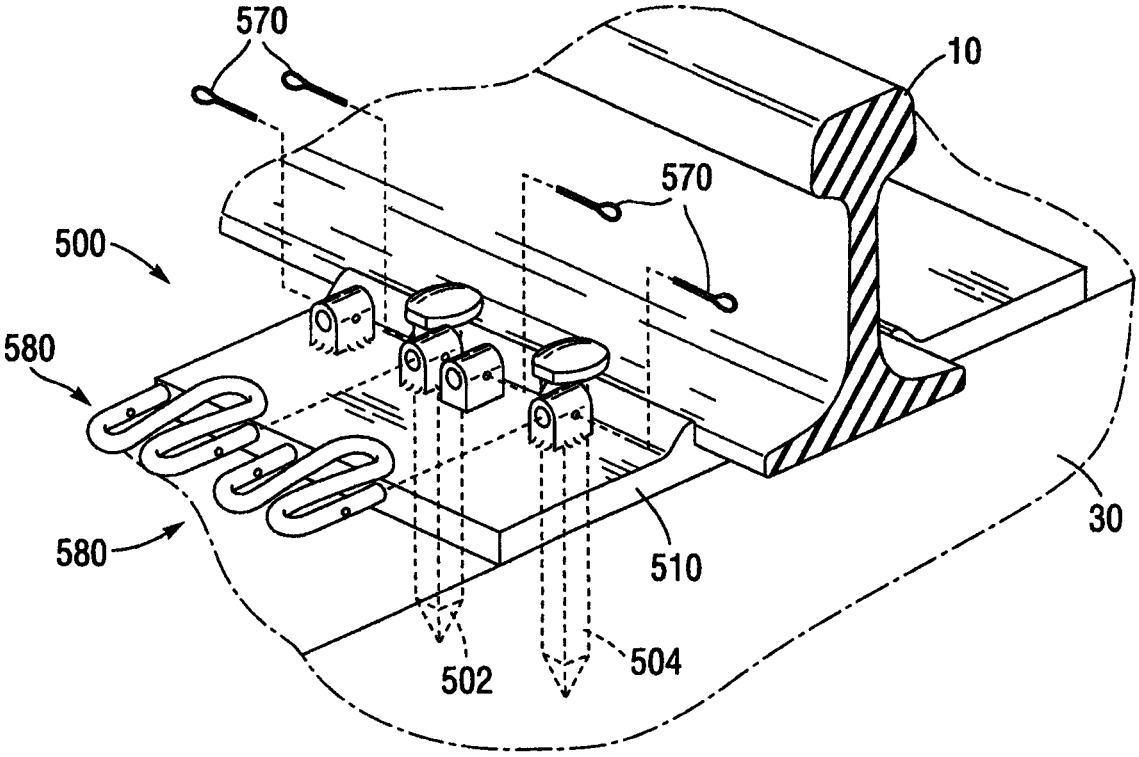
FIG. 25A is an upper perspective view of another spring clip tie plate with w spring clip(s) about to be attached in a fifth embodiment.

FIG. 25A is an upper perspective view of another spring clip tie plate 520 with w spring clip(s) 580 about to be attached in a fifth embodiment 500.

Figure 25B:
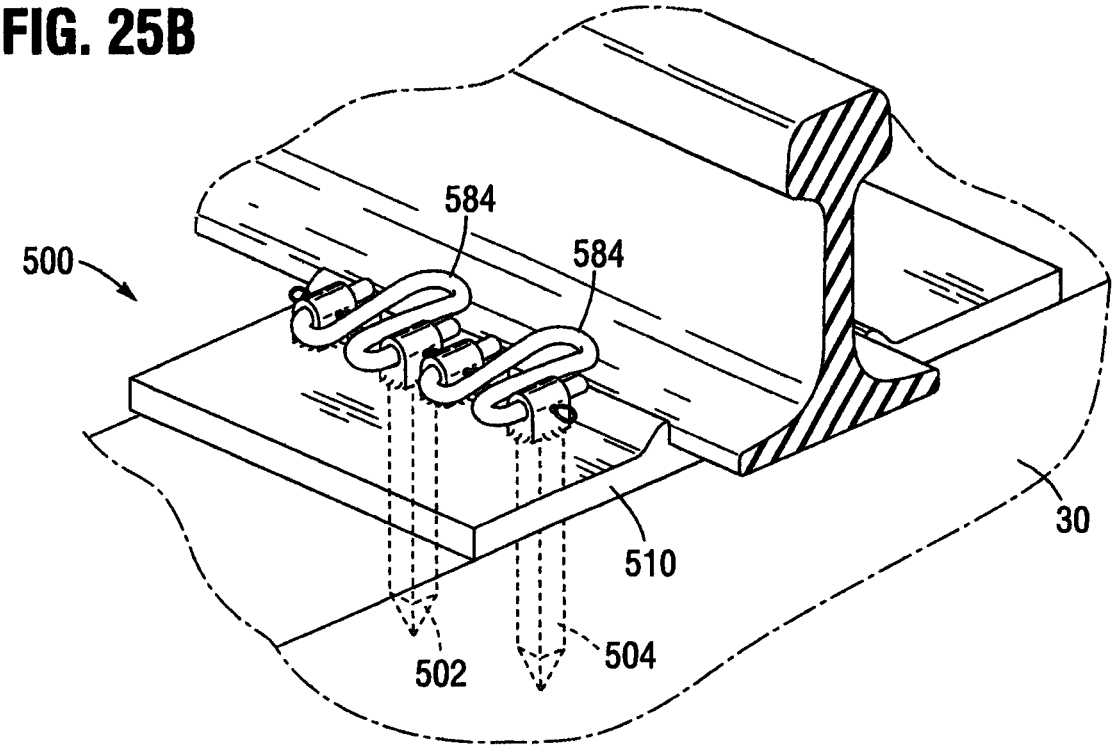
FIG. 25B is an upper perspective view of FIG. 25A with the w spring clip(s) assembled with the spring clip tie plate retaining the spikes.

FIG. 25B is an upper perspective view of FIG. 25A with the w spring clip(s) 580 assembled with the spring clip tie plate 510 retaining the spikes 502, 504.

Figure 26:
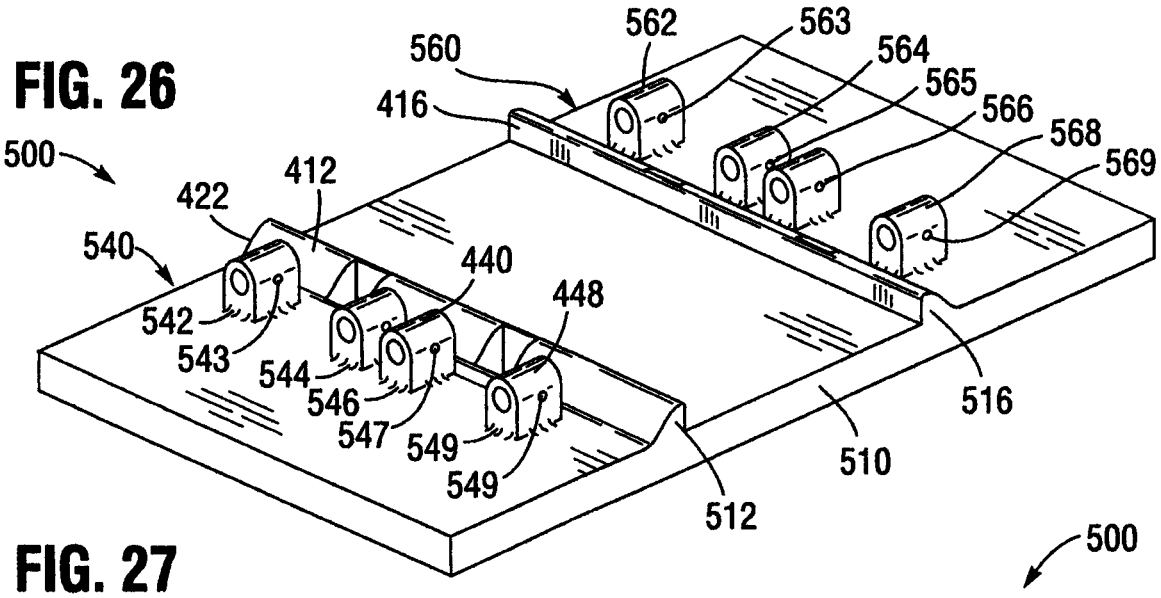
FIG. 26 is an upper perspective view of a fifth embodiment of the spring clip tie plate of FIG. 25B.
Figure 27:
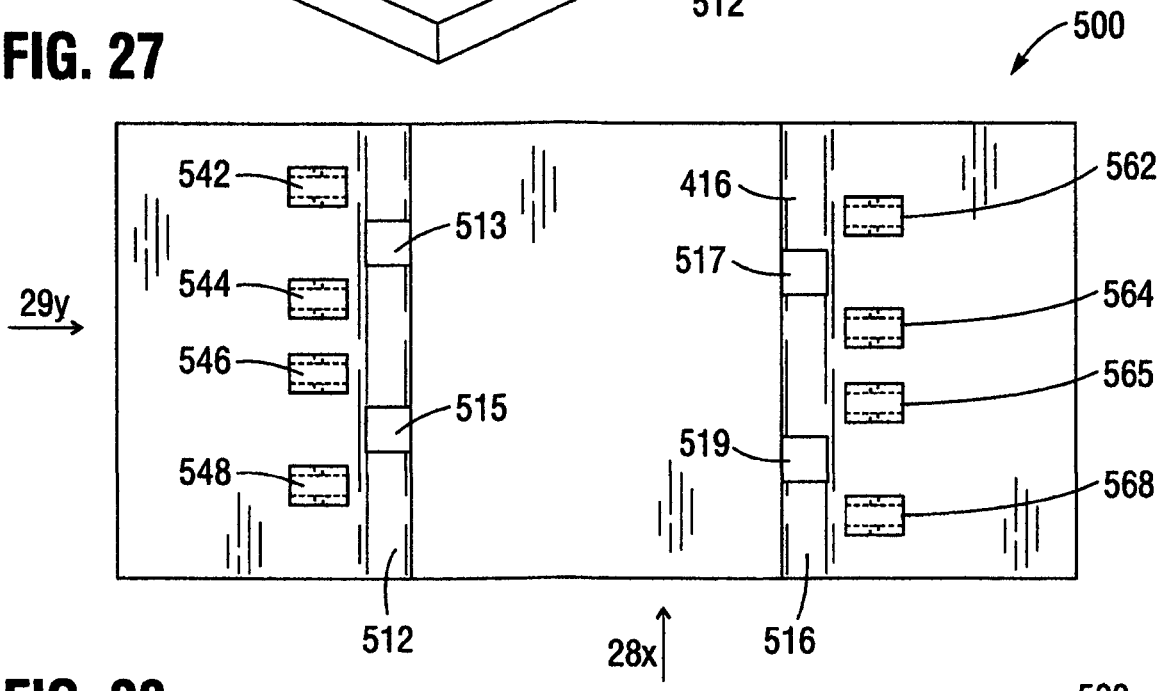
FIG. 27 is a top view of the spring clip tie plate of FIG. 26.
Figure 28:
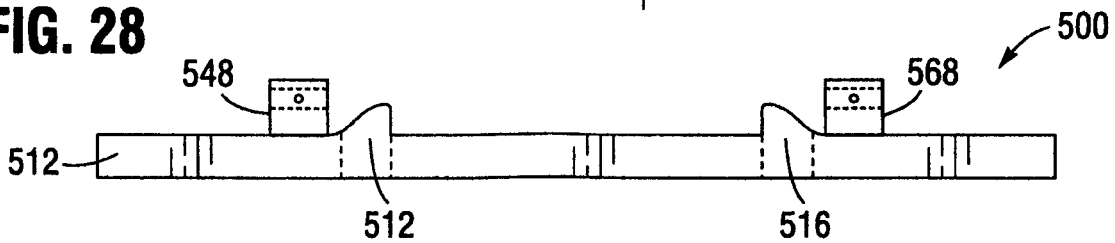
FIG. 28 is a side view of the spring clip tie plate of FIG. 27 along arrow 28X.
Figure 29:
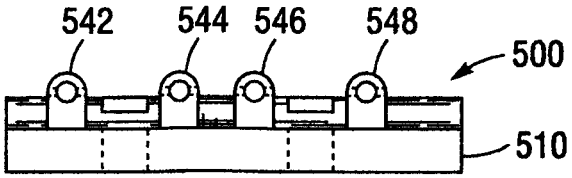
FIG. 29 is a front end view of the spring clip tie plate of FIG. 27 along arrow 29Y.

FIG. 26 is an upper perspective view of a fifth embodiment 500 of the spring clip tie plate 510 of FIG. 25B. FIG. 27 is a top view of the spring clip tie plate 510 of FIG. 26. FIG. 28 is a side view of the spring clip tie plate 520 of FIG. 27 along arrow 28X. FIG. 29 is a front end view of the spring clip tie plate 510 of FIG. 27 along arrow 29Y.

Figure 30A:
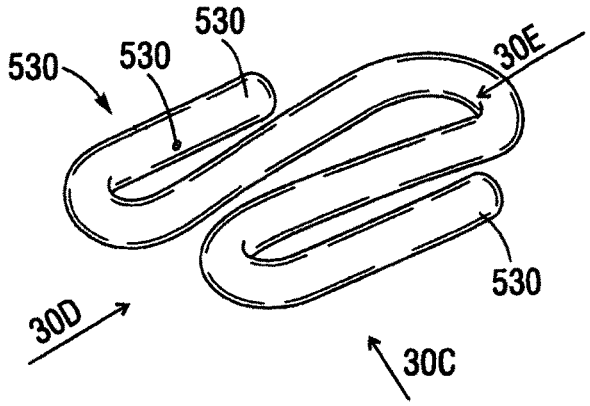
FIG. 30A is an upper perspective view of a w spring clip used in FIGS. 25A-25B.
Figure 30B:
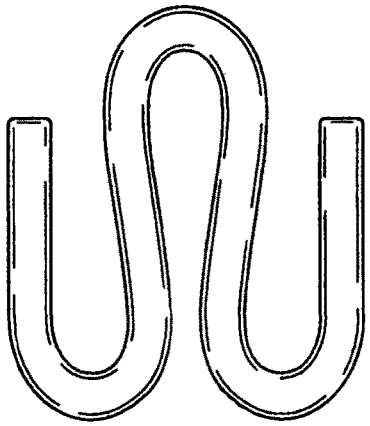
FIG. 30B is a top view of the w spring clip of FIG. 30A.
Figure 30C:
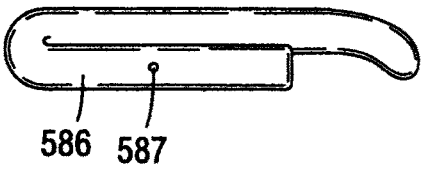
FIG. 30C is a side view of the w spring clip of FIG. 30A along arrow 30C.
Figure 30D:
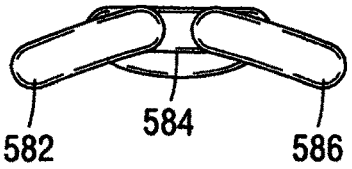
FIG. 30D is a front view of the w spring clip of FIG. 30A along arrow 30D.
Figure 30E:
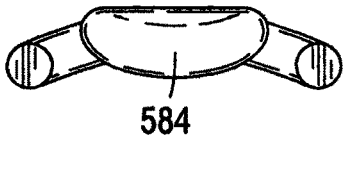
FIG. 30E is a rear view of the w spring clip of FIG. 30A along arrow 30E.

FIG. 30A is an upper perspective view of a w spring clip 580 used in FIGS. 25A-25B. FIG. 30B is a top view of the w spring clip 580 of FIG. 30A. FIG. 30C is a side view of the w spring clip 580 of FIG. 30A along arrow 30C. FIG. 30D is a front view of the w spring clip 580 of FIG. 30A along arrow 30D. FIG. 30E is a rear view of the w spring clip 580 of FIG. 30A along arrow 30E.

Referring to FIGS. 25A-30E, the fifth embodiment 500 can include a metal tie plate 510, with a first elongated ridge 512 running parallel to a second elongated ridge 516. A first spike hole 513 and a second spike hole 515 pass through the first elongated ridge 512, and a third spike hole 517 and fourth spike hole 519 pass through the second elongated ridge 516.

A plurality of spaced apart left metal structures 540 can be fixed to the tie plate 510 adjacent to the first elongated ridge 512. The plurality of left metal structures 540 can be welded and/or forged to the metal tie plate 510.

In this preferred embodiment, the plurality of spaced apart left metal structures 540 can include a first left metal structure 542 with side through-hole 543, second left metal structure 544 with side through-hole 545, third left metal structure 546 with side through-hole 547, and fourth left metal structure 548 with side through-hole 549. Each of the left metal structures 540 having horizontal channel openings substantially parallel with each other. The horizontal channel openings of each of the plurality of spaced apart left metal structures 540 having longitudinal axes, substantially perpendicular to the first elongated ridge 512.

The w shaped spring clip 580 can include a first leg 582, with side through-hole 583, a bent mid portion 584, and a second leg 586 with side through-hole 587.

The installer can insert the legs 582, 586 of one spring clip 580 into the horizontal channel openings of a pair of metal structures 542, 544. Another spring clip 580 can have its' legs 582, 586 into the horizontal channel openings of a second pair of metal structures 546, 548.

The spring clips 580 can be locked to respective metal structures 542, 544 by one of the cotter pins 570 passing through a side through-hole 543 in a first left metal structure 542 and through a side through-hole 583 in the first leg 528 of the spring clip 580. Another one of the cotter pins 570 can be passed through a side through-hole 545 in a second left metal structure 544 and through a side through-hole 587 in a second leg 586 of the spring clip 580. Another spring clip 580 can be locked to a second pair of metal structures 546 and 548 with another one of the cotter pins 570 passing through adjacent through-holes 547 583 and adjacent through-holes 549, 587.

A plurality of spaced apart right metal structures 560 can be fixed to the tie plate 510 adjacent to the second elongated ridge 516. The plurality of right metal structures 560 can be welded and/or forged to the metal tie plate 510.

In this preferred embodiment, the plurality of spaced apart right metal structures 560 can include a first right metal structure 562 with side through-hole 563, second right metal structure 564 with side through-hole 565, third right metal structure 566 with side through-hole 567, and fourth left metal structure 568 with side through-hole 569. Each of the right metal structures 560 having horizontal channel openings substantially parallel with each other. The horizontal channel openings of each of the plurality of spaced apart right metal structures 560 having longitudinal axes substantially perpendicular to the second elongated ridge 516. Each of the plurality of right metal structures 560 can include a first right metal structure 562 with side through-hole 563, second right metal structure 564 with side through-hole 565, third right metal structure 566 with side through-hole 567 and fourth right metal structure 568 with side through-hole 569.

Another set of spring clips 580 can be locked into the horizontal channel openings of the plurality of right metal structures 560 with additional cotter pins 570 in a similar manner to the cotter pins 570 used with the left plurality of metal structures 540.

The bent midportions 584 of each spring clip 580 is pushed over a portion of each head of the spikes 502, 504 retaining the spikes 502, 504 in place.

The bent midportions 584 of each spring clip 580 is pushed over a portion of each head of the spikes 502, 504 retaining the spikes 502, 504 in place. FIG. 25B shows the bent midportion 584 of the spring clip 580 pushed over the heads of the spikes 502, 504.

Sixth Embodiment

Figure 31A:
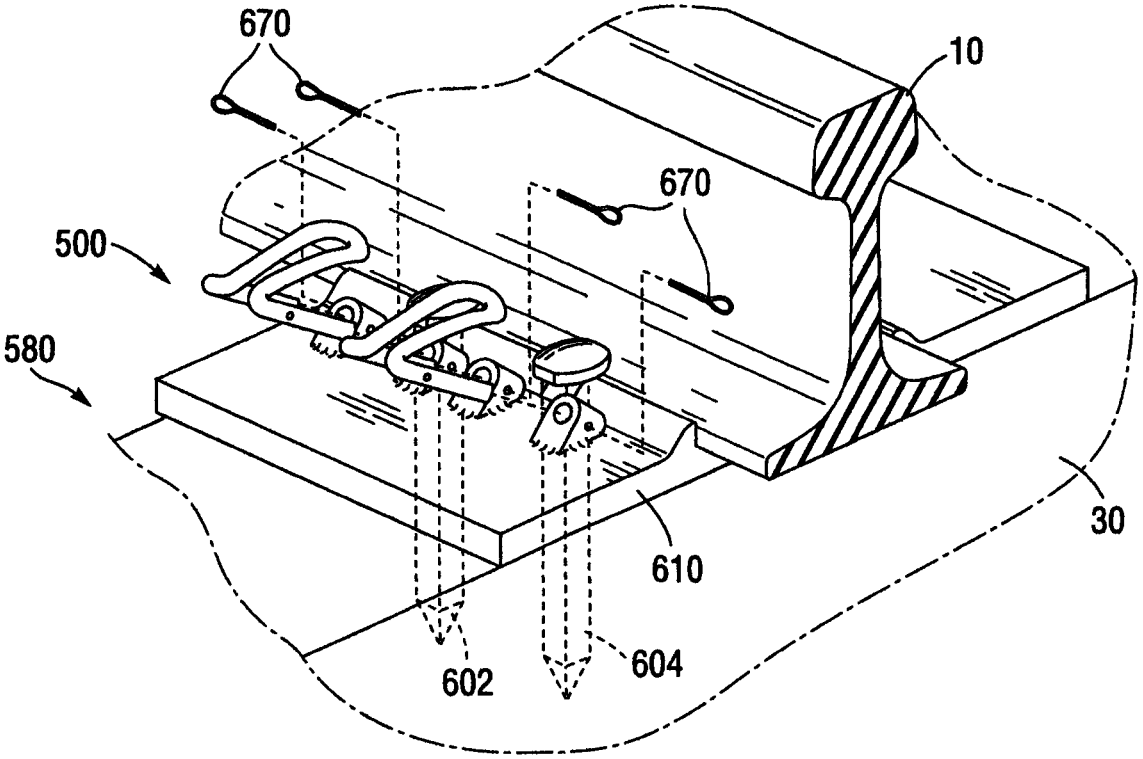
FIG. 31A is an upper perspective view of another spring clip tie plate with w spring clip(s) about to be attached in a sixth embodiment.
Figure 31B:
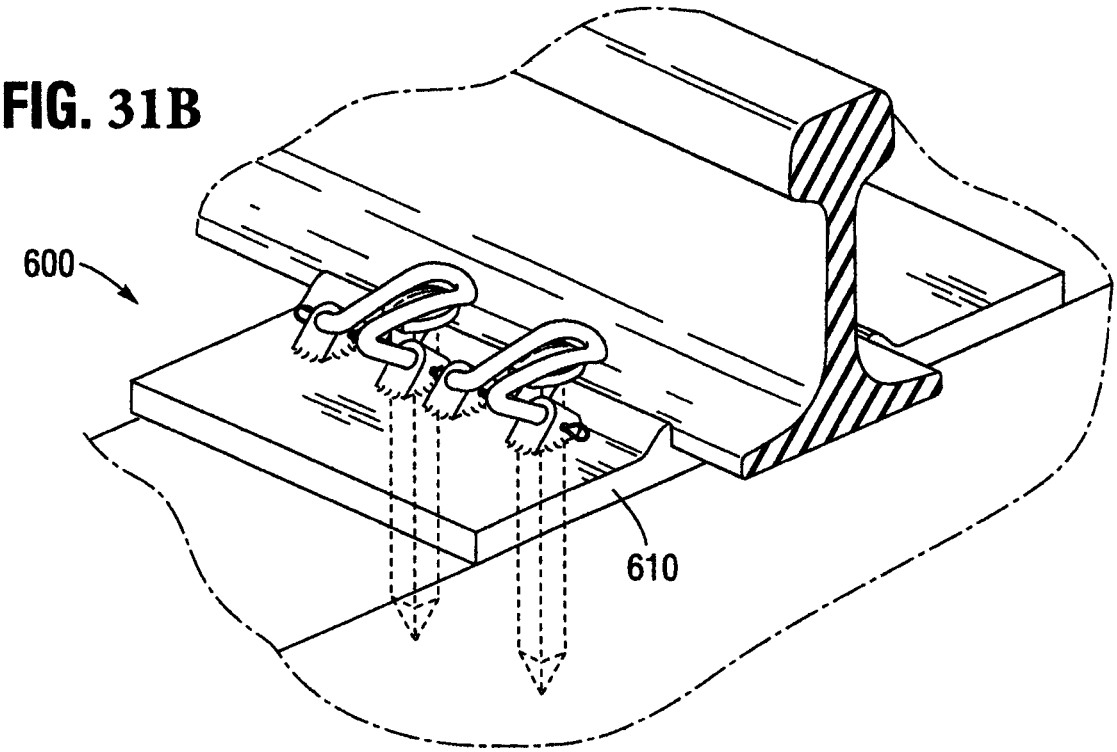
FIG. 31B is an upper perspective view of FIG. 31A with the w spring clip(s) assembled with the spring clip tie plate retaining the spikes.
Figure 32:
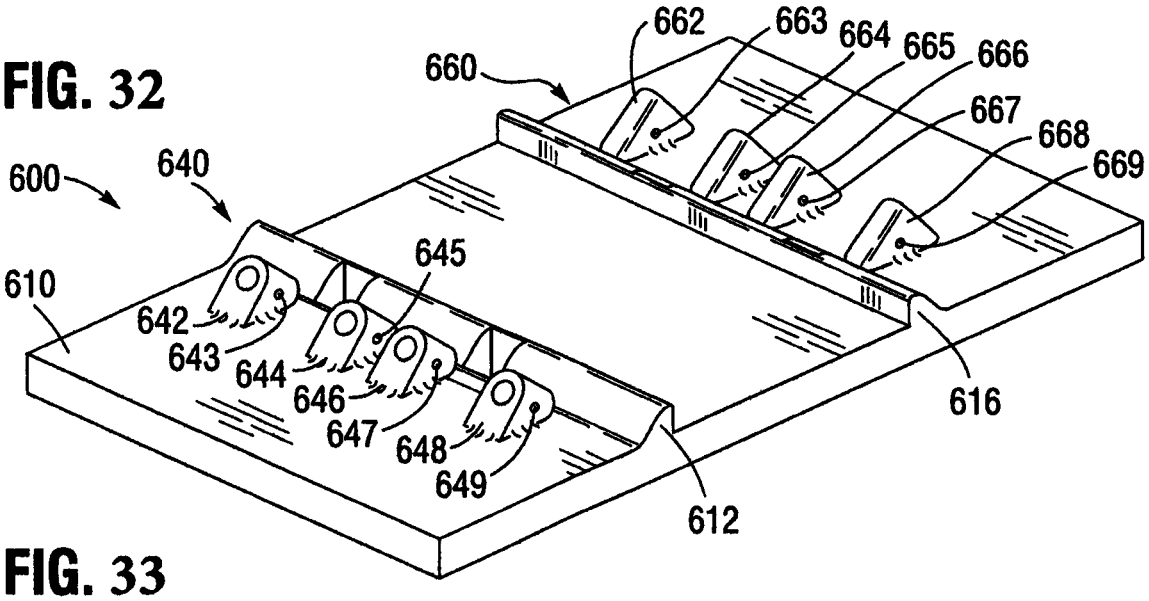
FIG. 32 is an upper perspective view of a sixth embodiment of the spring clip tie plate of FIG. 31B.

FIG. 31A is an upper perspective view of another spring clip tie plate 620 with w spring clip(s) 680 about to be attached in a sixth embodiment 600. FIG. 31B is an upper perspective view of FIG. 31A with the w spring clip(s) 680 assembled with the spring clip tie plate 610 retaining the spikes 602, 604. FIG. 32 is an upper perspective view of a sixth embodiment 600 of the spring clip tie plate 610 of FIG. 31B.

Figure 33:
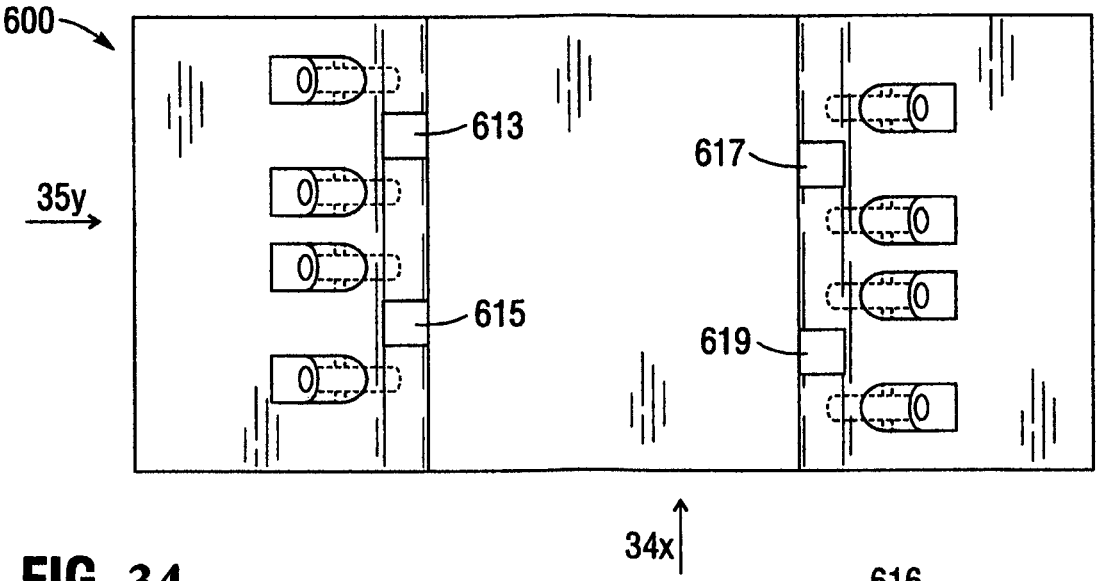
FIG. 33 is a top view of the spring clip tie plate of FIG. 32.
Figure 34:
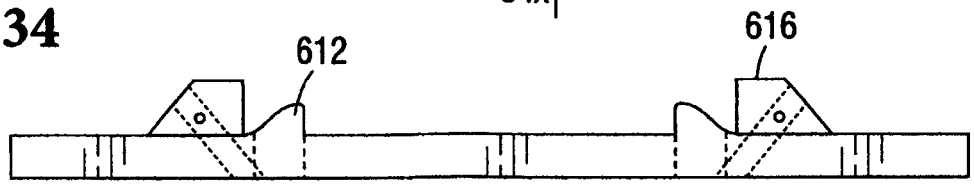
FIG. 34 is a side view of the spring clip tie plate of FIG. 33 along arrow 34X.
Figure 35:
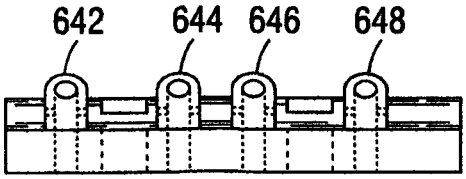
FIG. 35 is a front end view of the spring clip tie plate of FIG. 33 along arrow 35Y.

FIG. 33 is a top view of the spring clip tie plate 610 of FIG. 32. FIG. 34 is a side view of the spring clip tie plate 610 of FIG. 33 along arrow 34X. FIG. 35 is a front end view of the spring clip tie plate 610 of FIG. 33 along arrow 35Y.

Figure 36A:
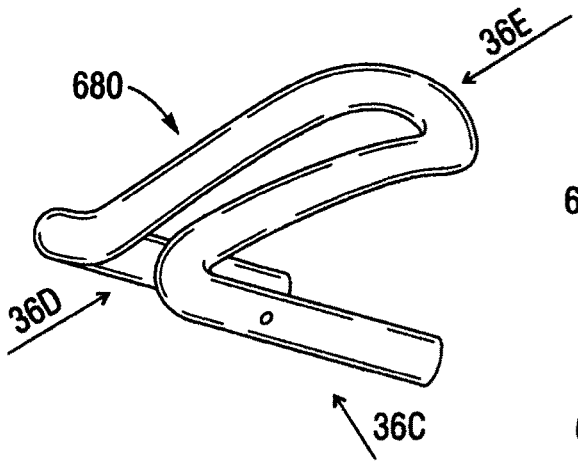
FIG. 36A is an upper perspective view of a w spring clip used in FIGS. 31A-31B.
Figure 36B:
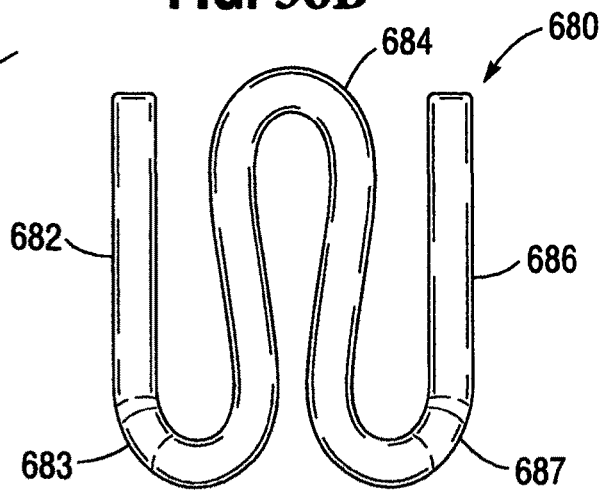
FIG. 36B is a top view of the w spring clip of FIG. 36A.
Figure 36C:
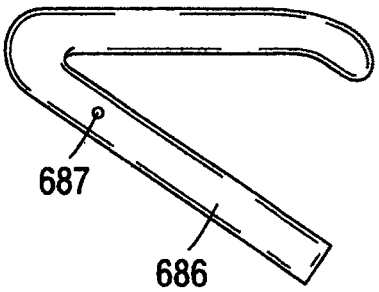
FIG. 36C is a side view of the w spring clip of FIG. 36A along arrow 36C.
Figure 36D:
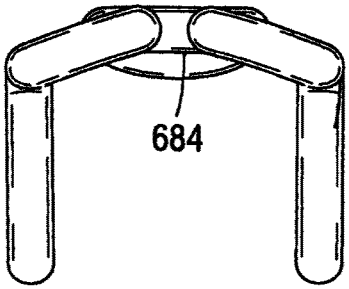
FIG. 36D is a front view of the w spring clip of FIG. 36A along arrow 36D.
Figure 36E:
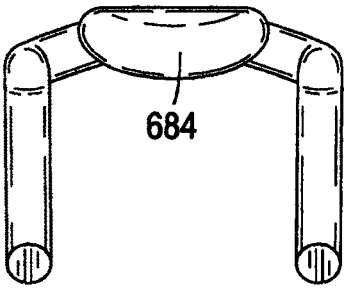
FIG. 36E is a rear view of the w spring clip of FIG. 36A along arrow 36E.

FIG. 36A is an upper perspective view of a w spring clip 680 used in FIGS. 31A-31B. FIG. 36B is a top view of the w spring clip 680 of FIG. 36A. FIG. 36C is a side view of the w spring clip 680 of FIG. 36A along arrow 36C. FIG. 36D is a front view of the w spring clip 680 of FIG. 36A along arrow 36D. FIG. 36E is a rear view of the w spring clip 680 of FIG. 36A along arrow 36E.

Referring to FIGS. 31A-36E, the sixth embodiment 600 can include a metal tie plate 610, with a first elongated ridge 612 running parallel to a second elongated ridge 616. A first spike hole 613 and a second spike hole 615 pass through the first elongated ridge 612, and a third spike hole 617 and fourth spike hole 619 pass through the second elongated ridge 616.

A plurality of spaced apart left metal structures 640 can be fixed to the tie plate 610 adjacent to the first elongated ridge 612. The plurality of left metal structures 640 can be welded and/or forged to the metal tie plate 610.

In this preferred embodiment, the plurality of spaced apart left metal structures 640 can include a first left metal structure 642 with side through-hole 643, second left metal structure 644 with side through-hole 645, third left metal structure 646 with side through-hole 647, and fourth left metal structure 648 with side through-hole 649. Each of the left metal structures 640 having angled channel openings substantially parallel with each other. The angle channel openings of each of the plurality of spaced apart left metal structures 640 having longitudinal axes substantially perpendicular to the first elongated ridge 612.

The w shaped spring clip 680 can include a first leg 682, with side through-hole 683, a bent mid portion 684, and a second leg 686 with side through-hole 687.

The installer can insert the legs 682, 686 of one spring clip 680 into the angled channel openings of a pair of metal structures 642, 644. Another spring clip 680 can have its' legs 682, 686 into the angled channel openings of a second pair of metal structures 646, 648.

The spring clips 680 can be locked to respective metal structures 642, 644 by one of the cotter pins 670 passing through a side through-hole 543 in a first left metal structure 542 and through a side through-hole 583 in the first leg 528 of the spring clip 580. Another one of the cotter pins 570 can be passed through a side through-hole 645 in a second left metal structure 644 and through a side through-hole 687 in a second leg 686 of the spring clip 680. Another spring clip 680 can be locked to a second pair of metal structures 646 and 648 with another pair of cotter pins 570 passing through adjacent through-holes 647 683 and adjacent through-holes 649, 687.

A plurality of spaced apart right metal structures 660 can be fixed to the tie plate 610 adjacent to the second elongated ridge 616. The plurality of right metal structures 660 can be welded and/or forged to the metal tie plate 610.

In this preferred embodiment, the plurality of spaced apart right metal structures 660 can include a first right metal structure 662 with side through-hole 663, second right metal structure 664 with side through-hole 665, third right metal structure 666 with side through-hole 667, and fourth left metal structure 668 with side through-hole 669. Each of the right metal structures 660 having angled channel openings substantially parallel with each other. The angled channel openings of each of the plurality of spaced apart right metal structures 660 having longitudinal axes, substantially perpendicular to the second elongated ridge 616. Each of the plurality of right metal structures 660 can include a first right metal structure 662 with side through-hole 663, second right metal structure 664 with side through-hole 665, third right metal structure 666 with side through-hole 667 and fourth right metal structure 668 with side through-hole 669.

Another set of spring clips 680 can be locked into the angled channel openings of the plurality of right metal structures 660 with additional cotter pins 670 in a similar manner to the cotter pins 670 used with the left plurality of metal structures 640.

The bent midportions 684 of each spring clip 680 is pushed over a portion of each head of the spikes 602, 604 retaining the spikes 602, 604 in place. FIG. 31B shows the bent midportion 684 of the spring clip 680 pushed over the heads of the spikes 602, 604.

Although the embodiments show the use of pins, such as cotter pins being used, other types of fasteners, such as but not limited to screws with or without nuts and washers, and the like can also be used.

While the above embodiments describe attaching base plates to tie plates, and attaching metal brackets and metal parts to metal tie plates by welding, other types of attachment techniques can be used, such as but not limited to mechanical attachments, and any other way of forming attachments, such as but not limited to forging, and the like.

The w spring clips can further be attached to mechanical structures shown and described in U.S. Pat. No. 5,520,330 to Brown et al., which is incorporated by reference.

700 Seventh Embodiment

FIG. 37A is an upper perspective side view of a seventh embodiment of a concave back C clip 780. FIG. 37B is a side view of the concave back C clip 780 of FIG. 37A. FIG. 37C is a front end left end view of the concave back C-clip 780 of FIG. 37B. FIG. 37D is a rear end right end view of the concave back C-clip 780 of FIG. 37B. FIG. 37E is a top side view of the concave back C-clip 780 of FIG. 37A. FIG. 37F is a bottom side view of the concave back C-clip 780 of FIG. 37A. FIG. 37G is a lower perspective side view of the C-clip of FIG. 37A.

Referring to FIGS. 37A-37G, concave back C-clip 380 can be formed from spring steel and include a leg 382 with concave top side and convex lower side with leg end 783, and an upward curved edge 784, downward curved edge 786 and outer hook end 788.

FIG. 38A is an exploded perspective view of using a left and right pairs of the C-clips 780 of FIGS. 37A-37G with a left and right double box housing structures 710 for holding spikes 402, 404 down through a rail tie plate 310 about a railroad tie 20.

FIG. 38B is an assembled perspective view of the seventh embodiment 700 of FIG. 38A.

FIG. 38C is a top view of the assembled view of FIG. 38B.

FIG. 39 is a front end view of FIG. 38C along arrows 39.

FIG. 40 is a cross-sectional view of FIG. 38C along arrows 40.

FIGS. 37A through 37 G shows a C shaped Elastic C clip made of spring steel going through a baseplate in FIGS. 38A and 39 B, 38 C, 39 and 40.

Railroad tie 20 sits on top of a railroad tie plate 310 between a front elongated ridge 312 and rear elongated ridge 314 (not shown).

Before assembly, the rail 20 is set on top of the railroad tie plate 310 between the shoulders 312, 314 of the rail tie plate 310, then the spikes 402, 404 are driven into the wooden railroad ties.

A double box housing structure 710 has a left rectangular vertical frame 712 with a left rectangular frame base 713 and a right rectangular vertical frame 714 with right rectangular frame base 715.

A double box housing structure 710 is is already attached to the tie plate 310 on both the left side and right side of the railroad tie 20.

Each double box housing structure 710 includes a left support tab 722 with through-hole 723 in left support tab, middle support tab 724 connects each box housing structure together, through-hole 725 in middle support tab 724 and right support tab 726 with through-hole 727 in right support tab.

Rivets 750 can attach each double box housing structure 710 to the tie plate 310.

The C-clips are pressed into the left vertical fame 712 and right vertical frame 714 so that the downwardly curved edge 786 sits within each frame base 713, 715, and the lower convex surface of the leg 782 presses down on the top of the heads of spikes 402, 404.

Similar C-clips 780 are shown and described in U.S. Pat. No. 5,782,406 to Lgwemezzie, which is incorporated by reference in its' entirety. shows an assembly which is designed to be embedded in a concrete railroad tie. Concrete railroad ties do not have railroad tie plates as the rail sits on a rubber pad and sits directly on the concrete with just a rubber pad in between. This expired patent only holds the rail to the concrete tie.

FIG. 41A is an exploded perspective view of using a left and right C-clips 780 of FIGS. 37A-37G with a left and right box housing structures 730 and raised auxiliary plates 760 for holding spikes 402, 404 through a rail tie plate 310 about a railroad tie 20.

FIG. 41B is another exploded view of FIG. 41A with lowered auxiliary plates 760.

Referring to FIGS. 41A-41B, a left and right single box housing structure 730 can be used on both sides of the railroad 20. Each single box housing structure 730 can include a rectangular vertical frame 732, rectangular frame base 733 with left support tab 742 and through-hole 743 and right support tab 746 with through-hole 747.

A left and right auxiliary plate(s) 760 can be used on both sides of the rail road 20. Each auxiliary plate 760 can have a left notch 762 for a left spike 402 and a right notch 766 for a right spike 404, with a rectangular cut-out 764.

Metal bars 770 can be welded on top of the notches 762, 766.

FIG. 41C is an assembled perspective view of FIGS. 41A and 41B.

FIG. 42 is a top view of the assembled view of FIG. 41V.

FIG. 43 is a front end view of FIG. 42 along arrows 43.

FIG. 44 is a cross-sectional view of FIG. 42 along arrows 44.

Before assembly, the rail 20 is set on top of the railroad tie plate 310 between the shoulders 312, 314 of the rail tie plate 310, then the spikes 402, 404 are driven into the wooden railroad ties.

Each single box housing structure 730 can be attached to the tie plate 310 by rivets 750.

FIG. 41 B shows an auxiliary plate 760 with notches 762, 766 where the spike head has metal surrounding the spike heads. The reason for this is the C clip 780 is pushed towards the rail 20. The spike heads surrounded by the auxiliary plate 760 keeps the plate from sliding forward when the clip 780 is pushed over the auxiliary plate 760. The auxiliary plate 760 is about the thickness of the spike head so the notches 762, 766 provide a space where the spike heads can sit as the spike head would be even with the top of the auxiliary plate 760. so that the auxiliary plate 760 can sit flush on top of the rail foot. Retaining bars 770 would be pre-welded in a factory across the tops of the spike head cutouts 762, 766. FIGS. 41B, 41C, 42, 43, 44 also show a single box housing structure 730 fixedly attached to the railroad tie plate 310.

The C clip 780 is pressed into the retaining baseplate. housing structure

Installation is as follows: The rail road tie is laid down. Then the railroad tie plate 310 is set on the tie, the rail 20 is then laid between the shoulders of the railroad tie plate 310, the spikes 402, 404 are driven. Then the auxiliary plate 760 is set in place and the notches 762, 766 are aligned over the spike heads with the pre-welded bars 770 covering the spike heads to retain them in place. Then the C clip 780 is pressed through the housing structure 730 and the foot of the C clip 780 pushes down on the auxiliary plate 760 which hold both the rail 20 down and retains the spikes 402, 404.

The C-clips 780 are pressed into the rectangular vertical frame 732 so that the downward curved edge 786 is located in the rectangular frame base 733 and the lower convex surface of each leg 782 presses down on the top of the auxiliary plate 760 holding down the heads of spikes 402, 404.

800 Eighth Embodiment—Convex back C clip

FIG. 45A is an upper perspective side view of a eighth embodiment of a convex back C clip 880 with extending tail. FIG. 45B is a side view of the convex back C clip 880 of FIG. 45A. FIG. 45C is a front end left end view of the convex back C-clip 880 of FIG. 45B. FIG. 45D is a rear end right end view of the convex back C-clip 880 of FIG. 45B. FIG. 45E is a top side view of the convex back C-clip 880 of FIG. 45A.

FIG. 45F is a bottom side view of the convex back C-clip 880 of FIG. 45A.

FIG. 45G is a lower perspective side view of the C-clip 880 of FIG. 45A.

Referring to FIGS. 45A-456G, the flat convex back C clip with extended tail 880 can include a leg 882 (tail) with concave top side & convex lower side with leg end 883, upward curved hook 884, and hook end 885.

FIG. 46A is an exploded perspective view of an eight embodiment 800 using a left and right pairs of the C-clips 880 of FIGS. 45A-45G with left and right double box housing structures 810 for holding spikes 402, 404 down through a rail tie plate 310 about a railroad tie 20.

FIG. 46B is an assembled perspective view of FIG. 45A.

FIG. 47 is a top view of the assembled view of FIG. 46B.

FIG. 48 is a front end view of FIG. 47 along arrows 48.

FIG. 49 is a cross-sectional view of FIG. 47 along arrows 49.

Referring to FIGS. 46A-49, a pair of double box housing structure with upper slots 810 are shown on each side of a rail 20. Each double box structure 880 can include a left rectangular vertical frame 812 with upper slot 813, a right rectangular vertical frame 814 with upper slot 815, a left support tab 822 with through-hole 823, a middle support tab 824 with through-hole 825, and a right support tab 826 with through-hole 827. Rivets 850 can pass through the tab through-holes to attach the double housing structure 810 to the tie plate 310. FIG. 45A through 45 G show a C clip made of spring steel with an extended tail.

FIGS. 46A 46B 47 48 and 49 show the C clip with extended tale 880 with hook end 885 going through the upper slots 813, 815 in the double box housing structure, which is being fixedly attached by rivets to the railroad tie plate 310. The C clips 880 are shown being pressed in t0 the rectangular vertical frames 812, 814 and the concave surface of the leg (tail) tail presses down on the railroad spikes 402, 404 and the leg (tai) holding both the rail 20 and spikes 402, 404 down.

FIG. 50A is an exploded perspective view of using a left and right C-clips 880 of FIGS. 45A-45G with a left and right box housing structures 830 and raised auxiliary plates 860 for holding spikes 402, 404 through a rail tie plate 310 about a rail 20.

FIG. 50B is another exploded view of FIG. 50A with lowered auxiliary plates 860.

FIG. 50C is an assembled perspective view of FIGS. 50A-50B.

FIG. 51 is a top view of the assembled view of FIG. 50C.

FIG. 52 is a front end view of FIG. 51 along arrows 52.

FIG. 53 is a cross-sectional view of FIG. 51 along arrows 53.

Referring to FIGS. 50A-53, auxiliary plate 860 can include left spike notch 862, and right spike notch 864 with bars 870 welded thereon. The auxiliary plate 860 can include a rectangular cut-out 864 along one side.

FIG. 50A is an exploded view of a rail section railroad tie plate 310, an auxiliary plate 860 with spike hold down bars 870 welded across the spike head cutouts (notches) 862, 866, and a single box housing structure 830 for the inverted C clip 880 with an extended tail and railroad spikes 402, 404.

FIG. 50B shows the auxiliary plate 860 set in place and the single box housing structure 830 and C clip 880 with the extended leg (tail).

FIG. 50C shows the assembly in place with the C clip 880 pressed into the rectangular vertical frame 832 and the extended leg (tail) 882 holding the auxiliary plate 860 down which holds the rail 20 down and the spikes 402, 404.

900 Ninth Embodiment—Double Hook Flat C Clip

FIG. 54A is an upper side perspective view of a double hook flat C-clip 980. FIG. 54B is a side view of the double hook flat C-clip 980 of FIG. 54A.

FIG. 54C is a front end view of the double hook flat C-clip 980 of FIG. 54A.

FIG. 54D is a rear end view of the double hook flat C-clip 980 of FIG. 54A.

FIG. 54E is a top view of the double hook flat C-clip 980 of FIG. 54A.

FIG. 54F is a bottom view of the double hook flat C-clip 980 of FIG. 54A.

FIG. 54G is a lower side perspective view of the double hook flat C-clip 980 of FIG. 54A.

Referring to FIGS. 54A-54G, the C-clip 980 can include a left inwardly facing hook 982, flat top 984, right inwardly facing hook 986 and stepped space 988 between hook ends.

FIG. 55A is an exploded perspective view of using left and right pairs of the double hook flat C-clips 980 of FIGS. 54A-54G with a left and right double box housing structures 910 with side slots for holding spikes 402, 404 down through a rail tie plate 310 about a rail 20.

FIG. 55B is an assembled perspective view of FIG. 55A.

FIG. 56 is a top view of the assembled view of FIG. 57.

FIG. 57 is a front end view of FIG. 56 along arrows 48.

FIG. 58 is a cross-sectional view of FIG. 56 along arrows 58. FIG. 5A.

Referring to FIGS. 54A-58, the double box housing structure 910 with side slots, can include a left box structure 912 with side slot 913, a right box structure 914 with side slot 915, and a left support tab and through-hole 922/923, a middle tab and through-hole 924/925 and right tab and through-hole 926/927 that allow for rivets to attach the double box housing structure 910 to the tie plate 310.

FIGS. 54A through 54G show a somewhat closed C clip (double hook flat C-clip 980) which is designed to pass over the top of its single box structure 930 with left inwardly facing hook 982 hooked into side slots 913/915 and curves back around over the top of the baseplate to right inwardly facing hook 986 to hold down the rail spikes 402, 404.

FIG. 55A shows the rail the railroad tie plate 310 the double box housing structure 910 which will be fixedly attached to the railroad tie plate 310 and the somewhat double hook flat C-clip 980 which are made of spring steel.

FIG. 55B shows the whole assembly installed with the double hook flat C-clips 980 pressed in to hold both spikes 402, 404 and rail 20 down.

FIG. 56 is a top view of FIG. 55B

FIG. 57 is a front view of FIG. 56 along arrows 57.

FIG. 58 is a cross-sectional view of FIG. 56 along arrows 58.

FIG. 59A is an exploded perspective view of using a left and right double hook flat C-clips 980 of FIGS. 54A-54G with a left and right box housing structures 930 with side slots and raised auxiliary plates 960 for holding spikes 402, 404 through a rail tie plate 310 about a rail 20.

FIG. 59B is another exploded view of FIG. 59A with lowered auxiliary plates.

FIG. 59C is an assembled perspective view of FIGS. 59A-59B.

FIG. 60 is a top view of the assembled view of FIG. 59C.

FIG. 61 is a front end view of FIG. 60 along arrows 61.

FIG. 62 is a cross-sectional view of FIG. 60 along arrows 62.

Referring to FIGS. 591-62, the single box structure with side slot 930 includes a single box structure 932 and side slot 933, and left support tab and through-hole 942, 943 and right support tab and through-hole 946, 947 and rivets 950 that fixably attach the single box structure(s) 930 to the tie plate 310.

An auxiliary plate 960 can include left spike notch 962 and right spike notch 966 along with metal bars 970 that can be welded over the notches 962, 964, and rectangular cut-out 964 along one side. Right inwardly facing hook 982 can fit into side slot 933, and opposite facing right inwardly facing hook 986 presses against auxiliary plate 960.

FIG. 59A shows an exploded view of the rail 20, the auxiliary plate 960, the railroad tie plate 310 the single box structure(s) 930, the double hook flat C-clips 980, and spikes 402, 404.

FIG. 59B shows the single box structure(s) 930 is position over the rail 20 and spikes 402, 404, and the double hook flat C-clips 980.

FIG. 59C shows the auxiliary plate 960 installed over the spike heads 402, 404 and on top of the rail 20 foot with the double hook flat C-clips 980 press in locking in to place on top of the auxiliary plate 960 which hold both the rail 20 and spikes 402, 404 in place.

1000 Tenth Embodiment Double Hook Two Wire C Clip

FIG. 63A is an upper front side perspective view of a double hook two wire C clip 1080. FIG. 63B is a side view of a double hook two wire C clip 1080 of FIG. 63A. FIG. 63C is a front end view of a double hook two wire C clip 1080 of FIG. 63A. FIG. 63D is a rear end view of a double hook two wire C clip 1080 of FIG. 63A. FIG. 63E is a top view of a double hook two wire C 1080 clip of FIG. 63A. FIG. 63F is a bottom view of a double hook two wire C clip 1080 of FIG. 63A.

FIG. 63G is a lower rear side perspective view of a double hook two wire C clip 1080 of FIG. 63A.

Referring to FIGS. 63A-63G, the double hook two wire C clip 1080 can include a front end with an inwardly facing hook 1082, and generally flat top 1084, and a rear end with an inwardly facing hook 1086, along with a stepped space 1088 between hook ends of hooks 1082, 1086.

FIG. 64A is an exploded perspective view of using a left and right pairs of the double hook two wire C clips 1080 of FIGS. 63A-63G with a left and right double box housing structures 1010 with side slots for holding spikes 402, 404 down through a rail tie plate 310 about a rail 20.

FIG. 64B is an assembled perspective view of FIG. 64A.

Referring to FIGS. 63A-64B, a double box housing structure with side slots 1010 can be positioned on both sides of a rail 20. Each double box housing structure 1010 can include a left box structure 1012 with side slot 103, and a right box structure 1014 with side slot 1015. A left tab with through-hole 1022/1023, a middle tab with through-hole 1024/1025 and a right tab with through-hole 1026/1027 can mount the double box housing structure 1010 to the tie plate with rivets 1050.

FIGS. 63A through 63G show a similar closed off C clip to clips 980 (in FIGS. 54A-54G) but it being made of a spring steel wire/rod material. Its construction is easier to fabricate and serves the same function as the solid clips 980 (in FIGS. 54A-54G) closed off version.

Both the solid closed of C (980 (in FIGS. 54A-54G)) and wire rod versions (FIGS. 63A-64G) are well known in the industry and are both are in the public domain. See for example, U.S. Pat. No. 3,067,947 to Deenik et al.; 3,939,617 to Eisses; and U.S. Pat. No. 4,399,941 to Lubbers, which are all incorporated by reference in their entirety.

FIG. 64A shows the rail the rail road tie plate 310 the double box housing structure(s) 1010 which are to be fixedly attached to the railroad tie plates 310 the rod/wire C clips (1080 FIGS. 63A-64G) and the spikes 402, 404.

FIG. 64B shows the C clips 1080 pressed in to the side slots 1013, 1015 of the housing structure(s) 1010) with the top 1084 of the C clips 1080 pushed up and over the top of the left box structure 1012 and right box structure 1014 snapping down into position with the right inwardly facing hook(s) 1082 over the spike heads 402, 404 holding both the spikes 402, 404 and the rail d20 down.

FIG. 65A is an exploded perspective view of using a left and right double hook two wire C clips 1080 of FIGS. 63A-63G with a left and right single box housing structures 1030 with side slots and raised auxiliary plates 1060 for holding spikes 402, 404 through a rail tie plate 310 about a rail 20.

FIG. 65B is another exploded view of FIG. 65A with lowered auxiliary plates 1060.

FIG. 65C is an assembled perspective view of FIGS. 65A-65B.

FIG. 66 is a top view of the assembled view of FIG. 65C.

FIG. 67 is a front end view of FIG. 66 along arrows 67.

FIG. 68 is a cross-sectional view of FIG. 60 along arrows 68.

Referring FIGS. 65A-68, single box structure with side slot 1030 can be attached to the tie plate 310 on both sides of the rail 20.

Each single box structure 1030 can include a single box 1032 with side slot 1033, a left tab with through-hole 1042/1043 and a right tab with through-hole 1046/1047, and rivets 1050 for fixably attaching the single box structures 1010 to the tie plate 310.

FIG. 65A shows the rail the auxiliary plate 1060 with the pre-welded bars 1070 across the spike cutouts (notches) 1062, 1064, the wire rod clips 1080, the single box structure (s) 1030, the railroad tie plate 310, spikes 402, 404 and a single box structure(s) 1030 with side slot 1033 for the C clip 1080 which will be fixedly attached to the railroad tie plate 310.

FIG. 65B shows the bars 1070 over the cutouts (notches) 1062, 1064 in the auxiliary plate 106 said bars 1070 are pre-welded over the cutouts 1062, 1064 in a factory.

FIG. 65C shows the auxiliary plate 1060 installed over the top of the spike heads 402, 404 and on top of the rail 20 foot.

The left inwardly facing hook 1082 of the C clip(s) 1080 are pressed into slot(s) 1033 and flat top 1084 passes over the top of the single box structure 1032 with the right inwardly facing hook 1086 snapping in to place over the auxiliary plate 1060 to hold both the rail 20 and spikes 402, 404 down.

1100 Eleventh Embodiment G clip

FIG. 69A is an upper perspective view of the G-clip 1180. FIG. 69B is a lower perspective view of the G-clip 1180 of FIG. 69A. FIG. 69C is a top view of the G-clip 1180 of FIG. 69A. FIG. 69D is a bottom view of the G-clip 1180 of FIG. 69A. FIG. 69E is a right perspective view of the G-clip 1180 of FIG. 69A.

FIG. 69F is a left perspective view of the G-clip 1180 of FIG. 69A.

Referring to FIGS. 69A-69F, the G-clip 1180 can include flat protruding end 1182, first bend, 1184, second bend 1186 and straight end 1188, made of spring steel, are well known in the rail industry.

As described in the background section, G-clips are well known. See for example E813 RAIL CLIP, E187 RAIL CLIP, and E2055 RAIL CLIP, manufactured by Hanzi Industrial International Co., Ltd, of SHANGHAI, CHINA. See for example, U.S. Pat. No. 4,050,284 to Miller, which is incorporated by reference in its' entirety.

FIG. 70A is an exploded view of the G-clips 1180 with collars 110 and raised auxiliary plates 1160 with pre-welded bars 1170 on both sides of the rail 20, above the spikes 402, 404 in the tie plate 310.

FIG. 70B is another exploded view of FIG. 70B with auxiliary plates 1160 with pre-welded bars 1170 on top of the spike 402, 403 heads and footer edge of the rail 20.

FIG. 70C is an assembled view of FIG. 70A-70B with collars 1110 fixably attached to the tie plate 310 with the G-clips 1180 attached thereto pressing down on both the auxiliary plates 1160 over the spike heads 402, 403 and on the footer edge of the rail 20.

FIG. 71 is a top view of the assembled view of FIG. 70C.

FIG. 72 is a front end view of FIG. 71 along arrows 72.

FIG. 73 is a cross-sectional view of FIG. 71 along arrows 73.

Referring to FIGS. 70A-73, each collar 1110 can include a front curved end 112 and base 114 with downwardly extending stud 116. The auxiliary plate 1160 can include a left notch 1162, middle rectangular section 1164 and right notch 1166, with a bar 1170 pre-welded over the notches 1162, 1116.

FIG. 70A shows a rail 20, a G-clip 1180, a retaining collar f110 for the G clip 1180, an auxiliary plate 1160 with a pre welded bar 1170 over the spike head cutouts (notches) 1162, 1166 in the auxiliary plate 1160, spikes 402, 403 and a railroad tie plate 310. The collar 1110 is fixedly attached to the railroad tie plate 310 by a stud 1116 on the bottom of the collar 1110 which is inserted in to the rail road tie plate 310 through an aperture whereby the stud on the backside of the plate 310 Is heated and a head is forged to firmly hold the collar 1110 in place. The collar 1110 can also be welded to the railroad tie plate 310. FIG. 70B shows the auxiliary plate 1160 installed over the top of the spike heads 402, 403 and sitting on top of the rail foot edge of the rail 20.

FIG. 70 C shows the straight leg end 1188 of the G-clip 1180 pressed into the collar 1110 under the front curved end 1112, and the foot (flat protruding end 1182) of the G-clip 1180 pressing down on top of the auxiliary plate 1160 holding the rail 20 and the spikes 402, 403 down.

1200 Twelfth Embodiment E Clip

FIG. 74A is an upper perspective view of a W-clip 1280. FIG. 74B is a top view of the W-clip 1280 of FIG. 74A. FIG. 74C is a bottom view of the W-clip 1280 of FIG. 74A. FIG. 74D is a right side view of the W-clip 1280 of FIG. 74A. FIG. 74E is a rear end view of the W-clip 1280 of FIG. 74A. FIG. 74F is a front end view of the W-clip 1280 of FIG. 74A.

Referring to FIGS. 74A-74F, the W-clip includes left leg 1282, notch 1283 on left leg end 1282, left bend 1284, middle bend 1285, right bend 1286, right leg 1288, and notch 1289 on right leg end 1288.

FIG. 75A is an exploded perspective view of the W-clips 1280, clip holder structure 1210, raised auxiliary plate 1260 with pre-welded bars 1270 above a tie plate 310 on both sides of a rail 20.

FIG. 75B is another exploded perspective view of FIG. 75A with the auxiliary plate 1260 with pre-welded bars 1270 installed on both sides of a rail 20.

FIG. 75C is an assembled perspective view of FIGS. 74A-74B with W-clips 1280 pressed into the holder structure 1210, which is riveted to the tie plate 310 by rivets 1250.

FIG. 76 is a top view of the assembled view of FIG. 75C. FIG. 77 is a front end view of FIG. 76 along arrows 77. FIG. 78 is a cross-sectional view of FIG. 76 along arrows 78.

Referring to FIGS. 75A-79, a clip holder structure 1210 can include a base plate 1220, a left tab 1222, with through-hole 1223, a raised middle section 1224, a right tab 1226 with through-hole 1227. On top of the middle section 1224 can be a left facing bracket 1230 and right facing bracket 1240. Rivets 1250 can be used to fixably attach the clip holder structure 1210 to the tie plate 1310.

FIGS. 74A through 74F show a W Clip 1280 which is made of spring steel. FIG. 75A shows a rail an auxiliary plate 1260 with a pre welded bar(s) 1270 over the top of the spike head cutouts 1262, 1266, a clip holder structure 1210 and base plate 1220 with L shaped brackets 1230, 1240, a W clip 1280 with notches 1283, 1289 on the legs 1282, 1288 of the W clip 1280 to lock the W-clip 1280 in place with the L brackets 1230, 1240 on the base plate 1220, a railroad tie plate 310 where the baseplate 1220 with L brackets 1230, 1240 is fixedly attached to the railroad tie plate 310 and spikes 402, 404.

FIG. 75B shows the auxiliary plate 1260 over the top of the spike heads 402, 404 and sitting on top of the foot edge of the rail 20.

FIG. 75C shows the W-Clip 1280 pressed into the base plate 1230 with the notches 1283, 1289 in Legs 1282, 1288 of the W-clip 1280 secured in to the L shaped brackets 1230, 1240 on the base plate 1220. The W-clip 1280 is pressing down on the auxiliary plate 1260 which is holding down both the rail 20 and the spikes 402, 404.

While the embodiments show and describe retaining railroad spikes to rail ties, the embodiments can be used to retain railroad screw shaped spikes to rail ties.

Although fasteners, such as nuts and washers are shown and described, other types of fasteners can be used, such as but not limited to locking washers, and the like. Parts can be attached together by welding, forging, heating with and without hydraulic presses and the like.

While some embodiments reference using upwardly protruding studs with threaded ends for nuts to attach metal plates to the metal tie plate, other techniques can be used to fasten metal parts together.

For example, an upwardly protruding rod without a threaded end can be used where the rod is heated and a hydraulic press compresses the upper end forming a head attaching a horizontal plate to the tie plate. See for example, FIG. 19B, and anywhere nuts and washers were referenced.

The upwardly protruding rod can initially be a stud with a head on one end that is pushed up through holes in the tie plate, and the head of the stud can be welded to the undersurface of the tie plate. Afterward a horizontal plate can be attached to the tie plate as previously described.

This new railroad tie plate invention is very important to the safety of the railroad industry. Currently rail spikes are constantly coming out and with the constant pounding of the freight trains no method of keeping them in exists.

Lag screws are also prone to coming loose and this causes the rail gauge too separate causing train derailments.

A Global rail infrastructure company sees the value in this invention.

It could save countless lives and many millions of dollars in damage caused by train derailments.

Although specific advantages have been enumerated above, various embodiments may include some, none, or all of the enumerated advantages.

Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

To aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A railroad spike retention system for retaining spikes to rail ties, comprising:

a metal tie plate with a plurality of through-holes for railroad spikes, the metal tie plate having a top surface facing upward, and a bottom surface facing downward; and a plurality of metal structures attached to the upper surface of the tie plate; and a plurality of flat concave back C clips having a portion that covers a head portion of each railroad spike for preventing each railroad spike from coming out.

2. The railroad spike retention system of claim 1, wherein each flat concave back C clip includes a leg with concave top side and convex lower side, an upward curved edge and a downward curved edge, wherein the downward curved edge presses against the head portion of each railroad spike.

3. The railroad spike retention system of claim 1, wherein each metal structure includes:

a rectangular vertical frame and rectangular frame base, and a left mount tab, and right mount tab; and rivets for attaching the left mount tab and the right mount tab to the tie plate.

4. The railroad spike retention system of claim 3, further comprising:

an auxiliary plate having a left notch with a left welded bar covering the left notch and right notch with a right welded bar covering the right notch, and a rectangular cut-out along one side of the auxiliary plate, wherein the downward curved edge on the C-clip presses against the auxiliary plate which presses down on each head portion of each railroad spike.

5. A railroad spike retention system for retaining spikes to rail ties, comprising:

a metal tie plate with a plurality of through-holes for railroad spikes, the metal tie plate having a top surface facing upward, and a bottom surface facing downward; and a plurality of metal structures attached to the upper surface of the tie plate; and a plurality of flat convex back C clips with extended legs having a portion that covers a head portion of each railroad spike for preventing each railroad spike from coming out.

6. The railroad spike retention system of claim 5, wherein each flat convex back C clip with extended leg includes an extended leg with concave top side and convex lower side and outer end, an opposite facing upward curved hook with hook end, wherein the extended leg presses against the head portion of each railroad spike.

7. The railroad spike retention system of claim 6, wherein each metal structure includes:

a rectangular vertical frame and an upper slot, and a left mount tab, and right mount tab; and rivets for attaching the left mount tab and the right mount tab to the tie plate.

8. The railroad spike retention system of claim 7, further comprising:

an auxiliary plate having a left notch with a left welded bar covering the left notch and right notch with a right welded bar covering the right notch, and a rectangular cut-out along one side of the auxiliary plate, wherein the extended leg on the C-clip presses against the auxiliary plate which presses down on each head portion of each railroad spike.

9. A railroad spike retention system for retaining spikes to rail ties, comprising:

a metal tie plate with a plurality of through-holes for railroad spikes, the metal tie plate having a top surface facing upward, and a bottom surface facing downward; and a plurality of metal structures attached to the upper surface of the tie plate; and a plurality of double hook flat C-clips having a portion that covers a head portion of each railroad spike for preventing each railroad spike from coming out.

10. The railroad spike retention system of claim 9, wherein each double hook flat C-clips includes a left inwardly facing hook, a flat top, and a right inwardly facing hook.

11. The railroad spike retention system of claim 9, wherein each metal structure includes:

a box structure with a left mount tab, and right mount tab; and rivets for attaching the left mount tab and the right mount tab to the tie plate.

12. The railroad spike retention system of claim 11, further comprising:

an auxiliary plate having a left notch with a left welded bar covering the left notch and right notch with a right welded bar covering the right notch, and a rectangular cut-out along one side of the auxiliary plate, wherein the double hook flat C-clips press down spikes into a tie plate and hold down a rail.

13. A railroad spike retention system for retaining spikes to rail ties, comprising:

a metal tie plate with a plurality of through-holes for railroad spikes, the metal tie plate having a top surface facing upward, and a bottom surface facing downward; and a plurality of metal structures attached to the upper surface of the tie plate; and a plurality of double hook two wire C-clips having a portion that covers a head portion of each railroad spike for preventing each railroad spike from coming out.

14. The railroad spike retention system of claim 13, wherein each double hook two wire C-clips includes a closed left inwardly facing hook, a flat top, and right inwardly facing hook with exposed wire ends.

15. The railroad spike retention system of claim 14, wherein each metal structure includes:

a box structure with a left mount tab, and right mount tab; and rivets for attaching the left mount tab and the right mount tab to the tie plate.

16. The railroad spike retention system of claim 15, further comprising:

an auxiliary plate having a left notch with a left welded bar covering the left notch and right notch with a right welded bar covering the right notch, and a rectangular cut-out along one side of the auxiliary plate, wherein the double hook two wire C-clips press down spikes into a tie plate and hold down a rail.

17. A railroad spike retention system for retaining spikes to rail ties, comprising:

a metal tie plate with a plurality of through-holes for railroad spikes, the metal tie plate having a top surface facing upward, and a bottom surface facing downward; and a plurality of metal structures attached to the upper surface of the tie plate; and a plurality of G-clips having a portion that covers a head portion of each railroad spike for preventing each railroad spike from coming out.

18. The railroad spike retention system of claim 17, wherein each G-clip includes a flat protruding foot end, a first bend, a second bend, and an opposite straight end.

19. The railroad spike retention system of claim 18, wherein each metal structure includes:

a collar with a front curved end, a base and a stud extending below the base, wherein the collar is fixedly attached to the tie plate by inserting the stud into an aperture in the tie plate, and is forged or welded in place.

20. The railroad spike retention system of claim 19, further comprising:

an auxiliary plate having a left notch with a left welded bar covering the left notch and right notch with a right welded bar covering the right notch, and a rectangular middle portion along one side of the auxiliary plate, wherein the G-clips press hold down both the spikes and a rail.

21. A railroad spike retention system for retaining spikes to rail ties, comprising:

a metal tie plate with a plurality of through-holes for railroad spikes, the metal tie plate having a top surface facing upward, and a bottom surface facing downward; and a plurality of metal structures attached to the upper surface of the tie plate; and a plurality of W-clips having a portion that covers a head portion of each railroad spike for preventing each railroad spike from coming out.

22. The railroad spike retention system of claim 21, wherein each W-clip includes left leg, notch on end, left bend, middle bend, right bend 1286, and right leg with notch on end.

23. The railroad spike retention system of claim 22, wherein each metal structure includes:

base plate, a left tab with through-hole, raised middle section, a right tab with through-hole, on top of the middle section is a left facing bracket and right facing bracket 1240, and Rivets to fixably attach the clip holder structure to the tie plate.

24. The railroad spike retention system of claim 23, further comprising:

an auxiliary plate having a left notch with a left welded bar covering the left notch and right notch with a right welded bar covering the right notch, and a rectangular middle cut-out portion along one side of the auxiliary plate, wherein the W-clips press hold down both the spikes and a rail.

25. A railroad spike retention system for retaining spikes to rail ties, comprising:

a railroad tie plate with a baseplate fixably attached; and an elastic rail clip held by the baseplate, wherein the rail clip holds down at least one spike and a rail.

26. A railroad spike retention system for retaining spikes to rail ties, comprising:

a railroad tie plate with a baseplate fixably attached;

an elastic rail clip; and an auxiliary plate with notches and a bar welded over the notches, wherein the auxiliary plate is held down by the rail clip, and the auxiliary plate holds down at least one spike and a rail.

27. A railroad spike retention system for retaining spikes to rail ties, comprising:

a railroad tie plate with a baseplate fixably attached directly to a top of the tie plate; and a metal rail clip held by the baseplate, wherein the metal rail clip holds down at least one spike and a rail.

* * * * *